US010328357B2

(12) United States Patent
Tarng et al.

(10) Patent No.: US 10,328,357 B2
(45) Date of Patent: Jun. 25, 2019

(54) DISCLUB GOLF: DISCLUB, GOLFDISC AND DISCOPTER

(71) Applicant: Min Ming Tarng, San Jose, CA (US)

(72) Inventors: Min Ming Tarng, San Jose, CA (US); Mei-Jech Lin, San Jose, CA (US); Eric Yu-Shiao Tarng, San Jose, CA (US); Alfred Yu-Chi Tarng, San Jose, CA (US); Angela Yu-Shiu Tarng, San Jose, CA (US); Huang-Chang Tarng, San Jose, CA (US)

(73) Assignee: PDCGA:Professional DisClub Golf Association/Tang System, San Jose, CA (US)

( * ) Notice: Subject to any disclaimer, the term of this patent is extended or adjusted under 35 U.S.C. 154(b) by 0 days.

(21) Appl. No.: 15/810,005

(22) Filed: Nov. 11, 2017

(65) Prior Publication Data

US 2018/0093197 A1 Apr. 5, 2018

Related U.S. Application Data

(63) Continuation-in-part of application No. 12/157,785, filed on Jun. 14, 2008, now Pat. No. 7,857,718.

(51) Int. Cl.
*A63B 63/00* (2006.01)
*A63B 65/12* (2006.01)
(Continued)

(52) U.S. Cl.
CPC ..... *A63H 33/18* (2013.01); *A63B 63/00* (2013.01); *A63B 67/00* (2013.01); *A63H 27/00* (2013.01);
(Continued)

(58) Field of Classification Search
CPC ..... A63H 33/18; A63H 27/00
See application file for complete search history.

(56) References Cited

U.S. PATENT DOCUMENTS 3,613,295 A * 10/1971 Everett ..... A63H 33/18 446/46
4,135,324 A * 1/1979 Miller ..... A63H 33/18 446/47

(Continued)

OTHER PUBLICATIONS https://www.pdga.com/introduction; www.pdga.com; Jan. 5, 2009 (Year: 2009).*

*Primary Examiner* — Eugene L Kim
*Assistant Examiner* — Jeffrey S Vanderveen

(57) ABSTRACT

The Disclub Golf is to swivel the disclub to launch the golfdisc to fly. The golfdisc has the nearly right triangle rim with straight bottom edge and triangle flap at the trail edge of the bottom edge. On the surface of rim, there are dimples to extend the flying distance of the golfdisc. There are smart phone, camera and video display, etc. embedded in the rim of golfdisc to be the head wearing discopter. The smart hat iHat headwear discopter takes off from the head of the disc golfer to search the lost golfdisc in the golf course. The wrist-wearing monitor makes the remote surveillance with discopter. The disclub has the versatile combinations of straight pole and golf-style stick to adapt the different situations of disclub golf. The extendable disclub has the pole sliding inside the tube. There are joints for the self-portrait and golf-style disclub.

19 Claims, 88 Drawing Sheets

(51) Int. Cl.

| | |
|---|---|
| ***A63B 67/00*** | (2006.01) |
| ***A63B 67/06*** | (2006.01) |
| ***A63H 27/00*** | (2006.01) |
| ***A63H 27/14*** | (2006.01) |
| ***A63H 33/18*** | (2006.01) |

(52) U.S. Cl.
CPC ..... *A63H 27/14* (2013.01); *A63B 65/122* (2013.01); *A63B 67/06* (2013.01)

(56) References Cited

U.S. PATENT DOCUMENTS

| | | | | |
|---|---|---|---|---|
| 4,795,111 | A * | 1/1989 | Moller | B64C 27/00 244/100 R |
| 7,081,032 | B1 * | 7/2006 | Holgate | A63H 33/18 446/46 |
| 2002/0017759 | A1 * | 2/2002 | McClung, III | A01K 15/025 273/317 |
| 2006/0189246 | A1 * | 8/2006 | Stark | A63H 33/18 446/46 |
| 2015/0360138 | A1 * | 12/2015 | Dawson | A63H 33/18 446/47 |
| 2016/0354707 | A1 * | 12/2016 | Polk | A63H 33/18 |

* cited by examiner

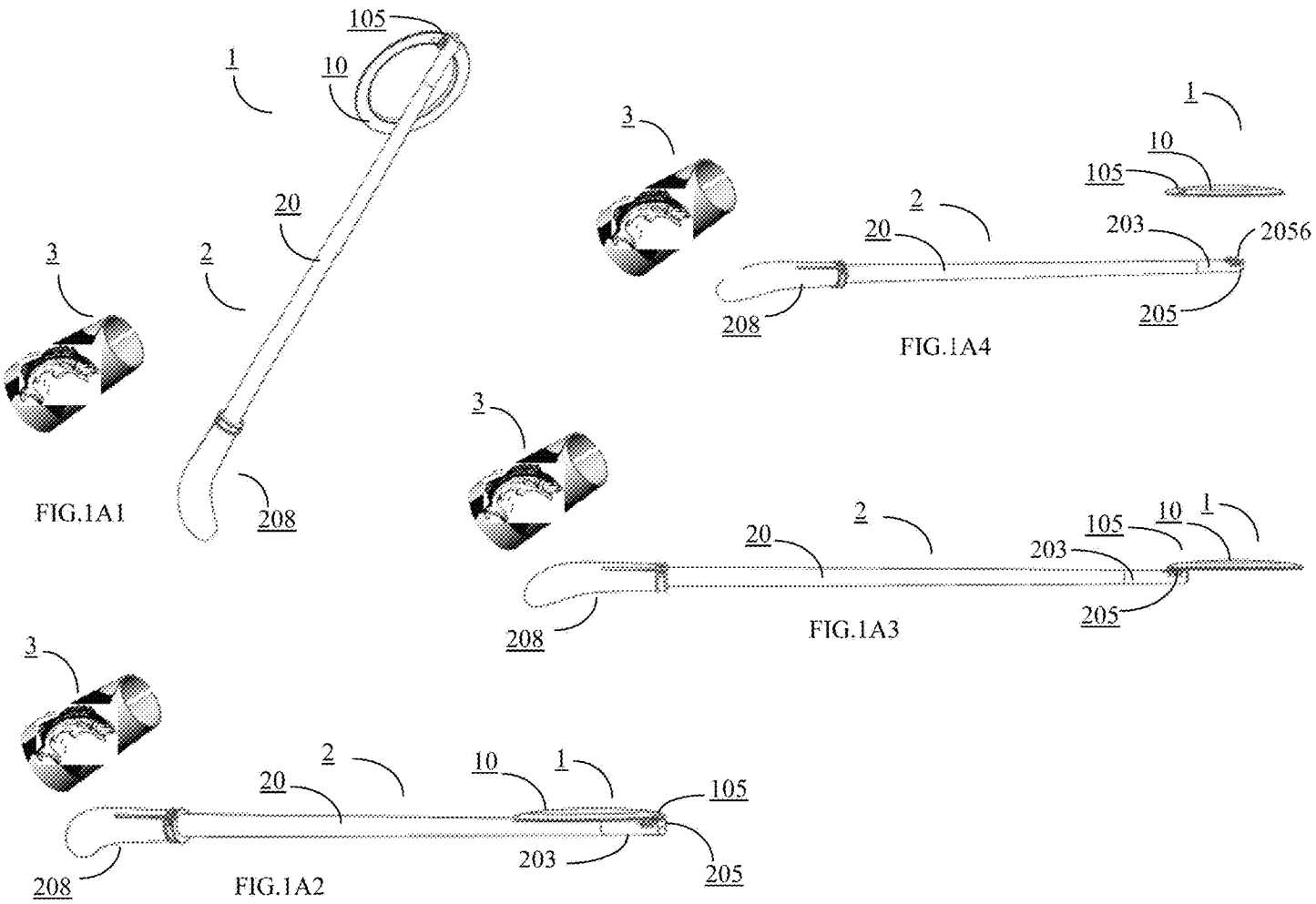
FIG.1A1
FIG.1A2
FIG.1A3
FIG.1A4

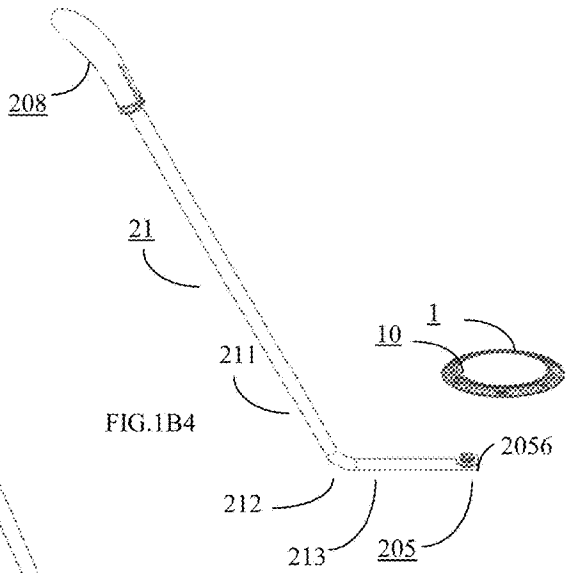
FIG.1B4
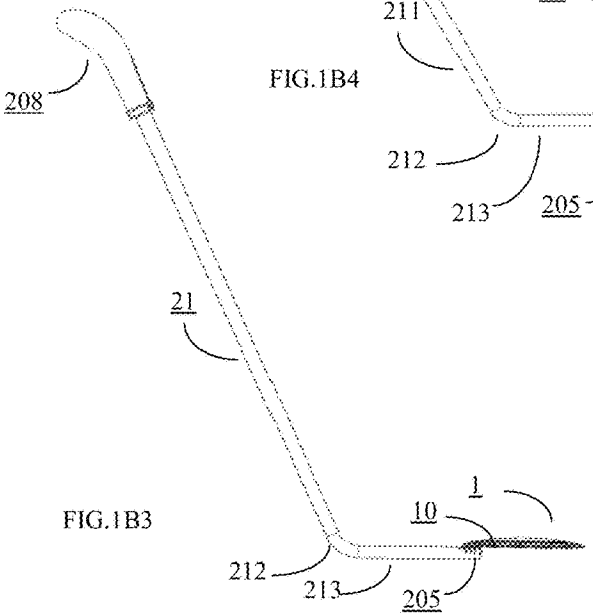
FIG.1B3
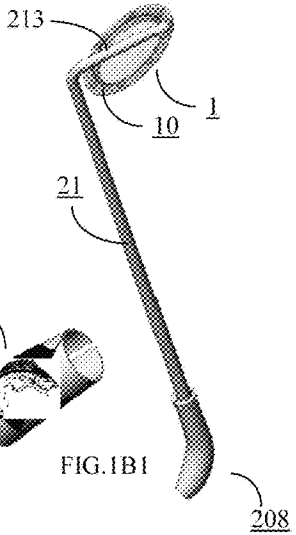
FIG.1B1
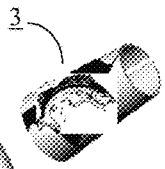
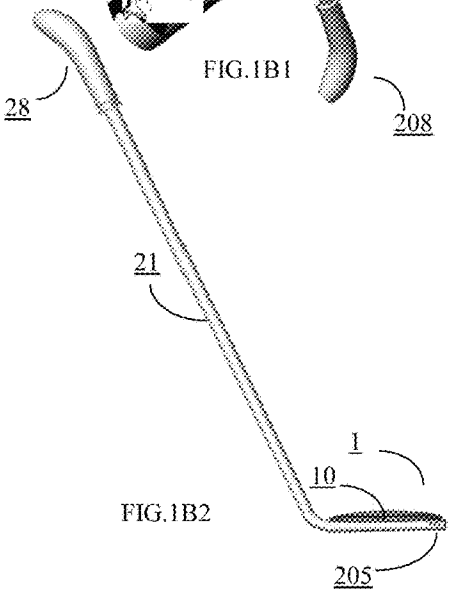
FIG.1B2

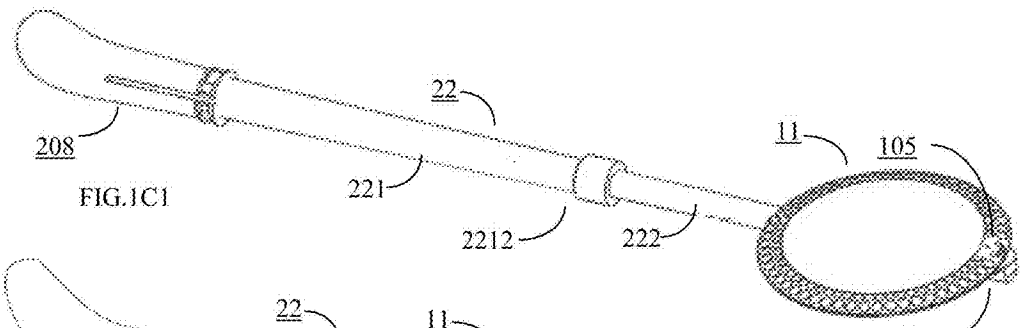
FIG.1C1
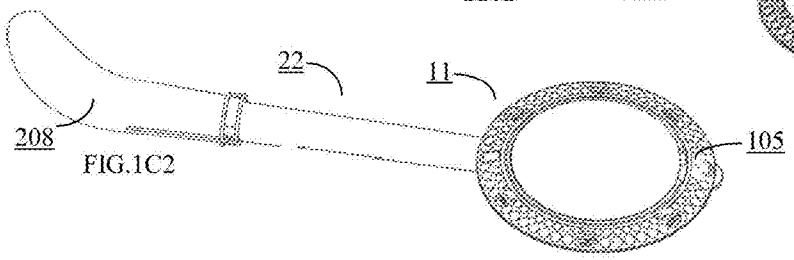
FIG.1C2
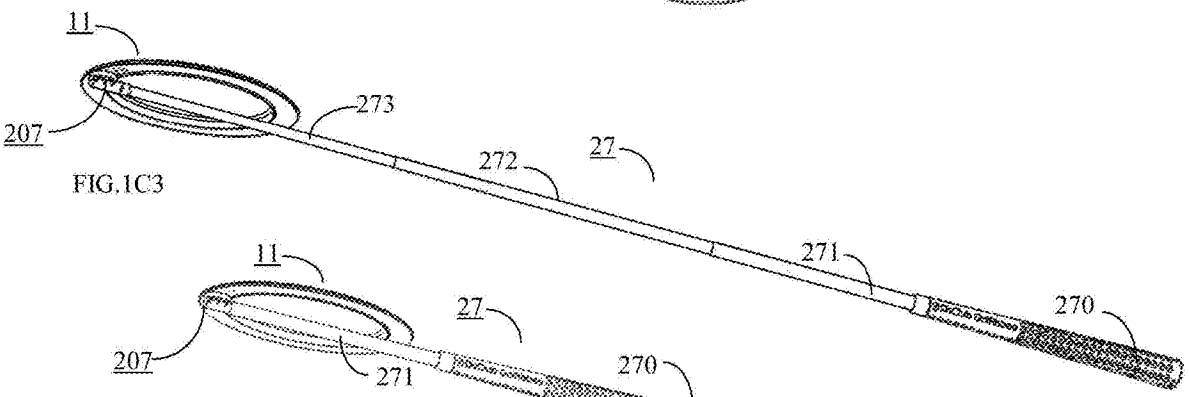
FIG.1C3
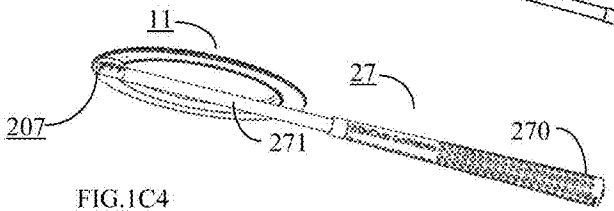
FIG.1C4

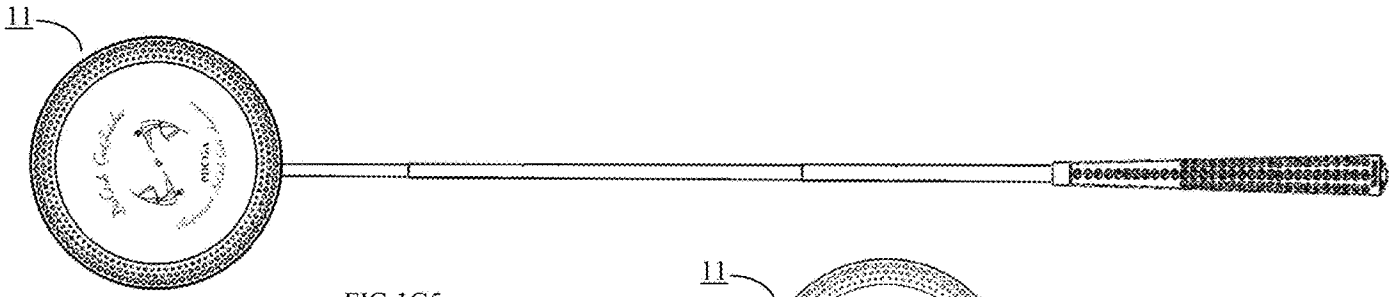
FIG.1C5
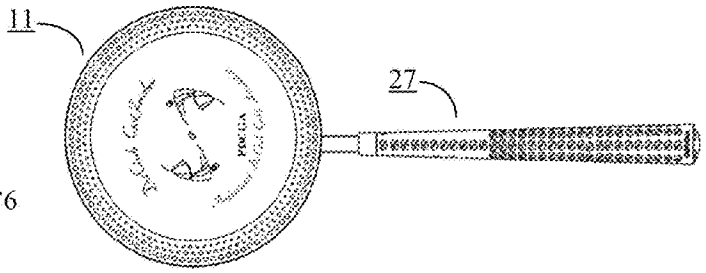
FIG.1C6
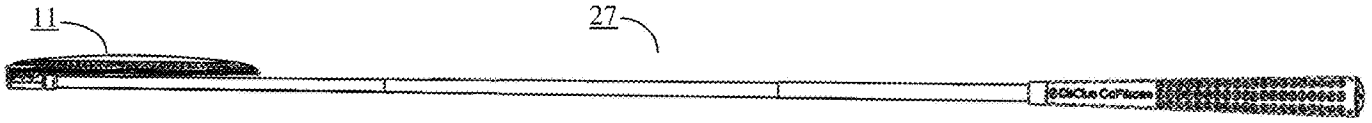
FIG.1C7
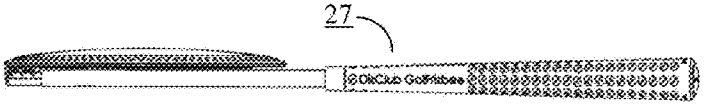
FIG.1C8

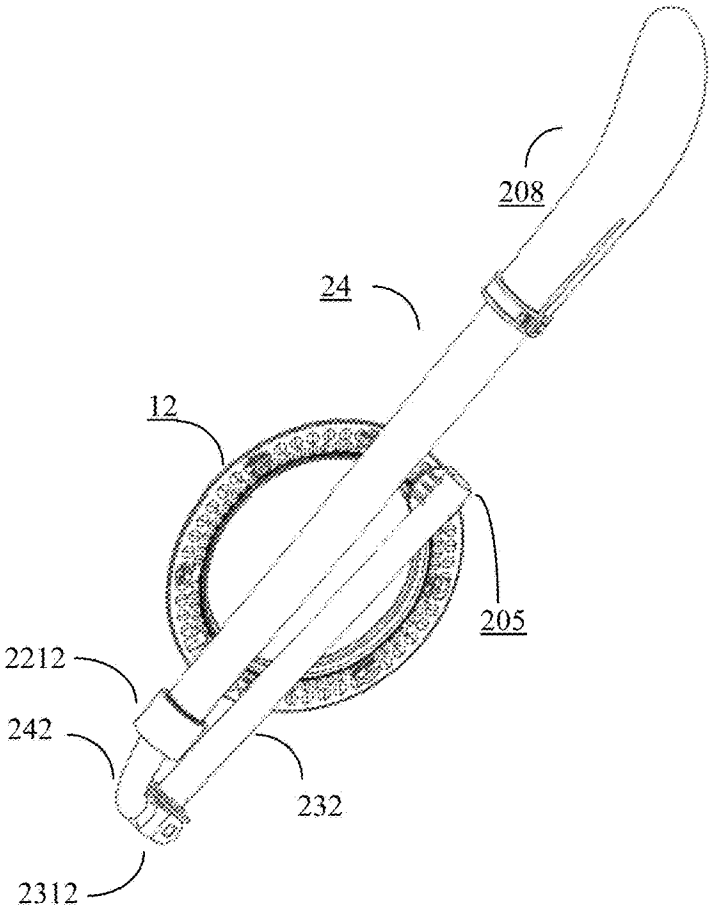
FIG.1D2B

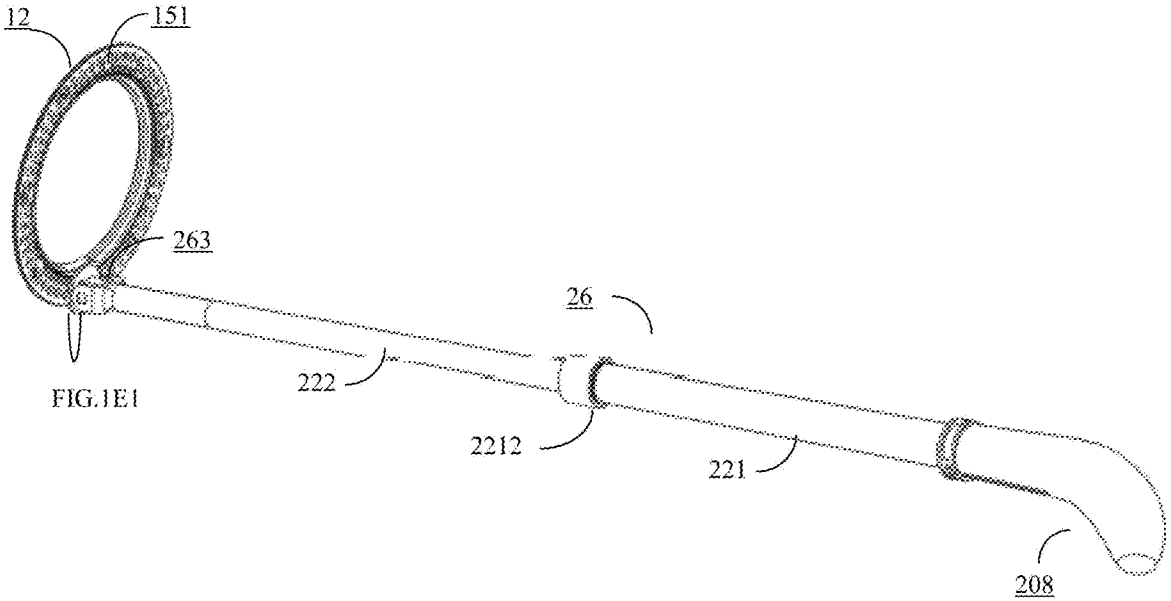
FIG.1E1
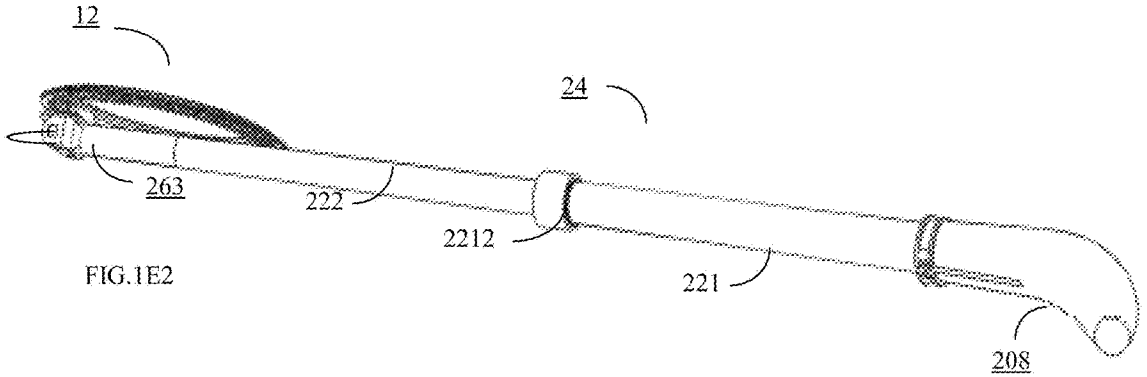
FIG.1E2

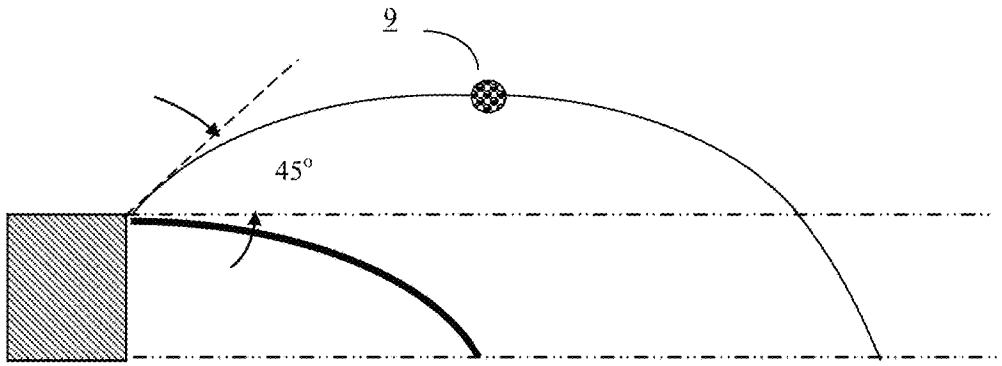
FIG.2A
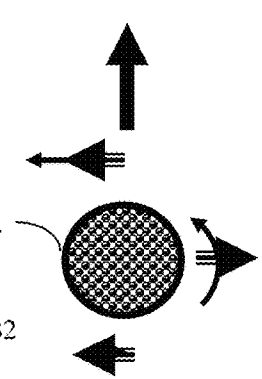
FIG.2B2
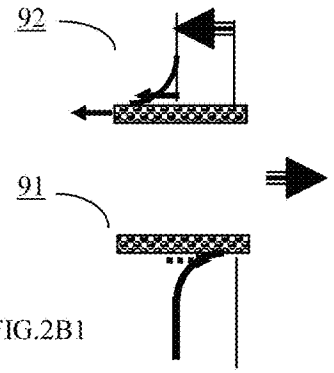
FIG.2B1

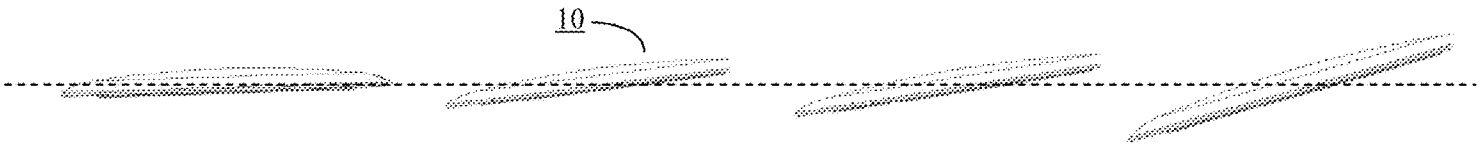
FIG.3A
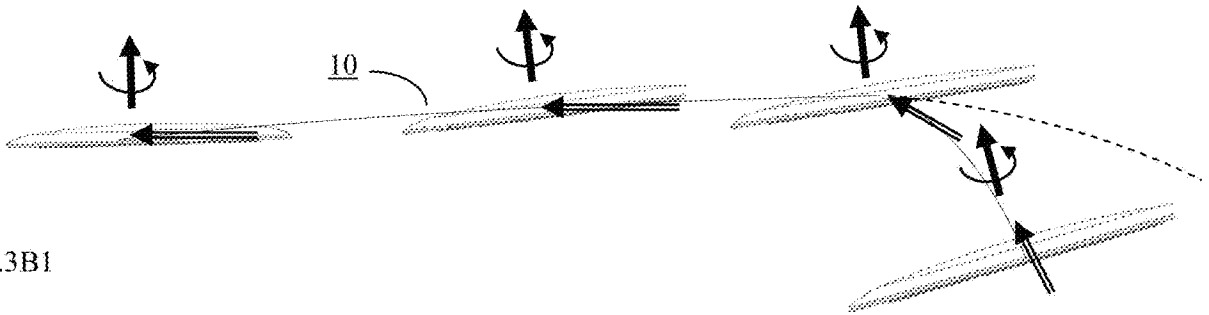
FIG.3B1
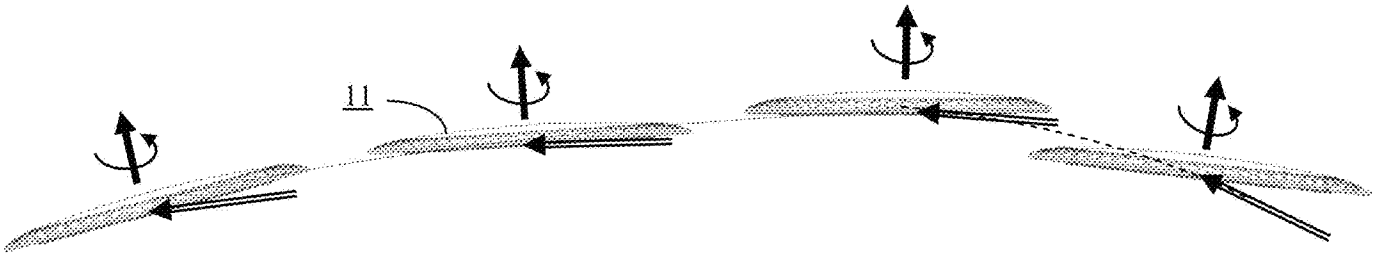
FIG.3B2

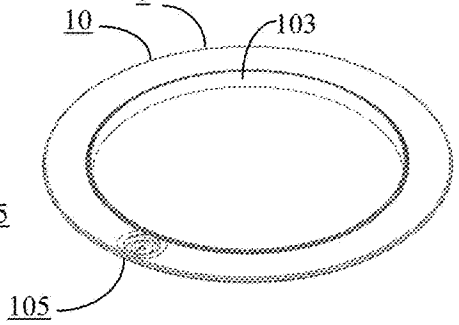
FIG.4C1
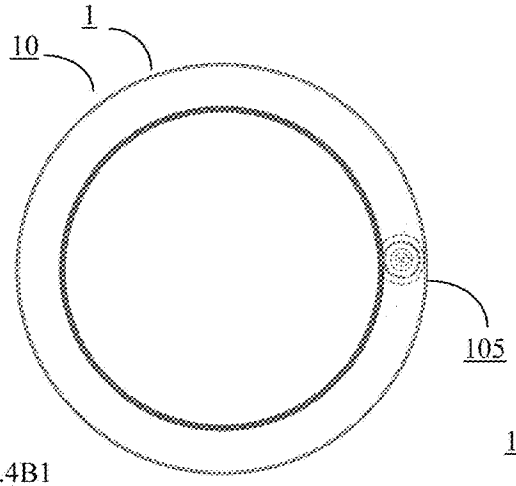
FIG.4B1
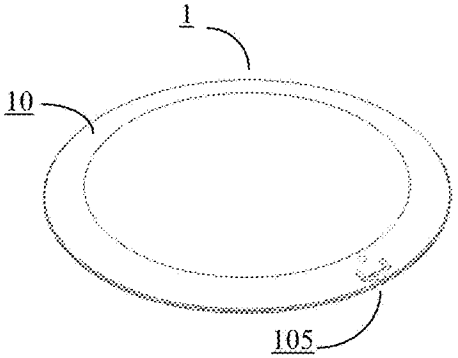
FIG.4A1
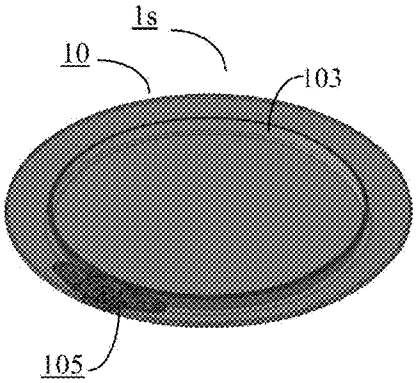
FIG.4C2
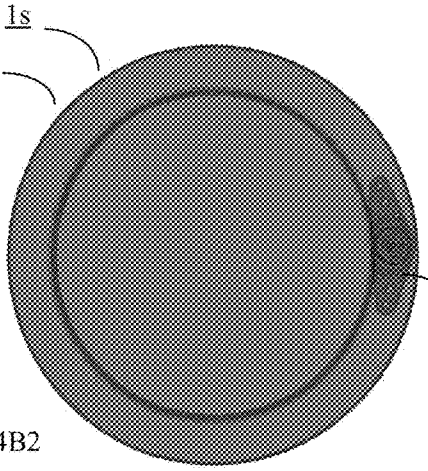
FIG.4B2
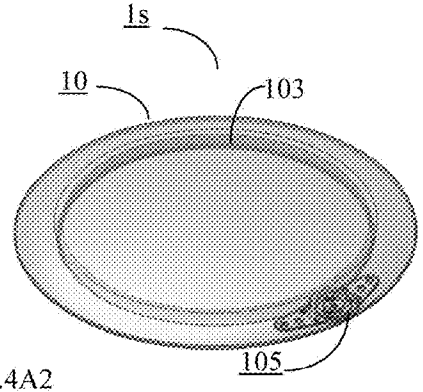
FIG.4A2

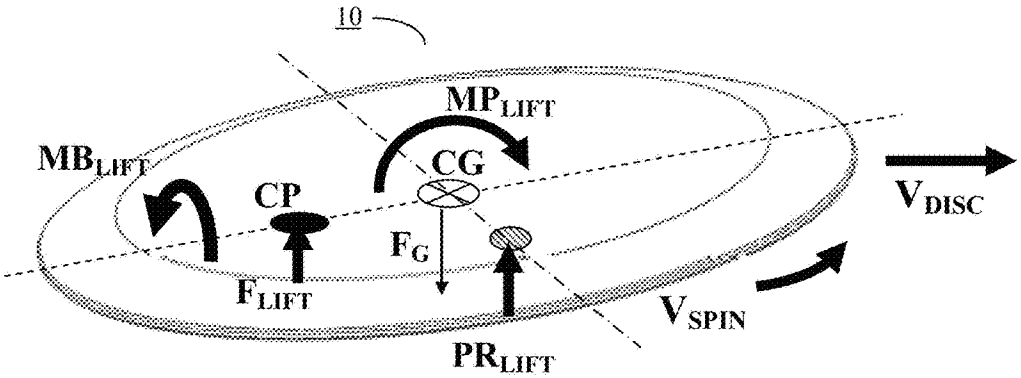
FIG.5A1
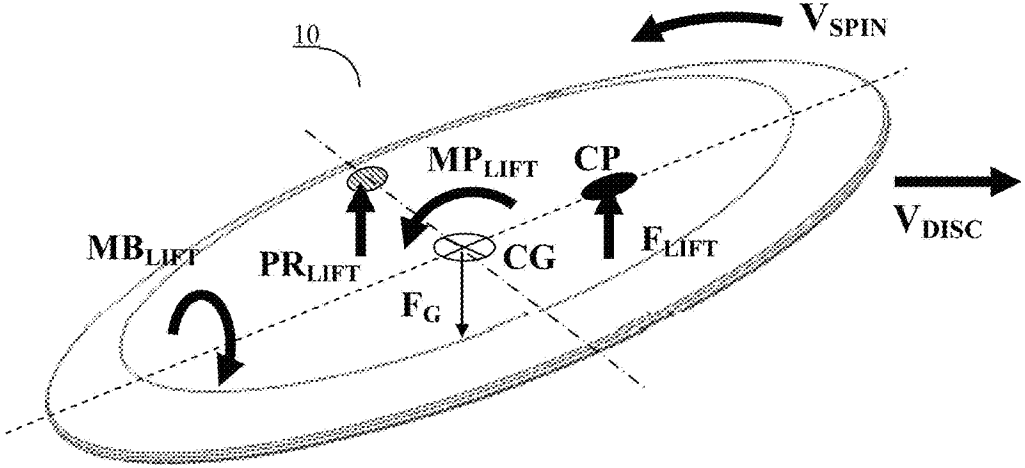
FIG.5A2

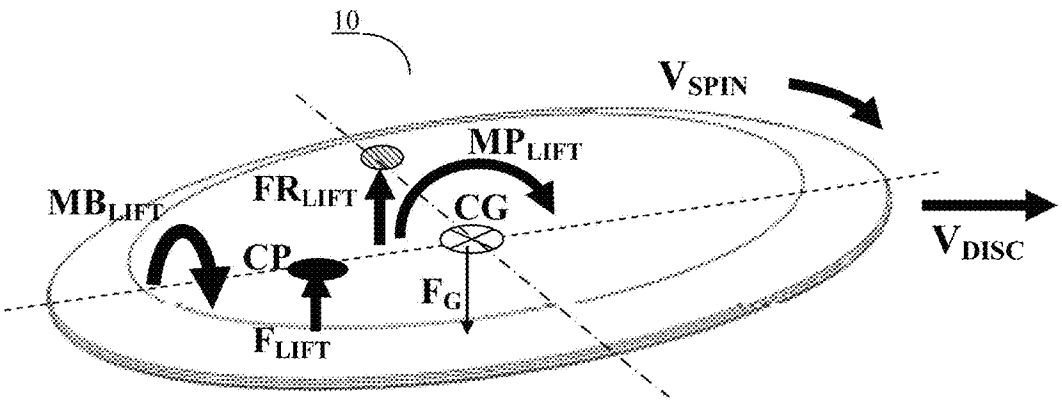
FIG.5B1
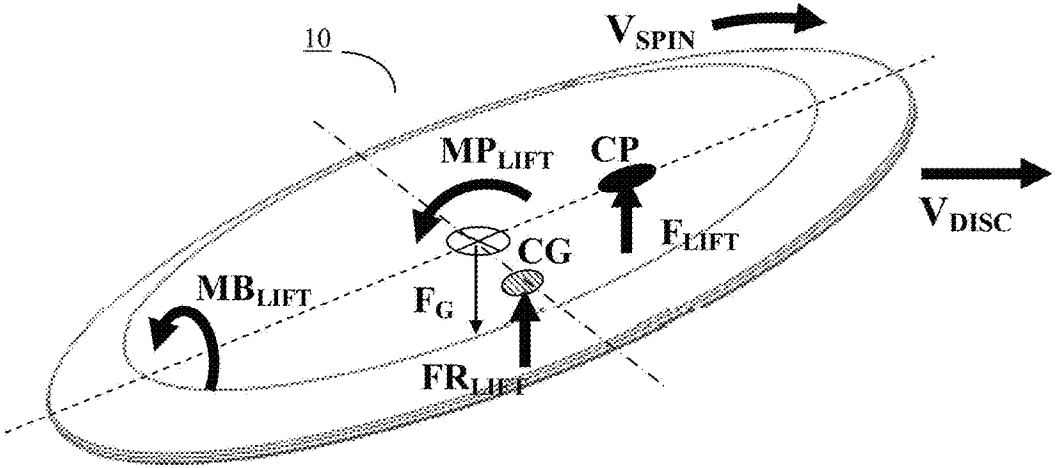
FIG.5B2

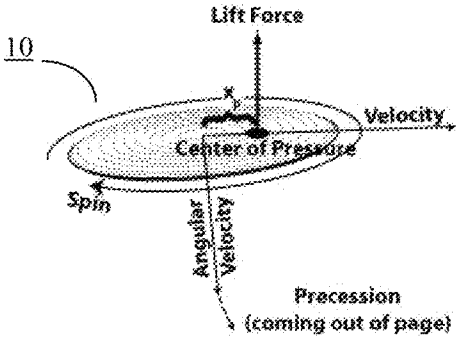
FIG.5C2
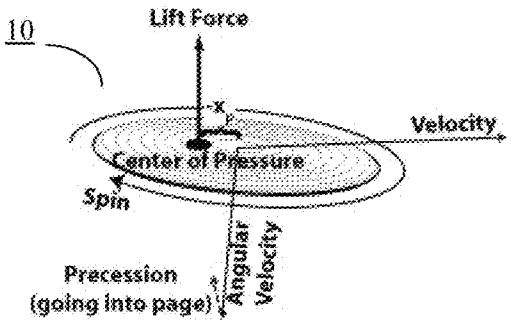
FIG.5C1
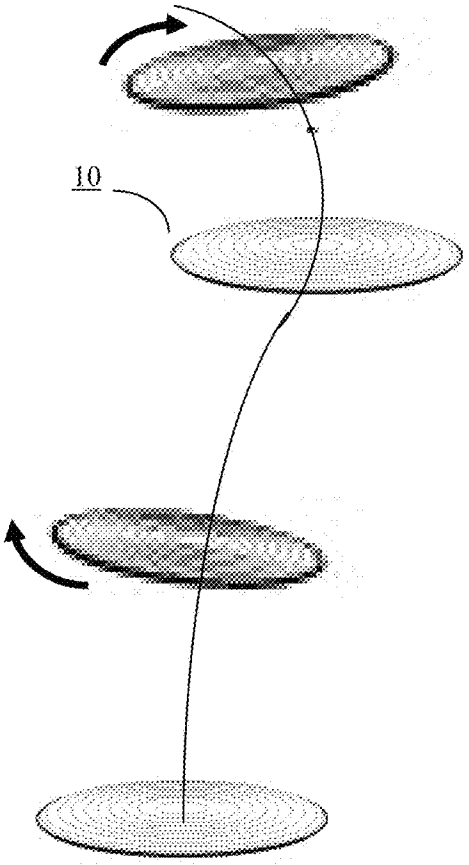
FIG.5C

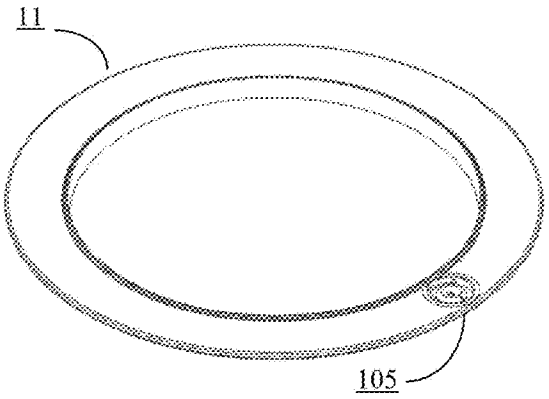
FIG.6B1
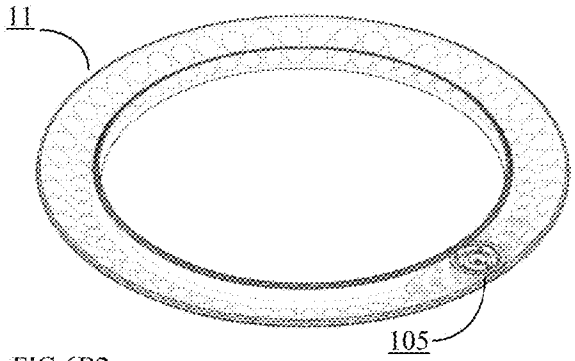
FIG.6B2
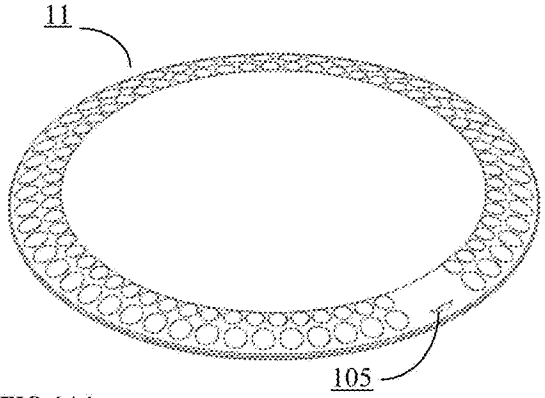
FIG.6A1
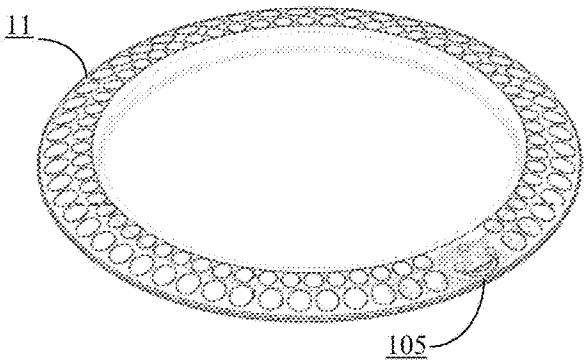
FIG.6A2

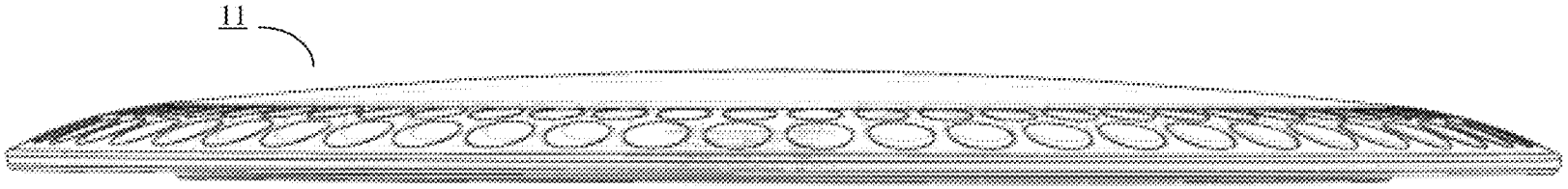
FIG.6C1
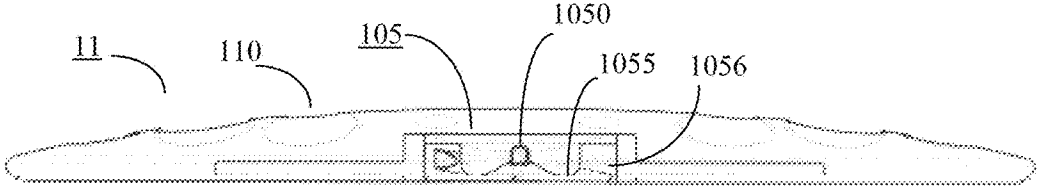
FIG.6C2
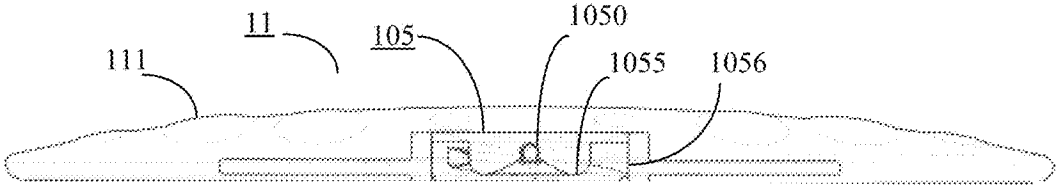
FIG.6C3

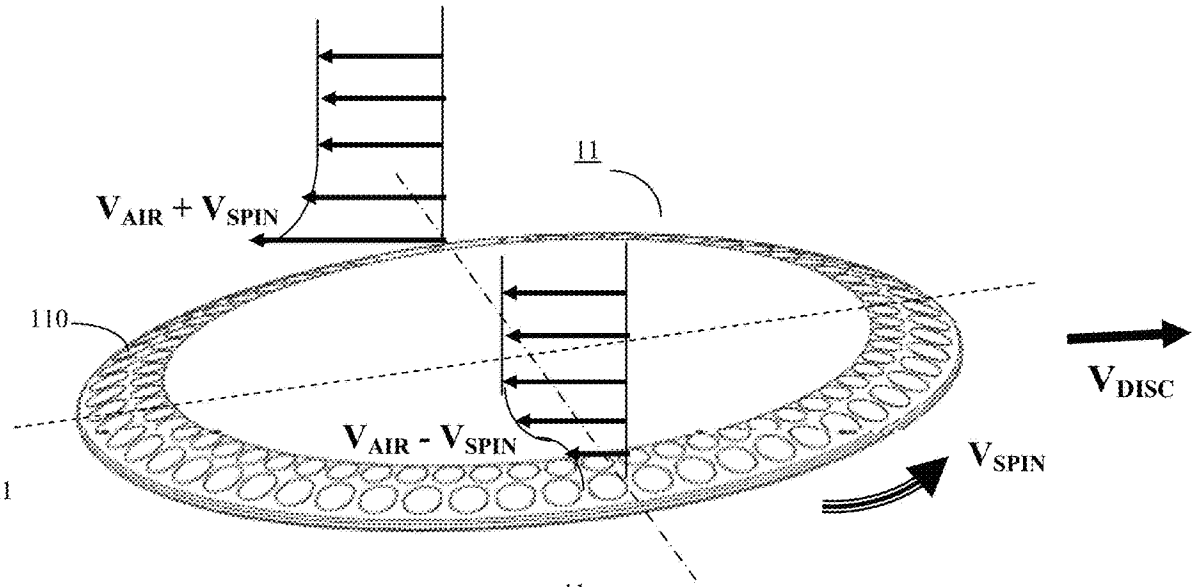
FIG.7A1
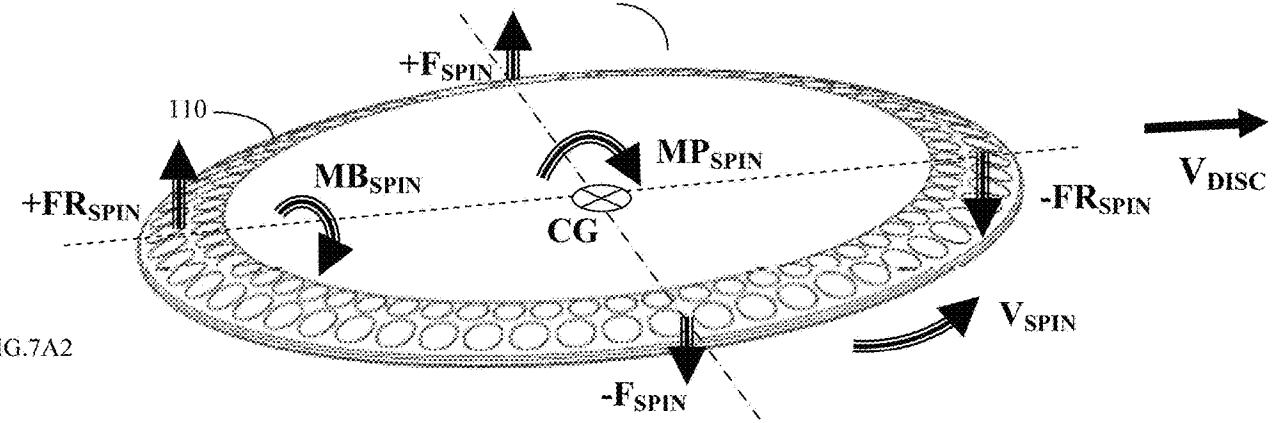
FIG.7A2

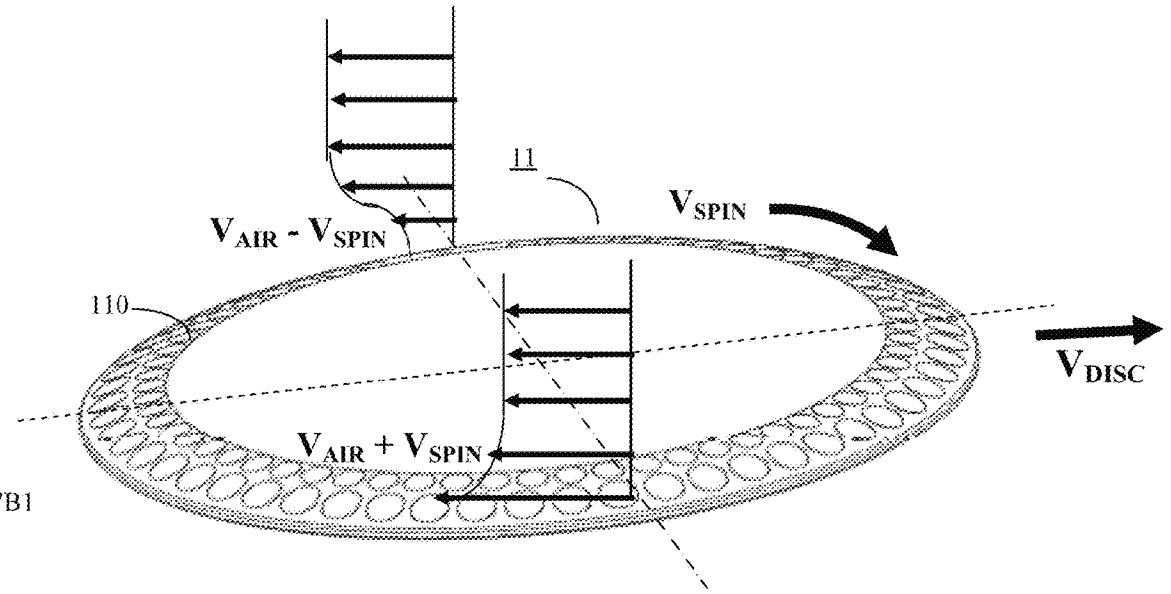
FIG.7B1
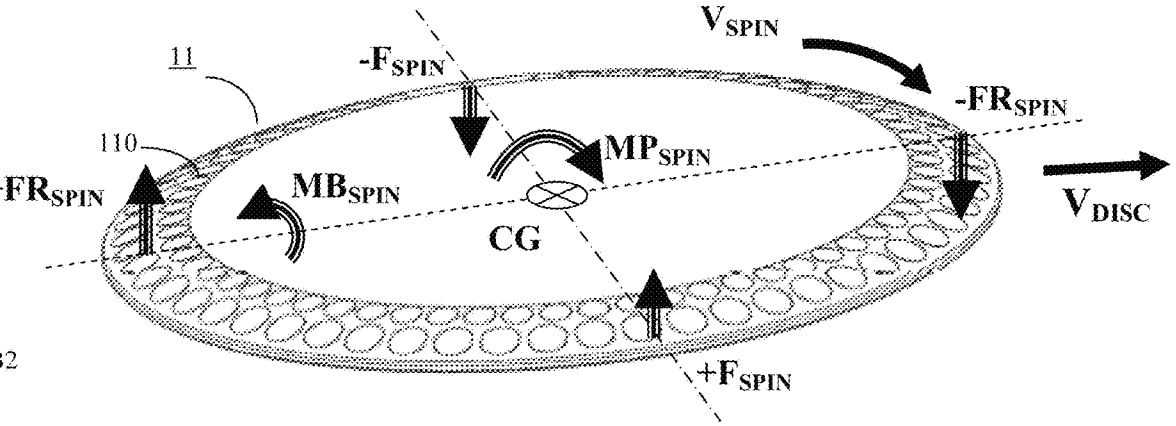
FIG.7B2

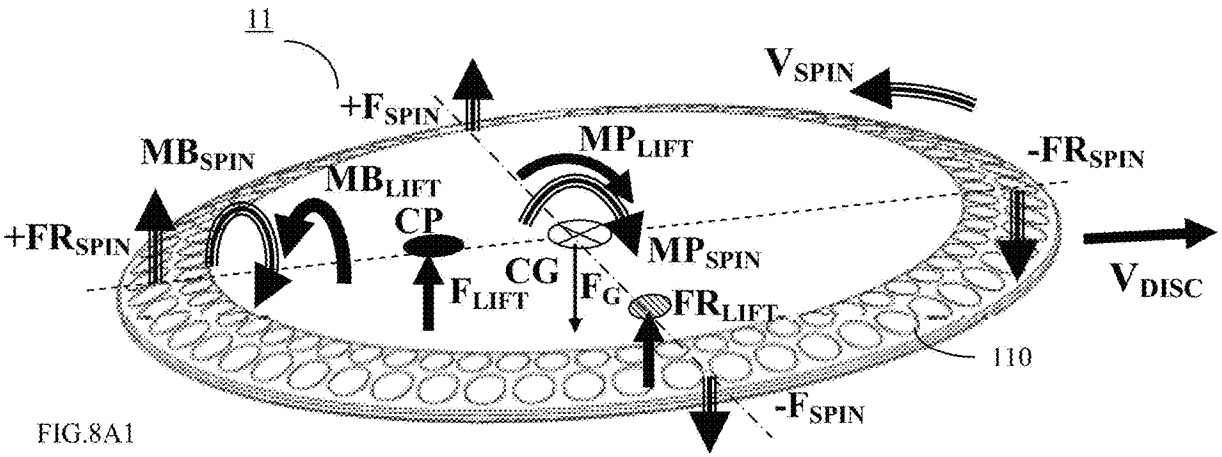
FIG.8A1
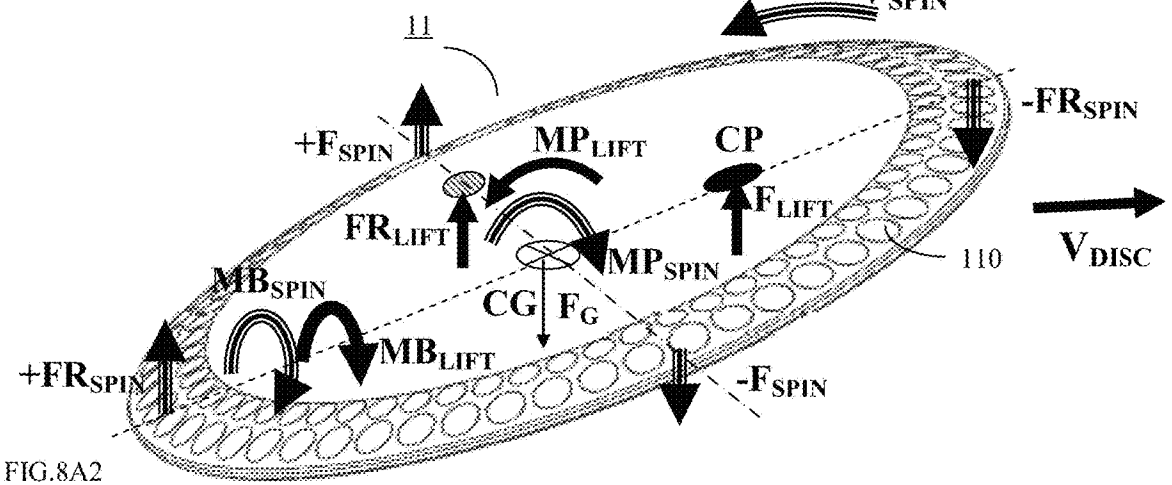
FIG.8A2

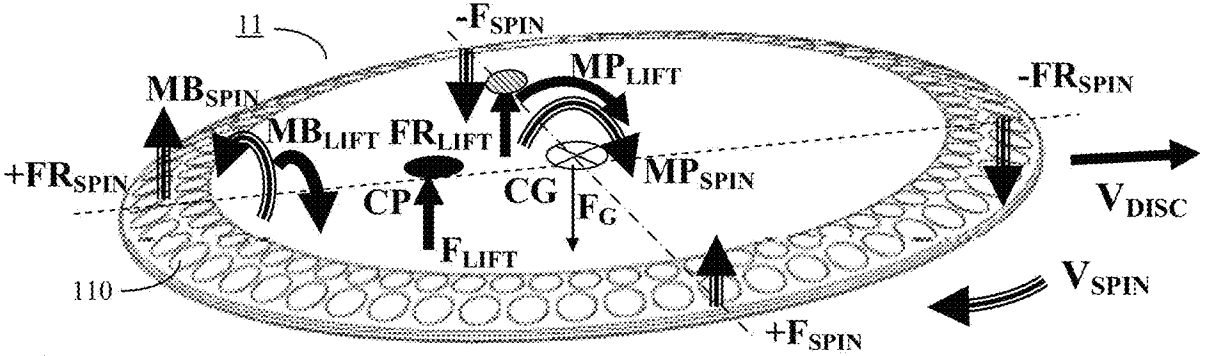
FIG.8B1
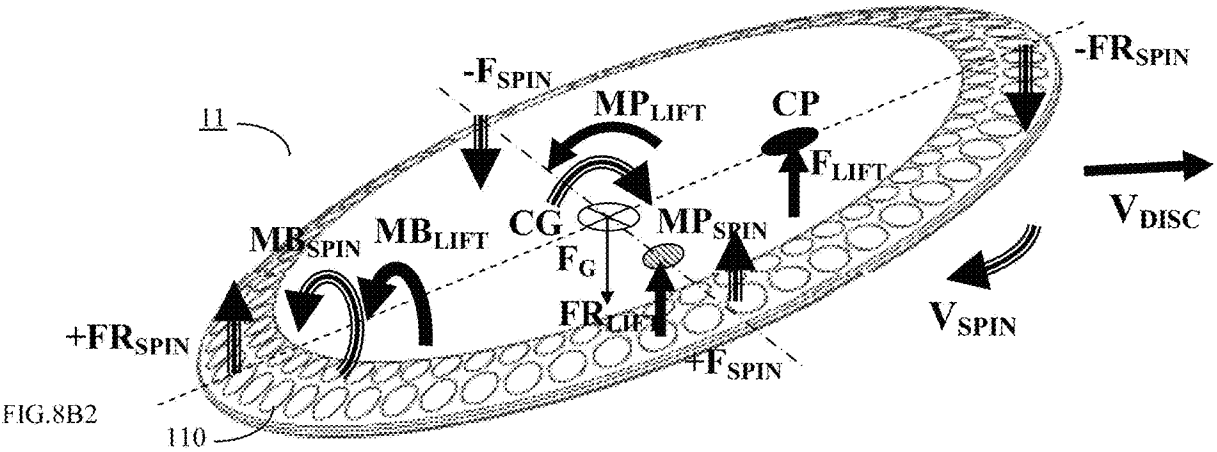
FIG.8B2

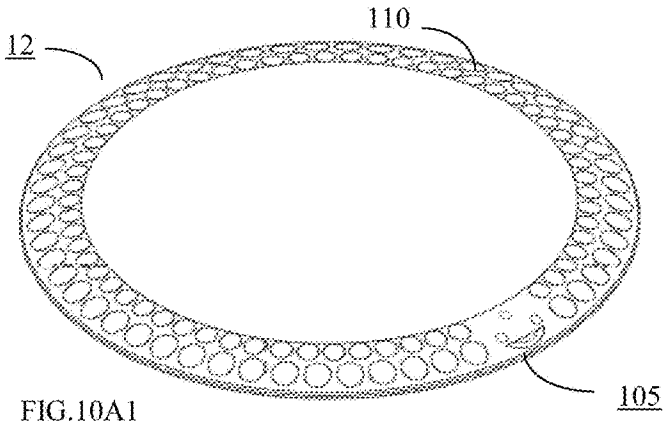
FIG.10A1
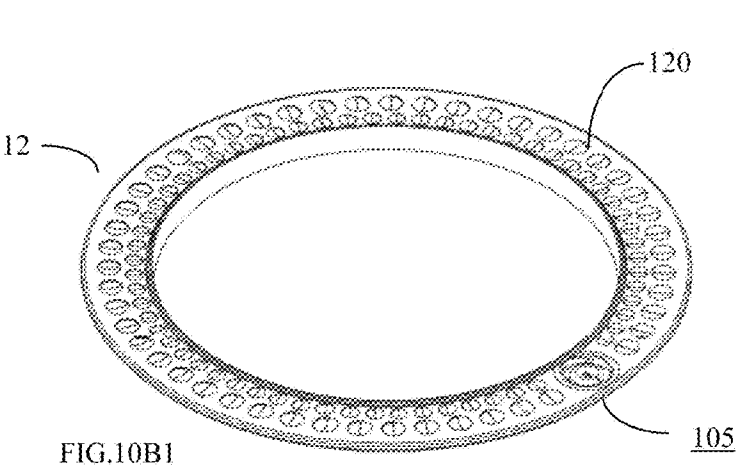
FIG.10B1
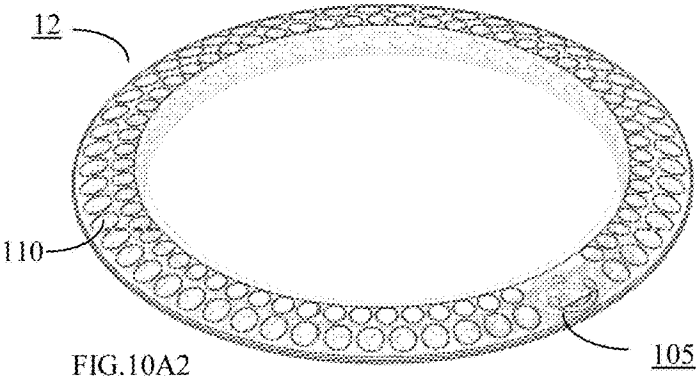
FIG.10A2
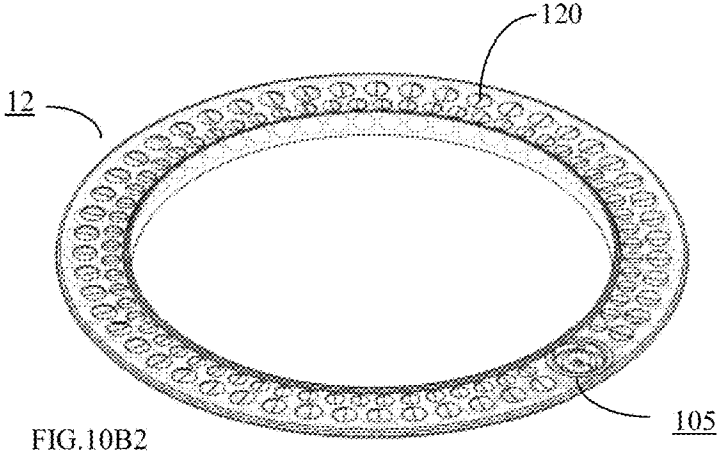
FIG.10B2

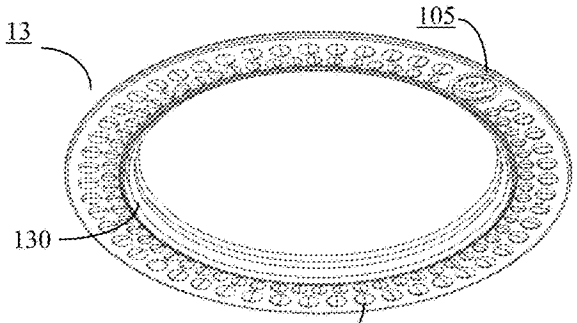
FIG.12B1
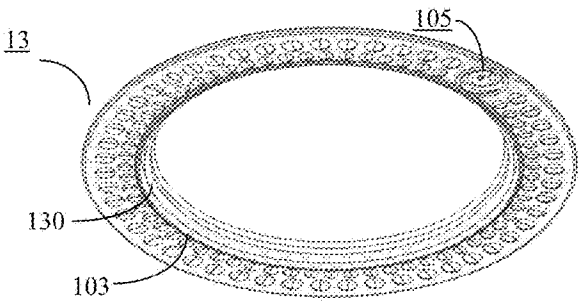
FIG.12B2
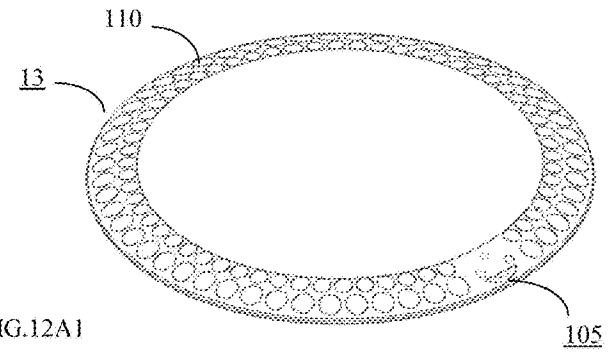
FIG.12A1
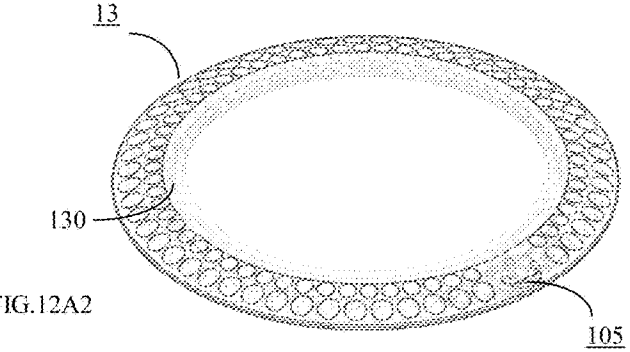
FIG.12A2
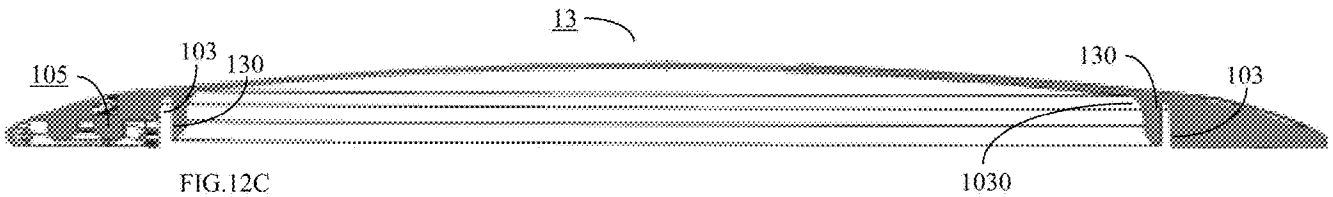
FIG.12C

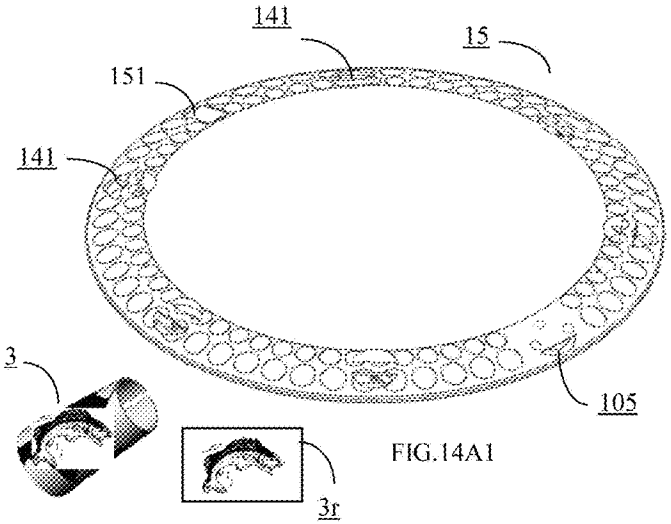
FIG.14A1
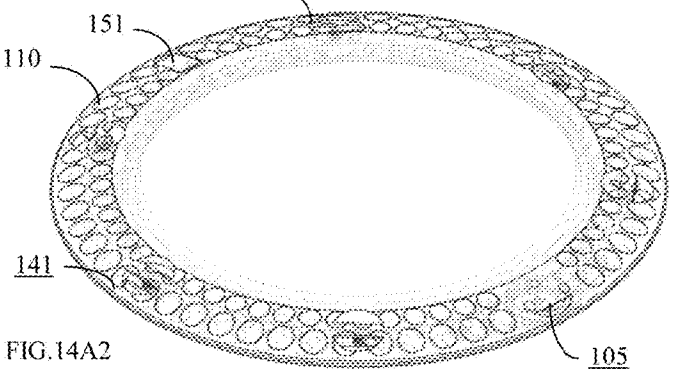
FIG.14A2
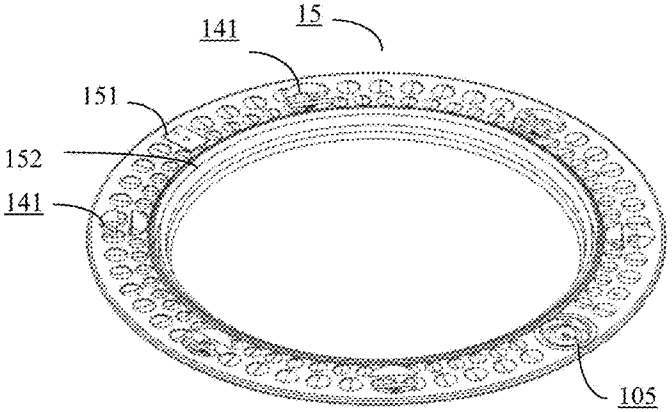
FIG.14B1
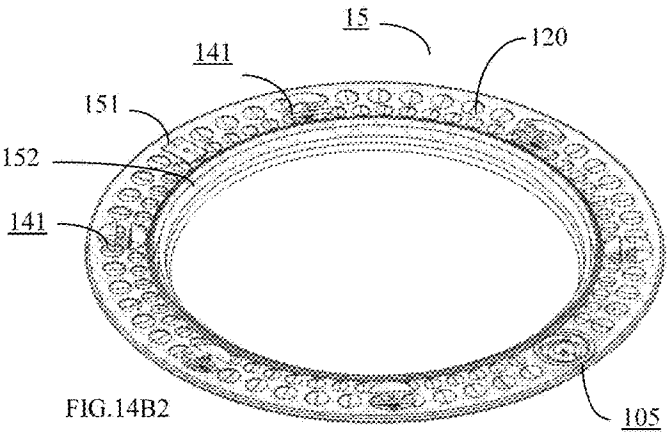
FIG.14B2

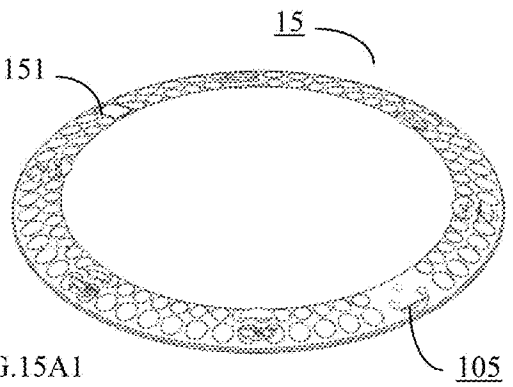
FIG.15A1
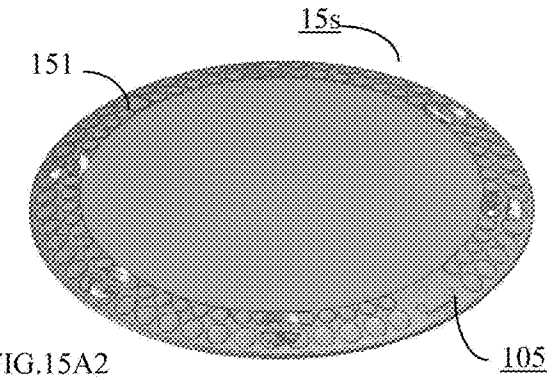
FIG.15A2
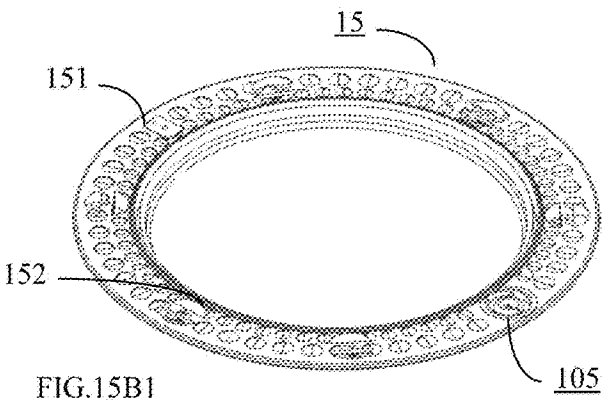
FIG.15B1
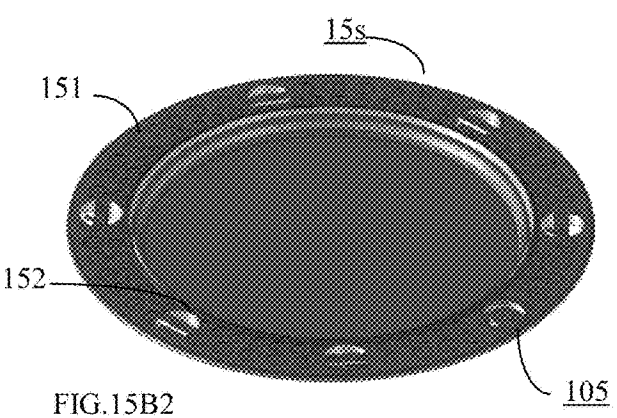
FIG.15B2

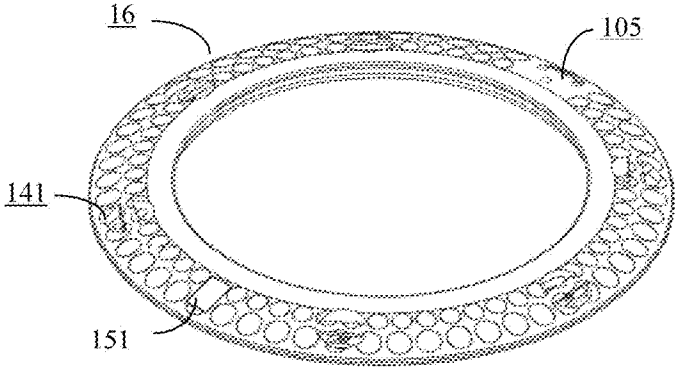
FIG.16A1
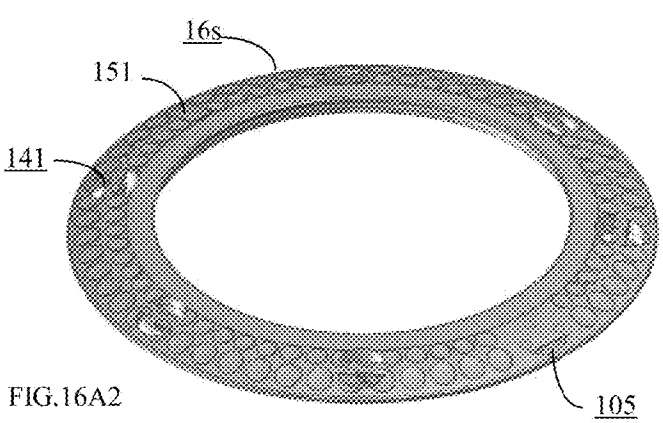
FIG.16A2
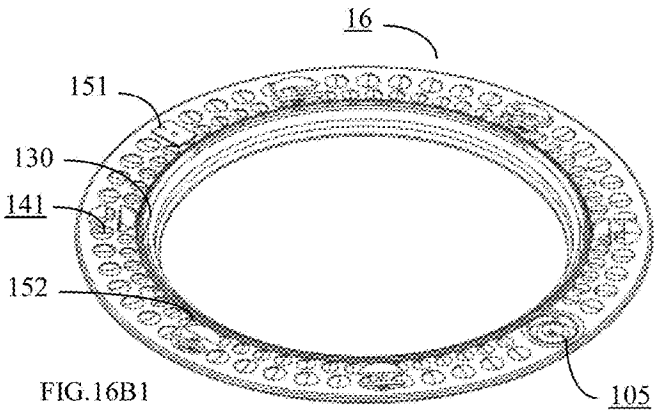
FIG.16B1
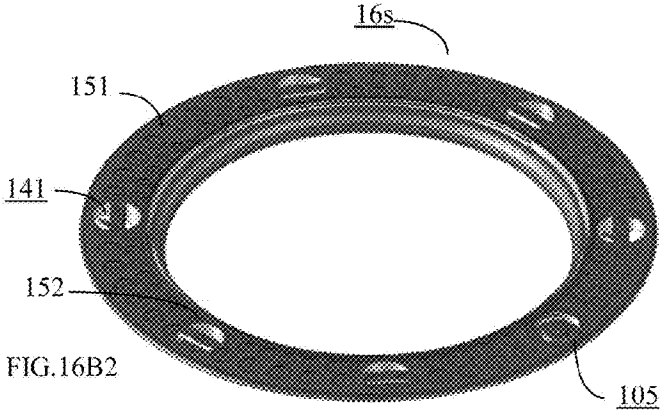
FIG.16B2

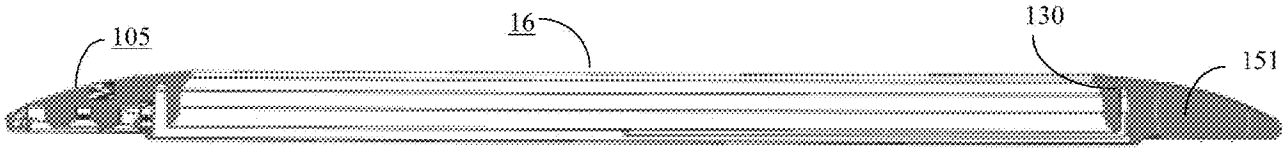
FIG.16C1
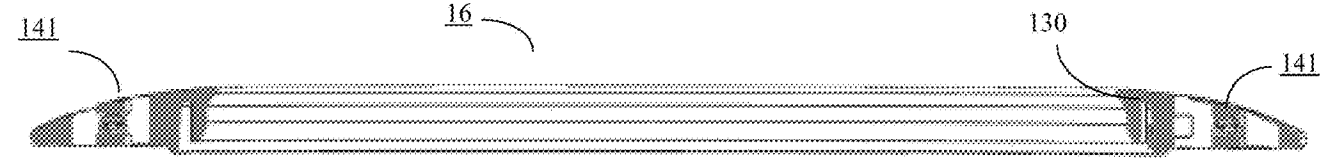
FIG.16C2
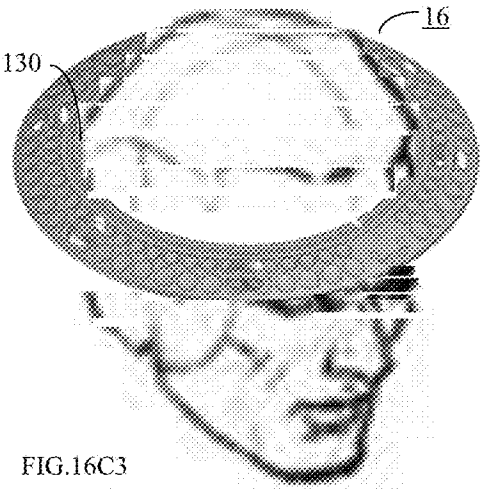
FIG.16C3
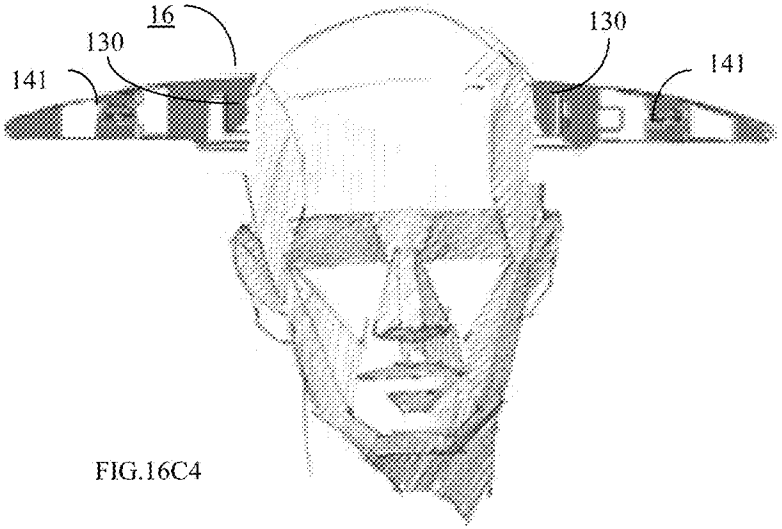
FIG.16C4

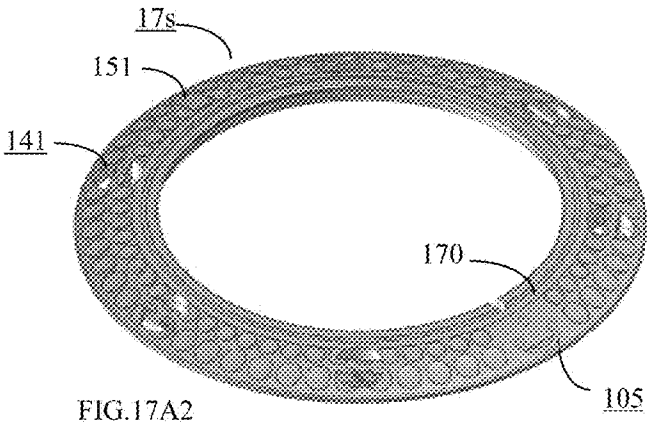
FIG.17A2
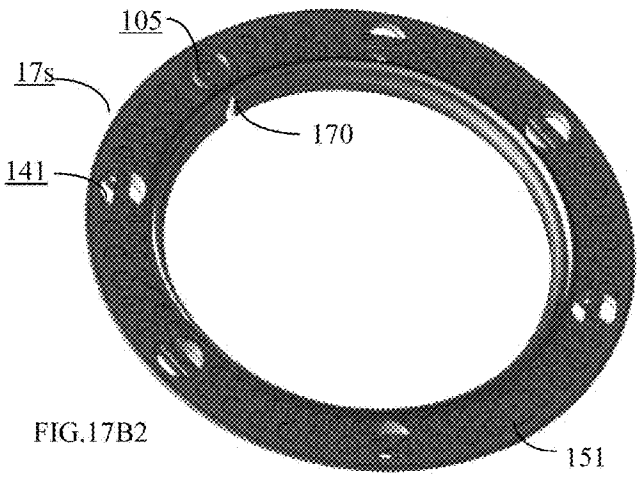
FIG.17B2
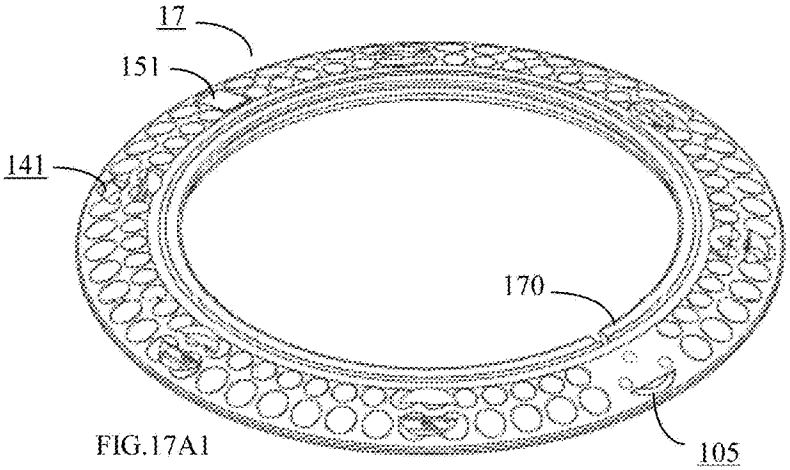
FIG.17A1
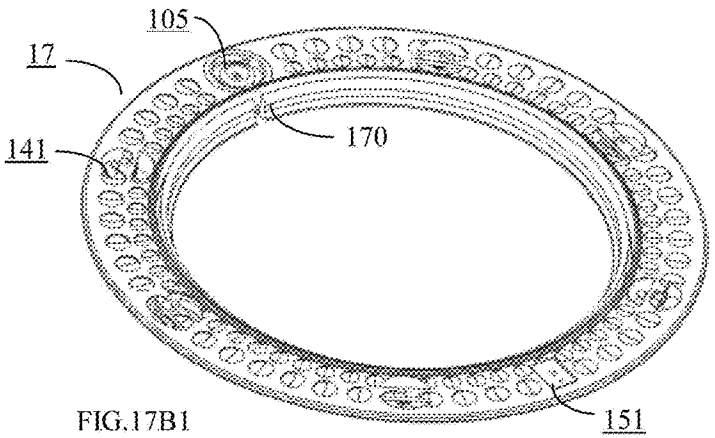
FIG.17B1

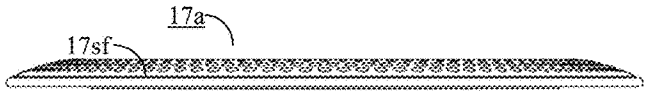
FIG.17C1
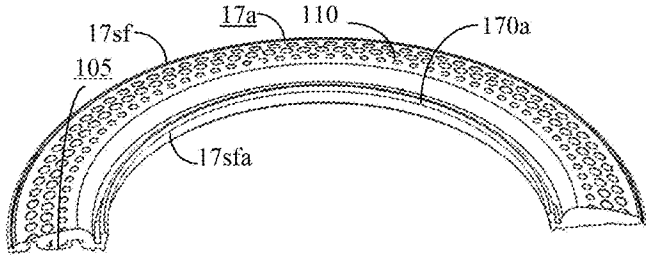
FIG.17C2
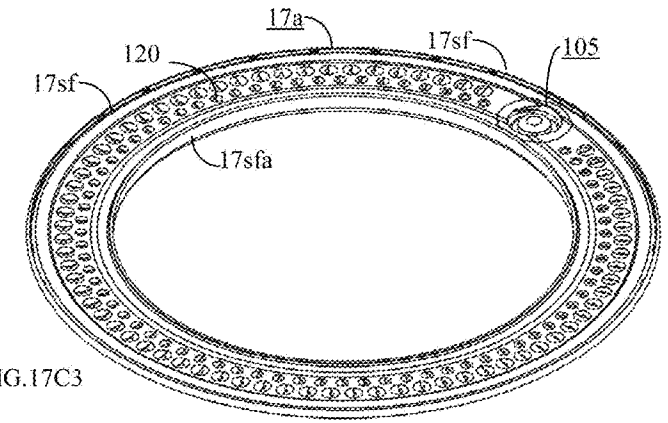
FIG.17C3
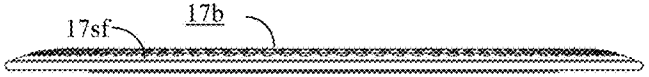
FIG.17D1
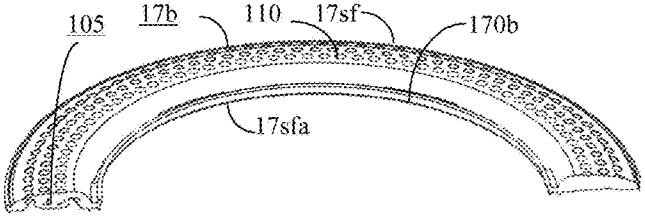
FIG.17D2
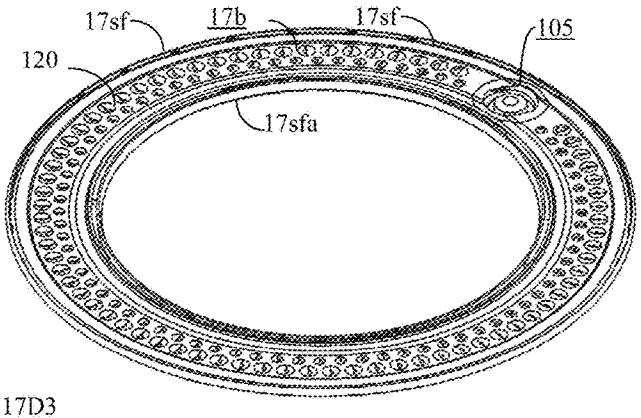
FIG.17D3

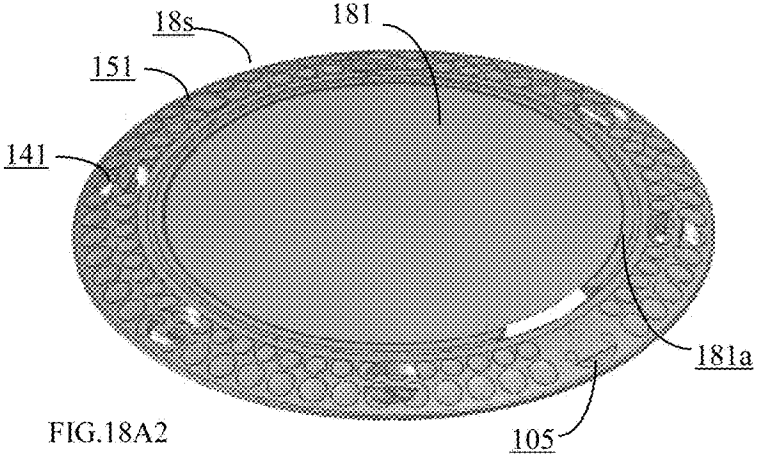
FIG.18A2
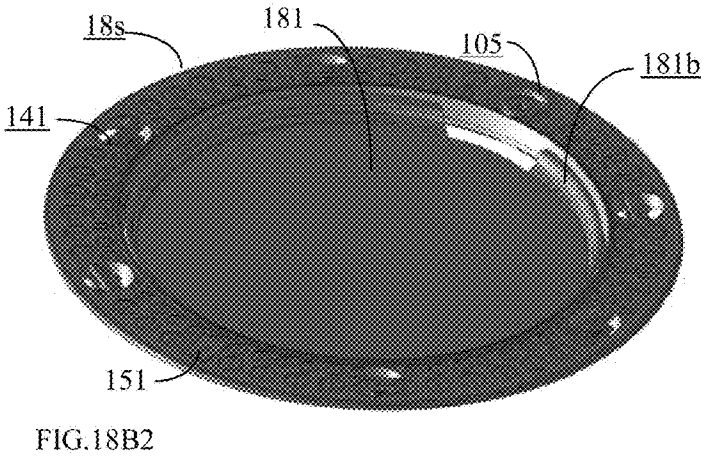
FIG.18B2
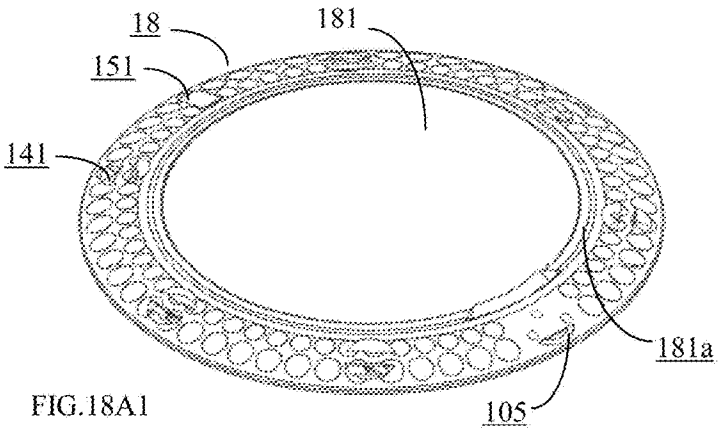
FIG.18A1
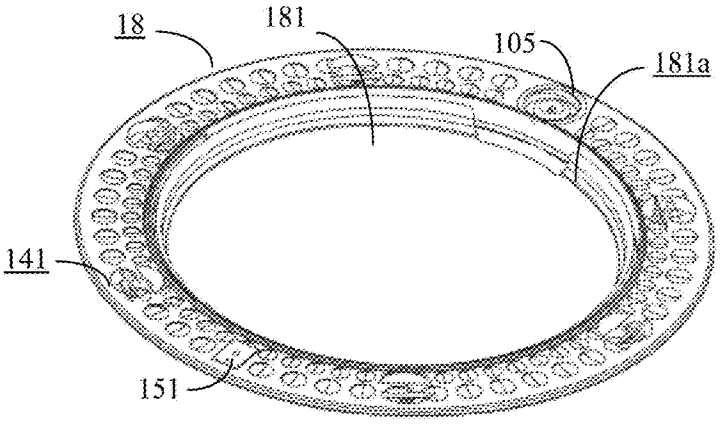
FIG.18B1

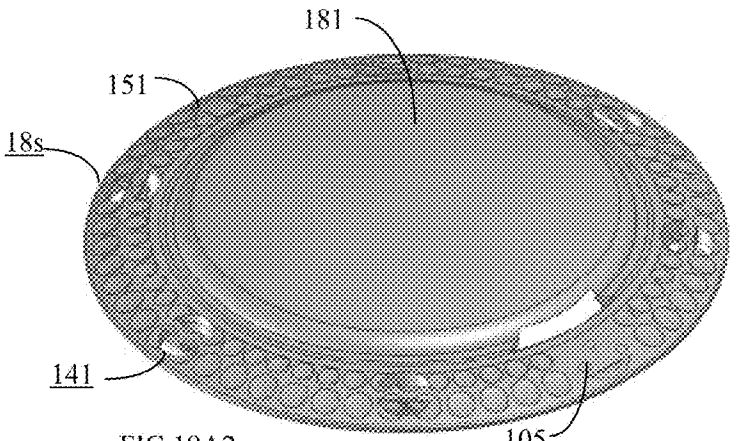
FIG.19A2
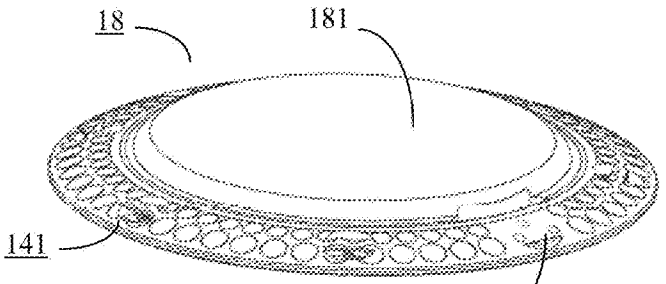
FIG.19A1
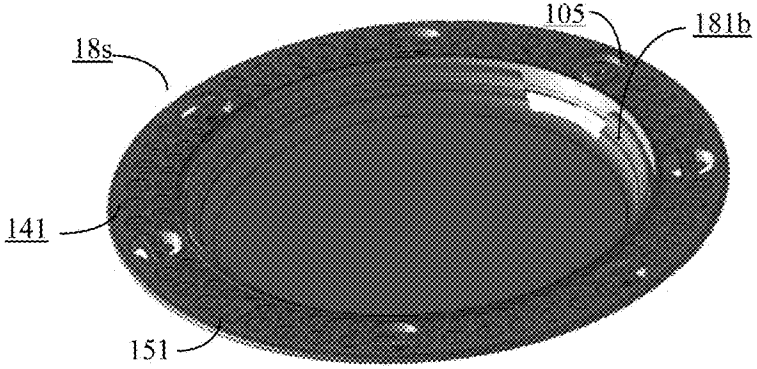
FIG.19B2
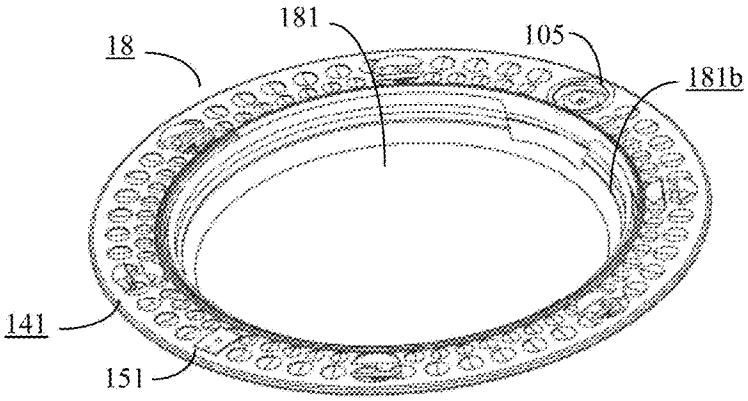
FIG.19B1

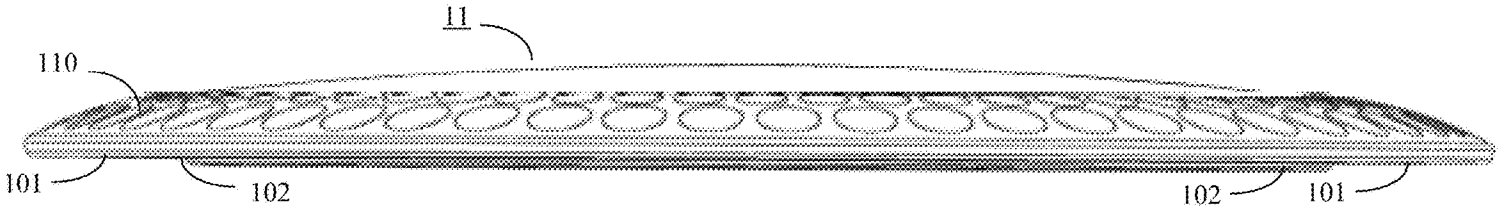
FIG.21A
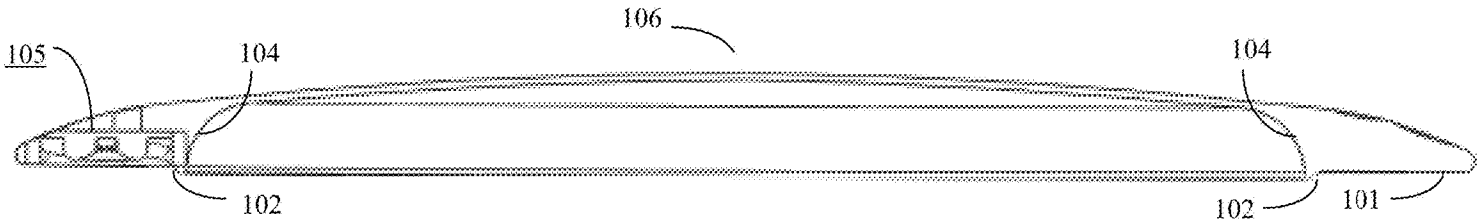
FIG.21B
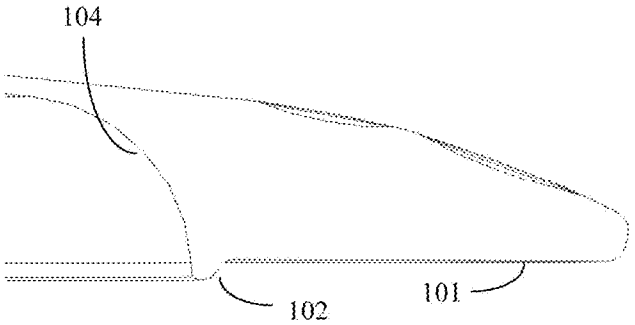
FIG.21C2
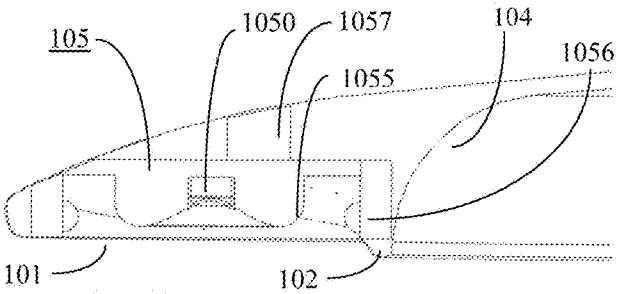
FIG.21C1

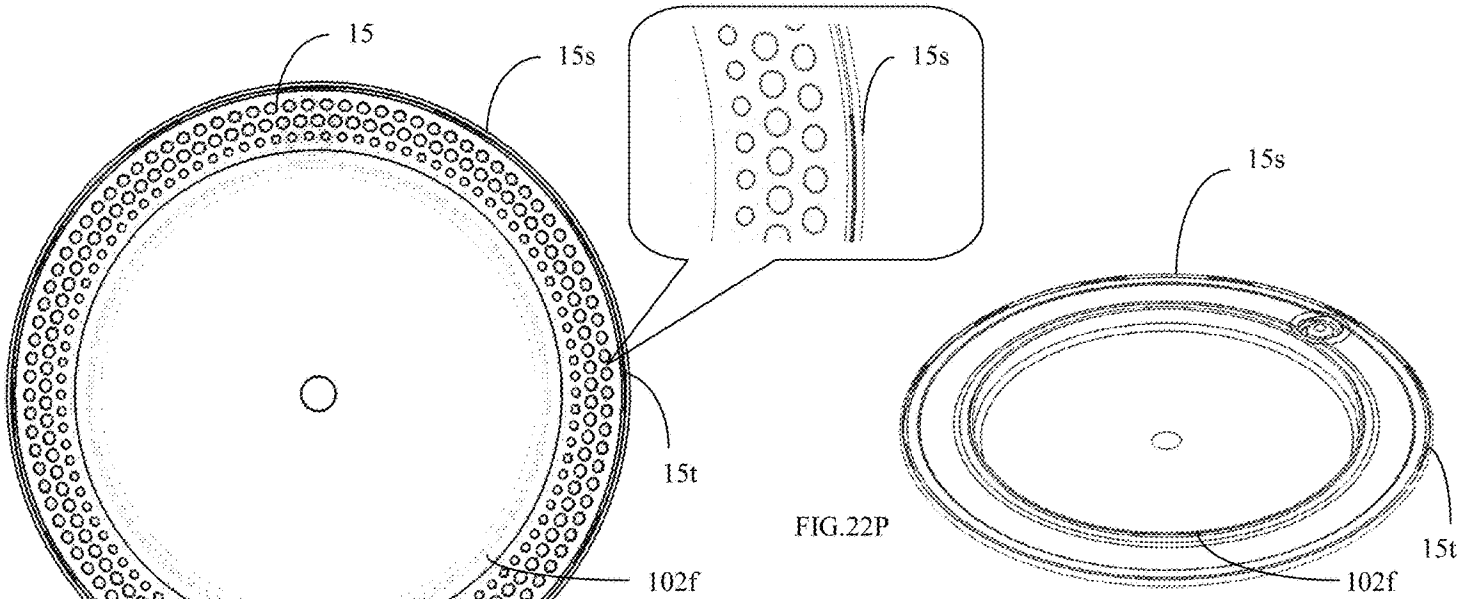
FIG.22N
FIG.22P
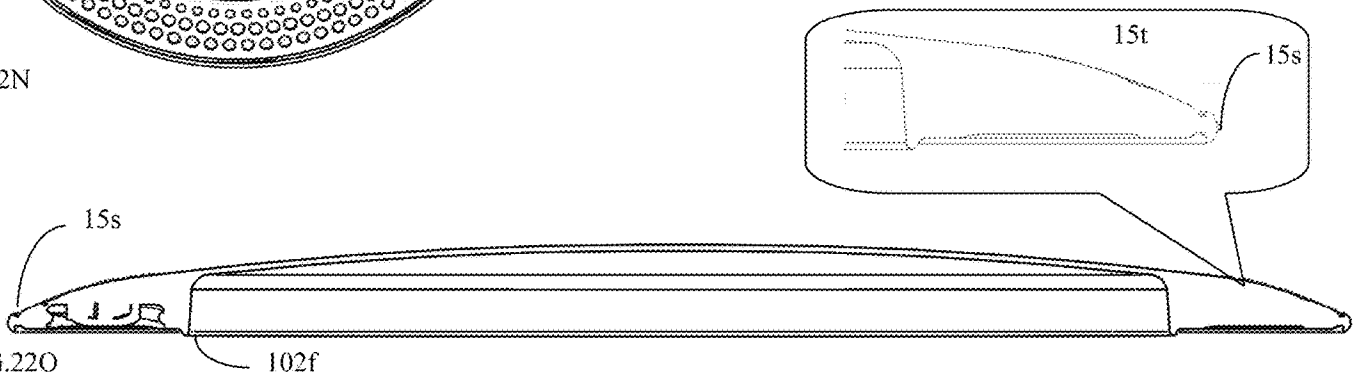
FIG.22O

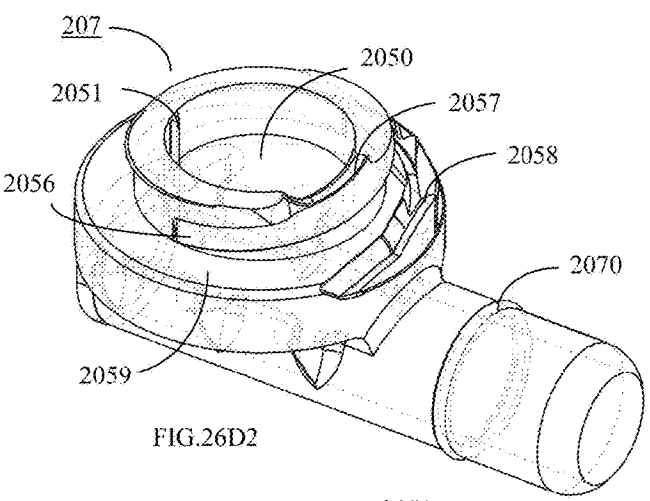
FIG.26D2
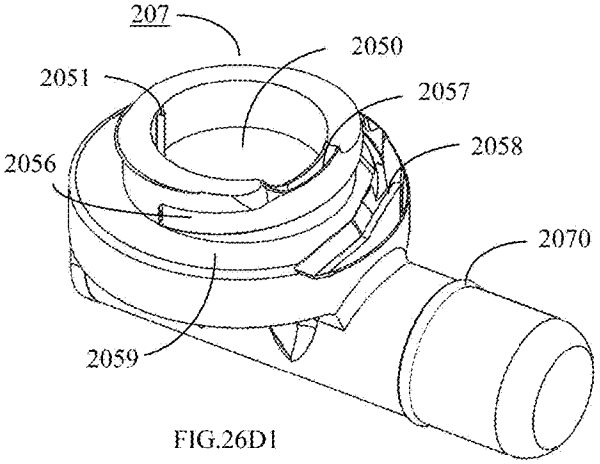
FIG.26D1
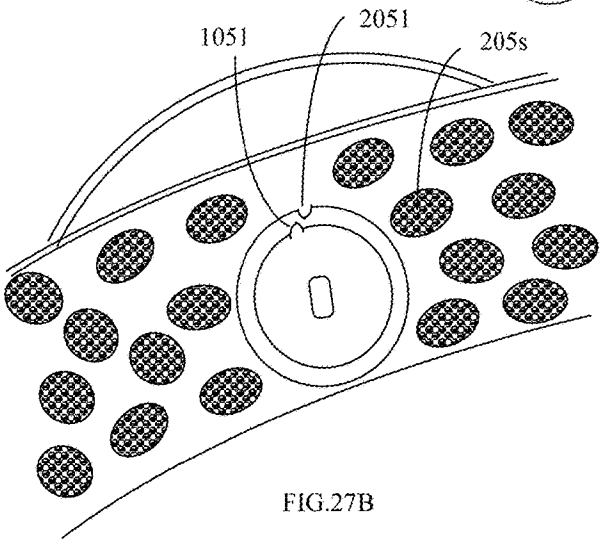
FIG.27B
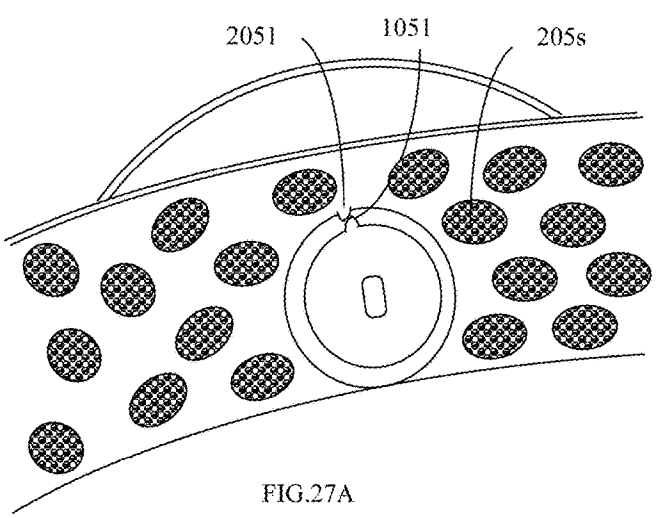
FIG.27A

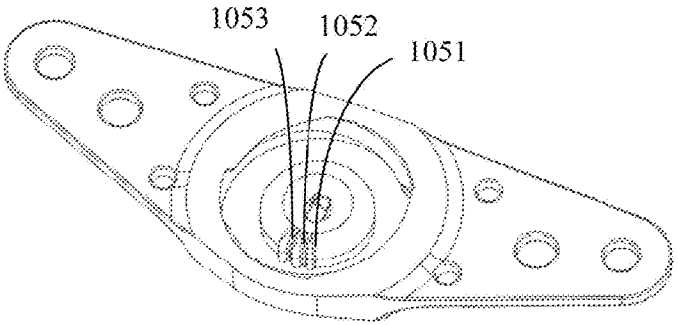
FIG.28B1
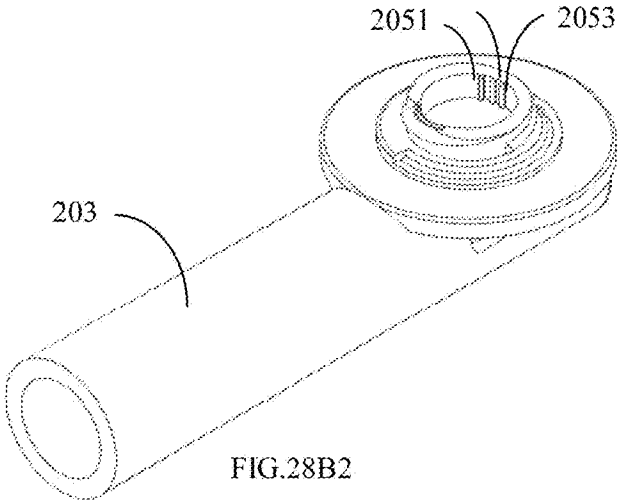
FIG.28B2
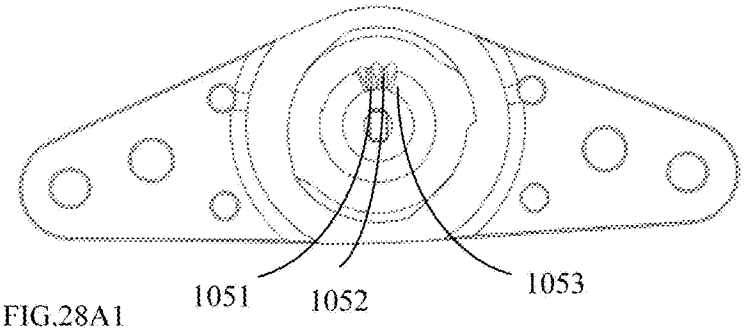
FIG.28A1
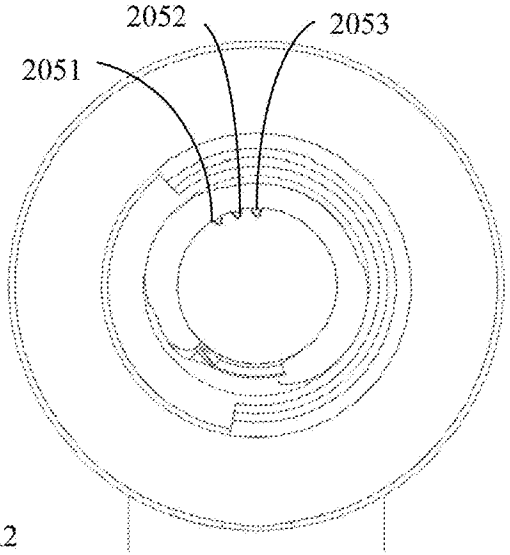
FIG.28A2

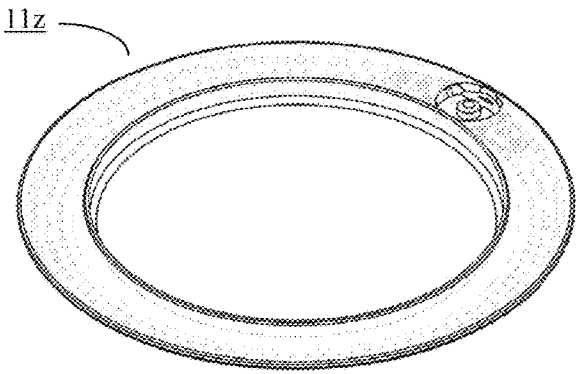
FIG.29E2
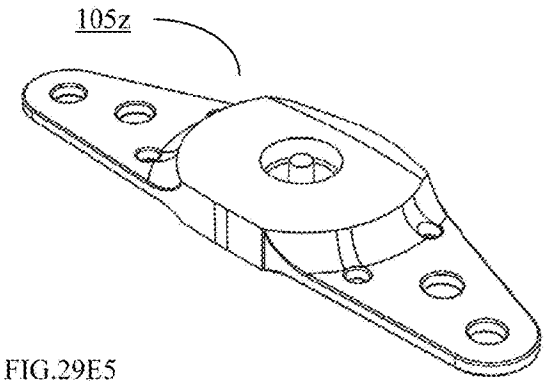
FIG.29E5
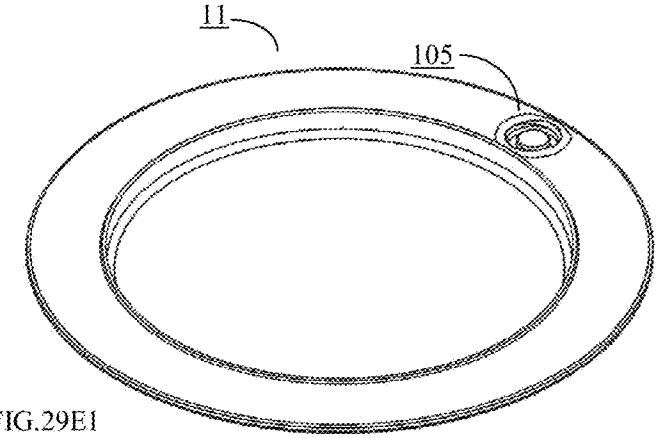
FIG.29E1
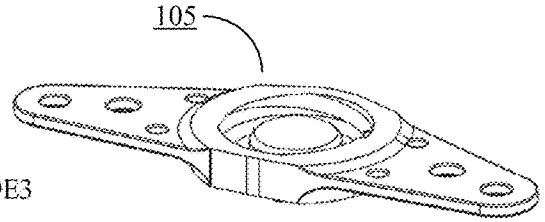
FIG.29E3
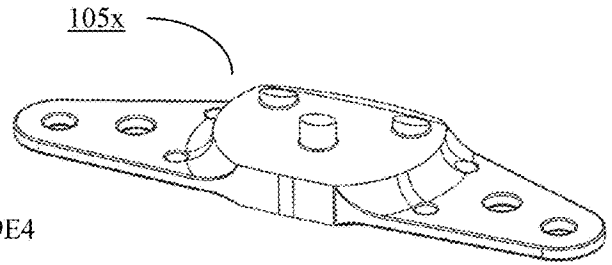
FIG.29E4

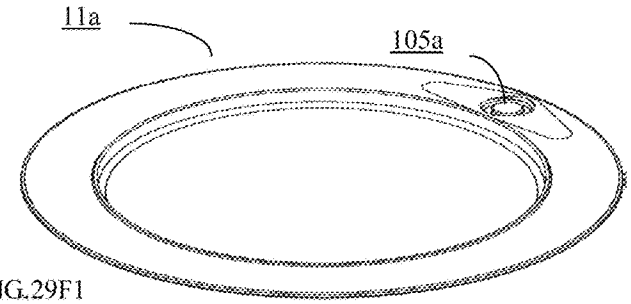
FIG.29F1
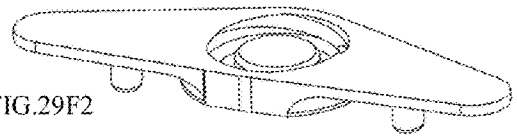
FIG.29F2
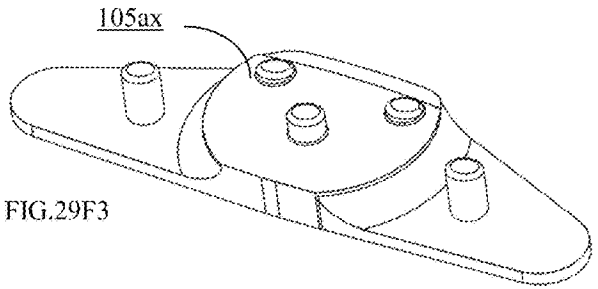
FIG.29F3
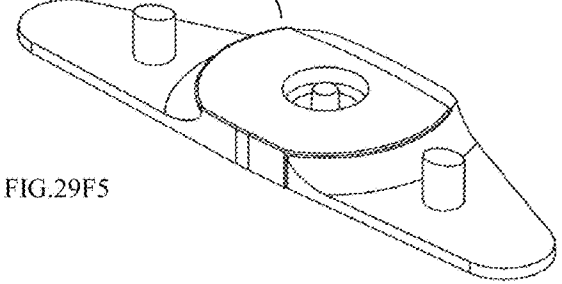
FIG.29F5
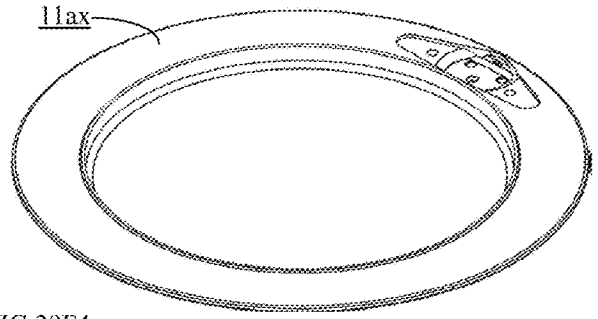
FIG.29F4
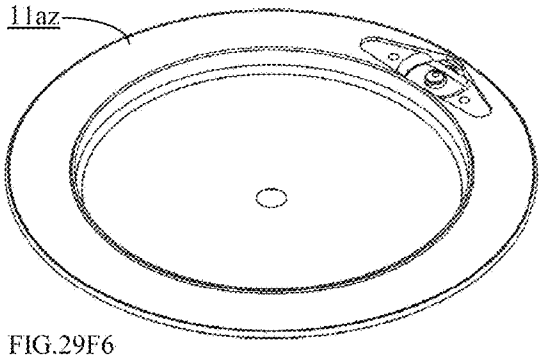
FIG.29F6

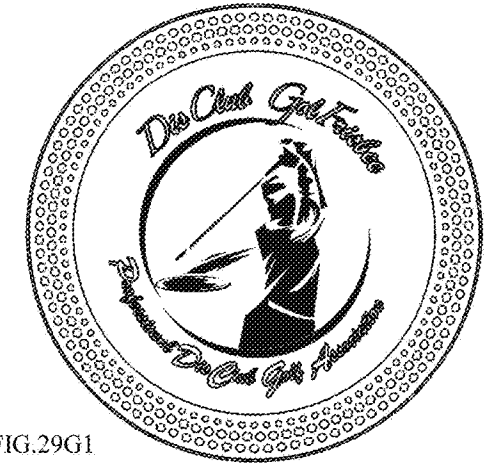
FIG.29G1
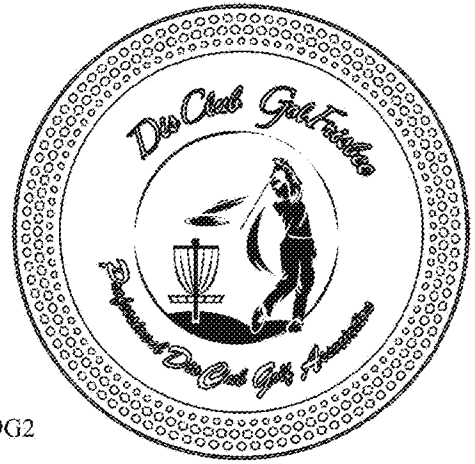
FIG.29G2
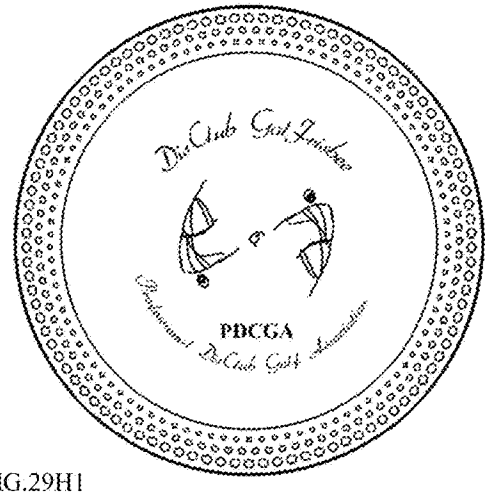
FIG.29H1
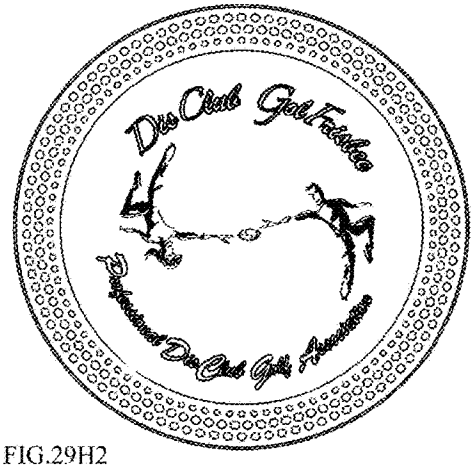
FIG.29H2

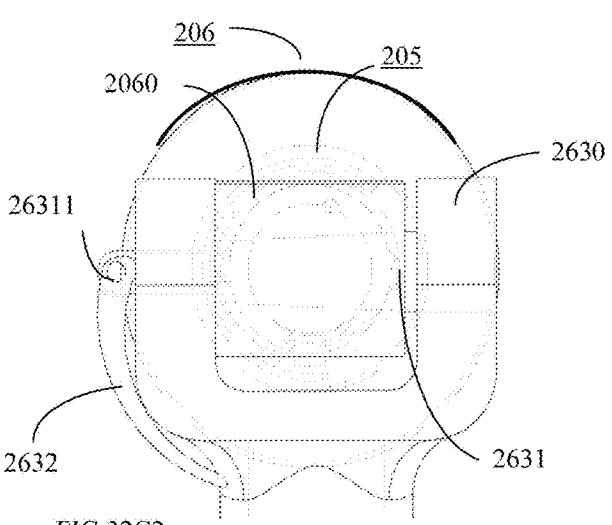
FIG.32C2
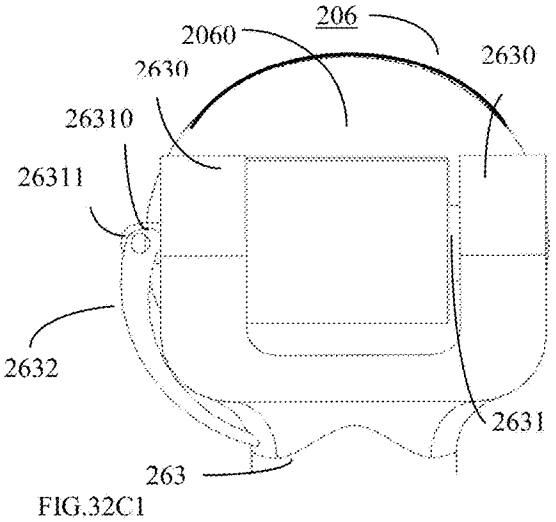
FIG.32C1
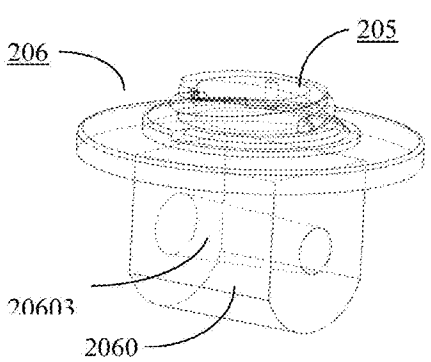
FIG.32D2
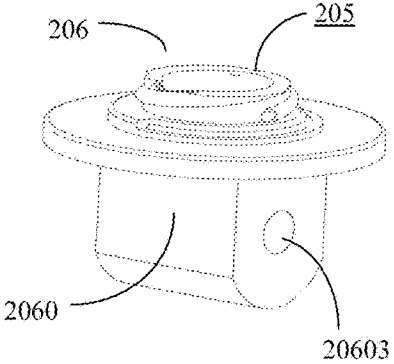
FIG.32D1

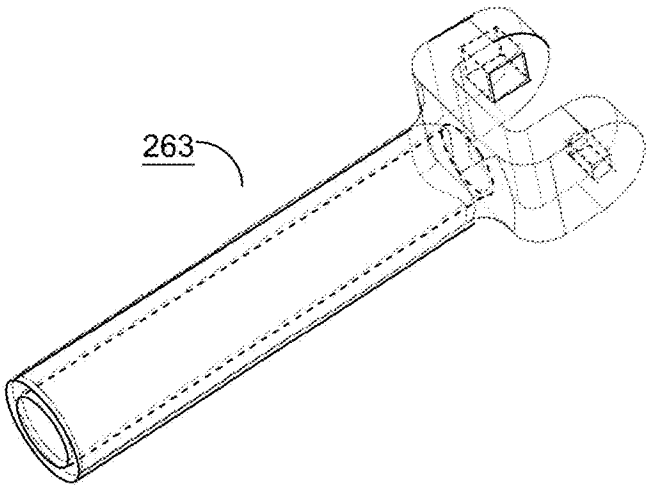
FIG.32E2
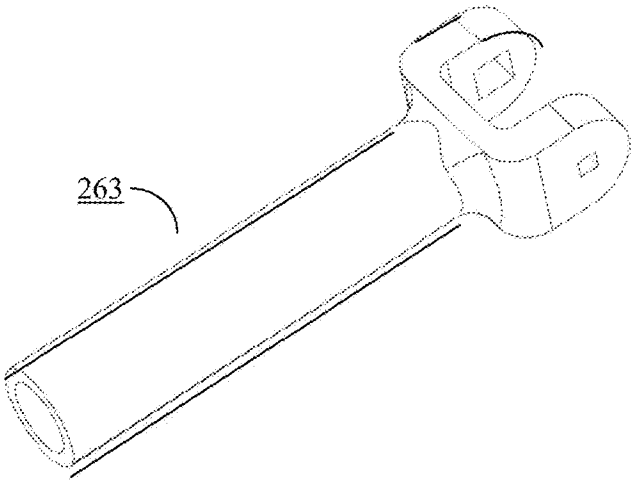
FIG.32E1
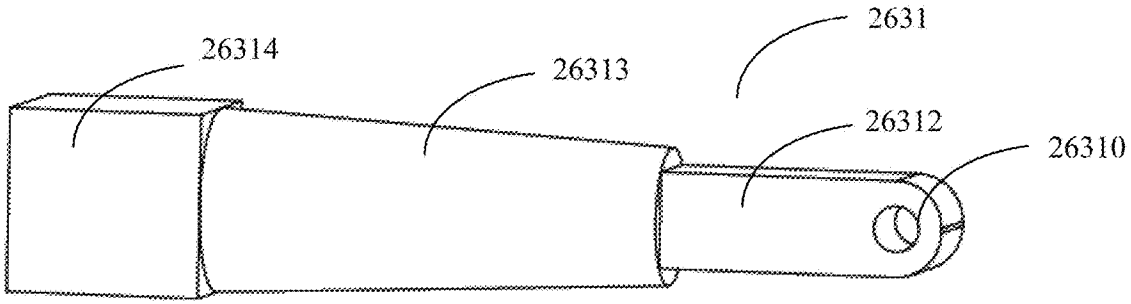
FIG.32F 203
205
20
208

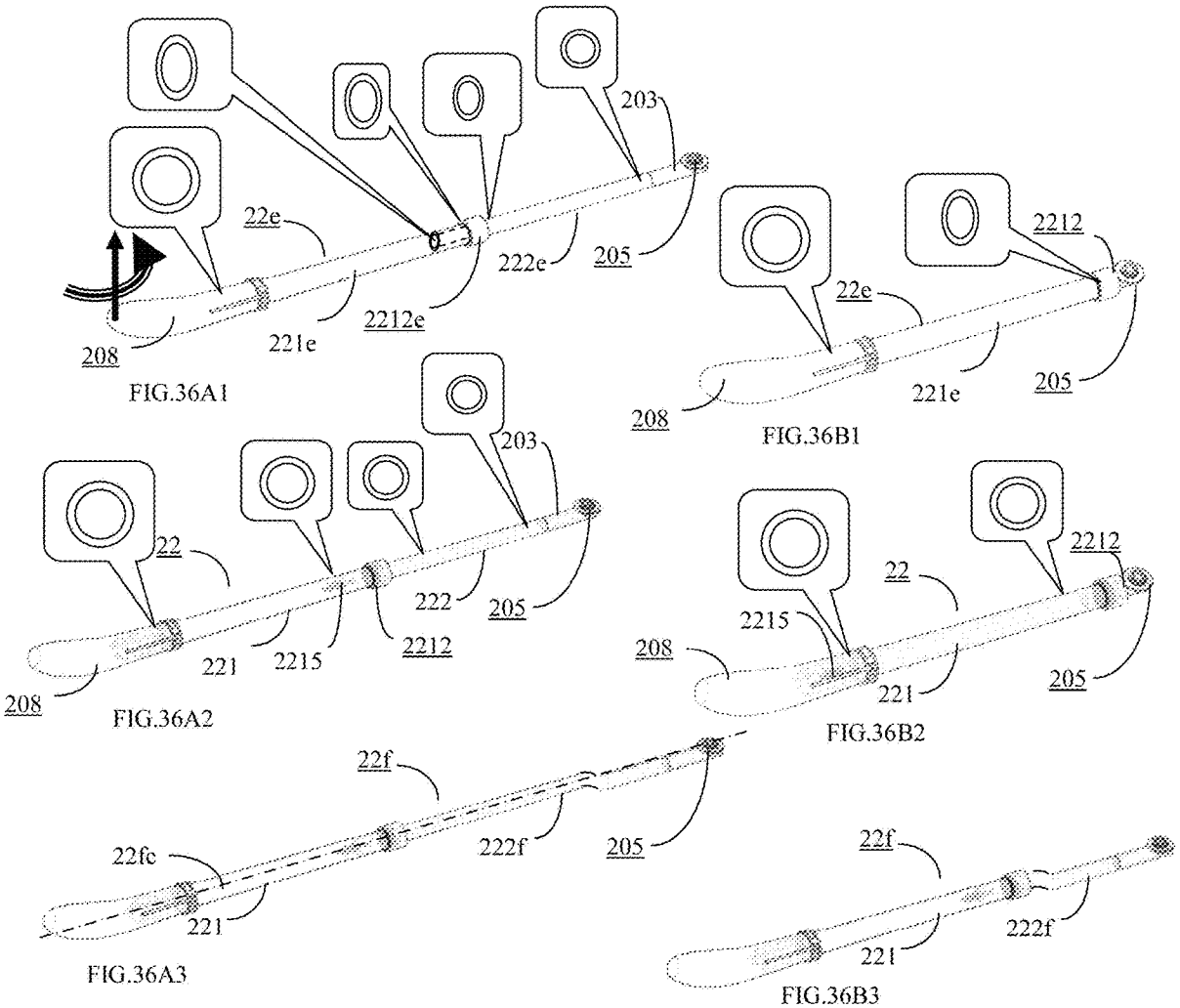
203
205
222e
2212e
221e
22e
208
FIG.36A1
203
205
222
2212
2215
221
22
208
FIG.36A2
205
222f
22f
221
22fe
FIG.36A3
2212
205
221e
22e
208
FIG.36B1
2212
205
22
221
2215
208
FIG.36B2
222f
22f
221
FIG.36B3

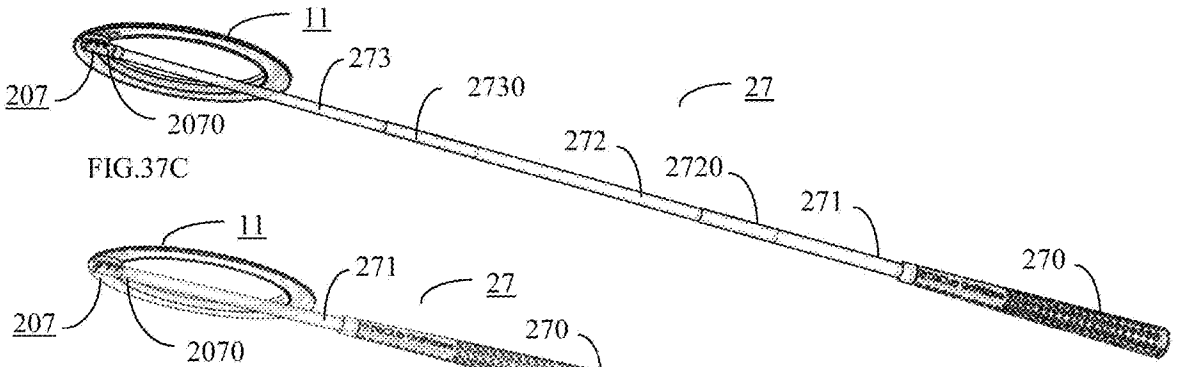
FIG.37C
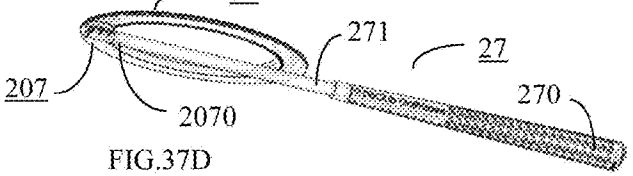
FIG.37D
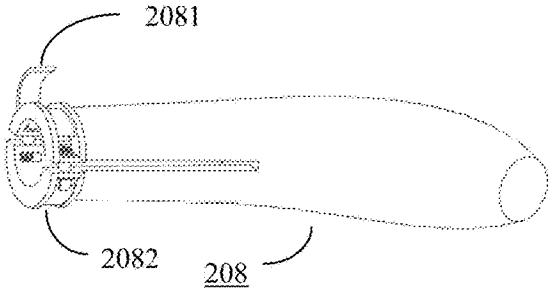
FIG.38A2
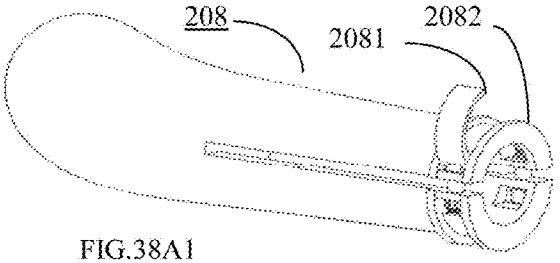
FIG.38A1

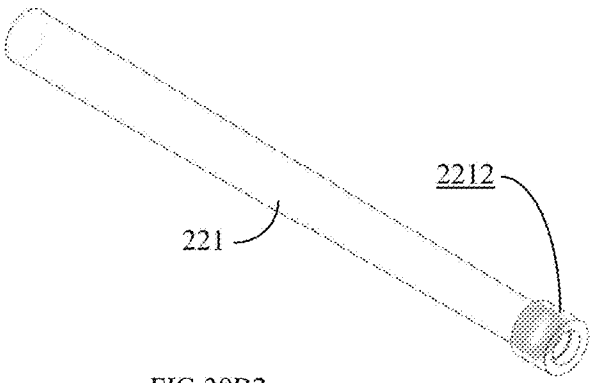
FIG.38B2
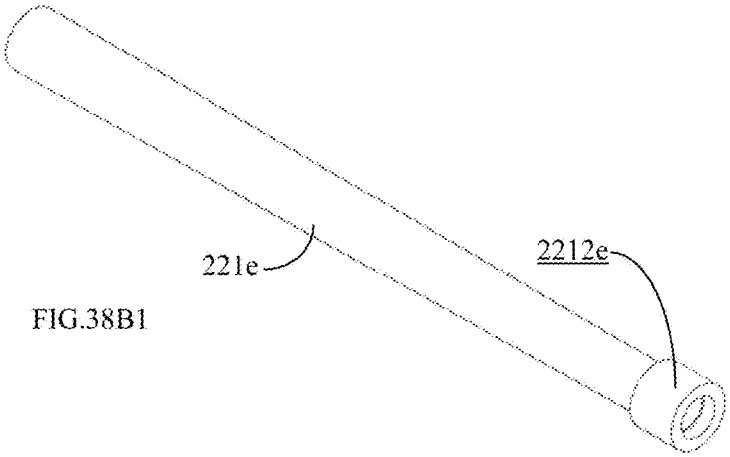
FIG.38B1
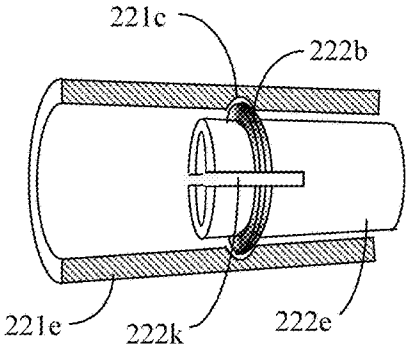
FIG.38B4
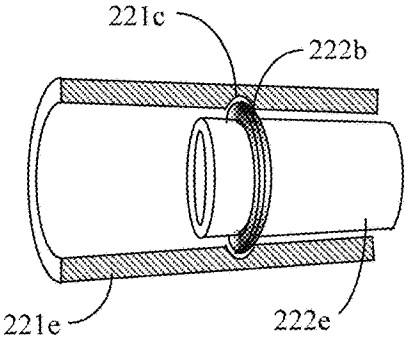
FIG.38B3

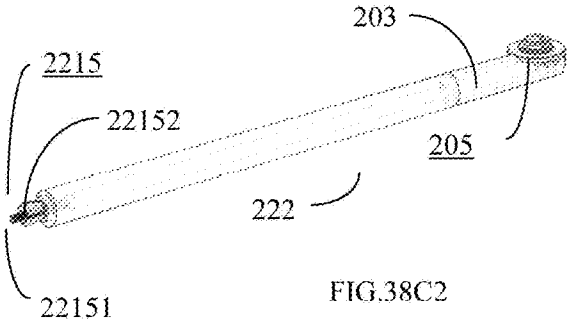
FIG.38C2
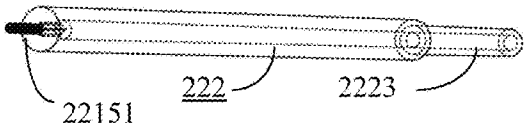
FIG.38D2
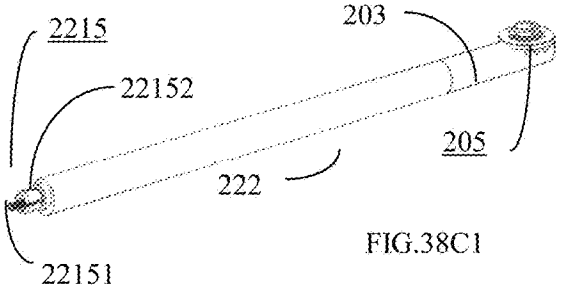
FIG.38C1
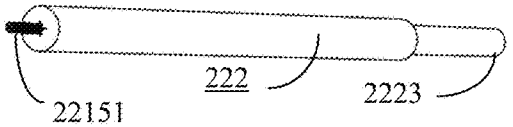
FIG.38D1

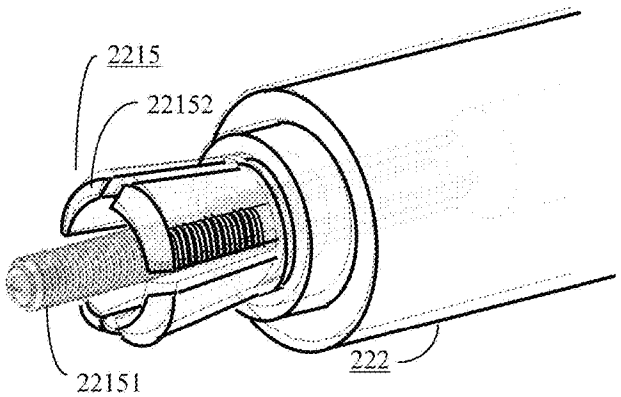
FIG.38E2
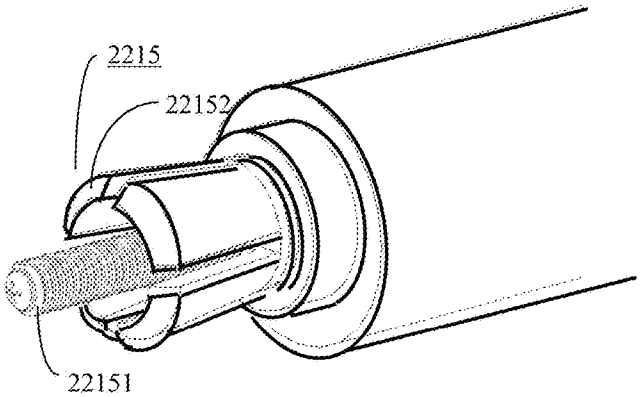
FIG.38E1
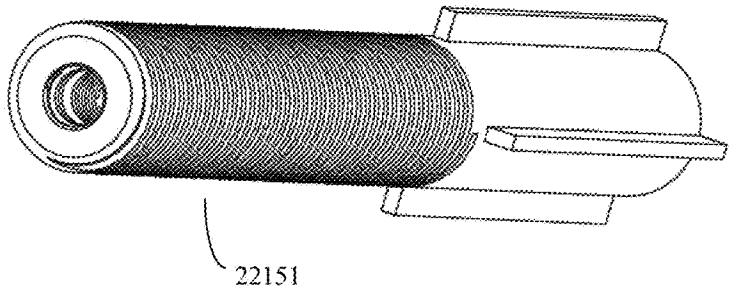
FIG.38G
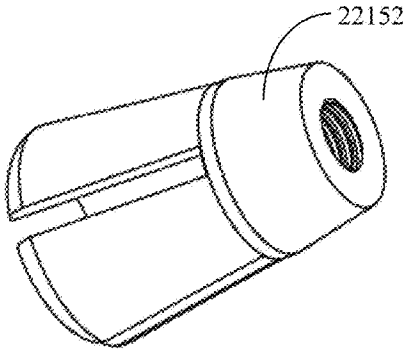
FIG.38F 106p
106d
106b
106s
106d 106v 106u 106p
106u
106s
106d 106v
106
106u
1L
105

106
106s
1L
105

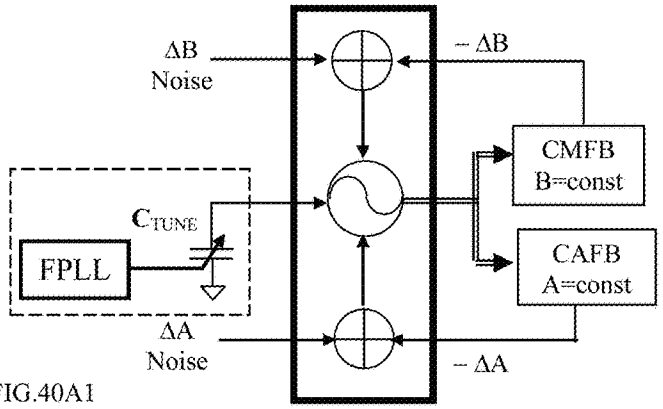
FIG.40A1
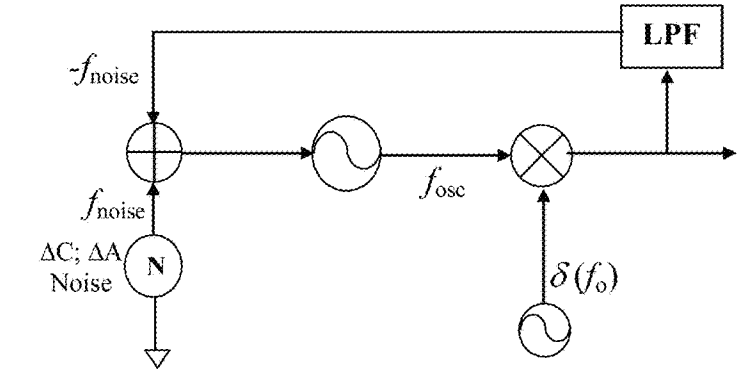
FIG.40B
$$fclk(t) = B + A\sin(\omega t + \phi(t)) = (B+\Delta B) + (A+\Delta A)\sin \omega t$$
$$\phi(t) = \sin^{-1}\{[\Delta B + \Delta A \sin \omega t]/A\}$$
$$\omega = 2p/(LC_{TUNE})1/2$$
peak detector
$$A = (A_{PEAK} - A_{VALLEY})/2$$
$$B = (A_{PEAK} + A_{VALLEY})/2$$
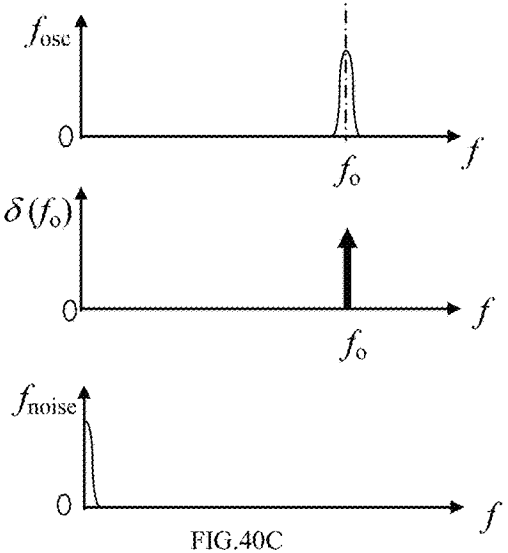
FIG.40C

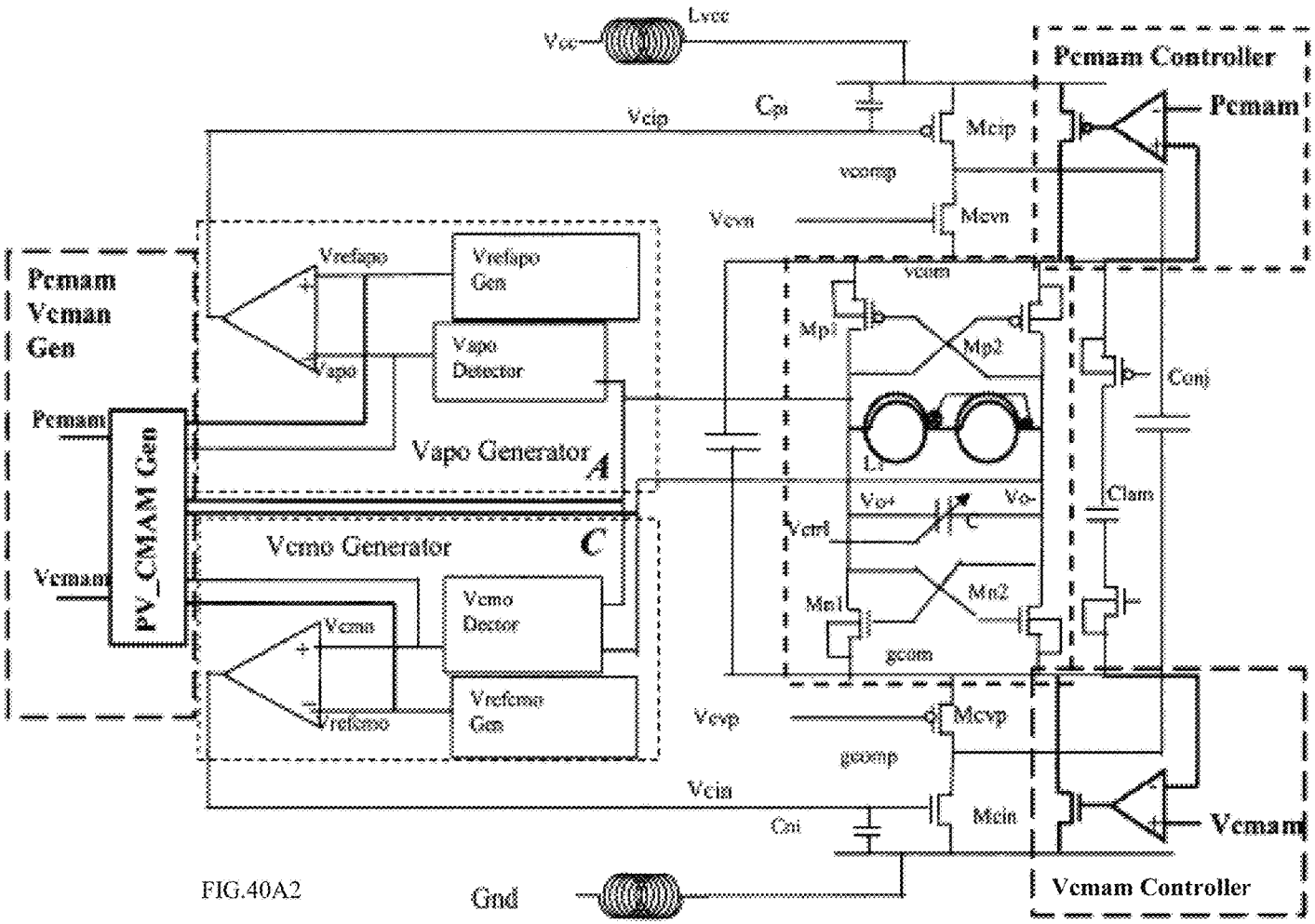
FIG.40A2

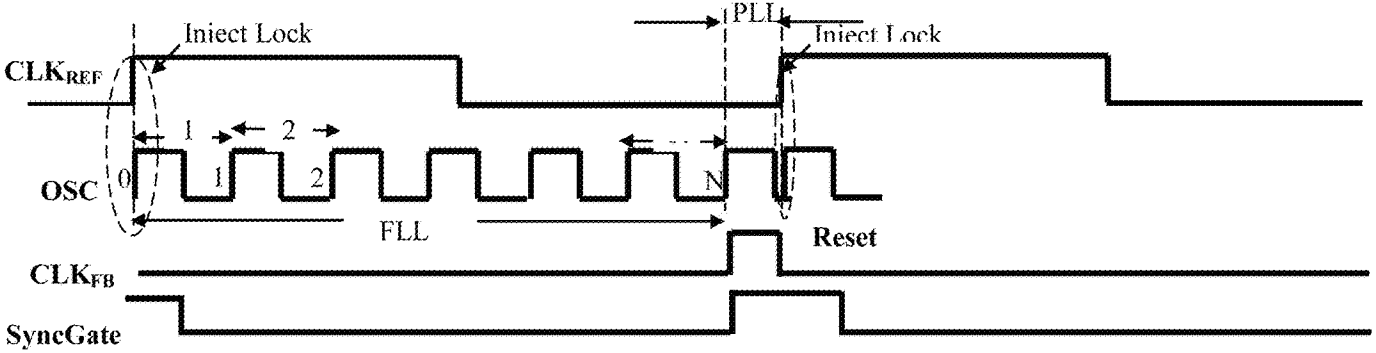
FIG.41A1
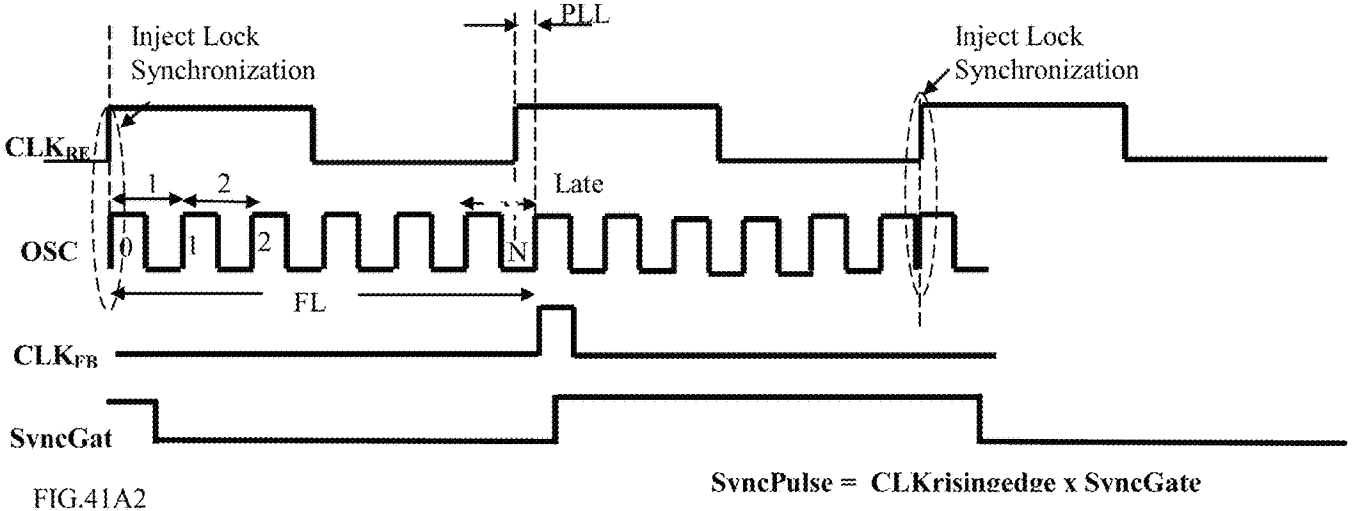
FIG.41A2

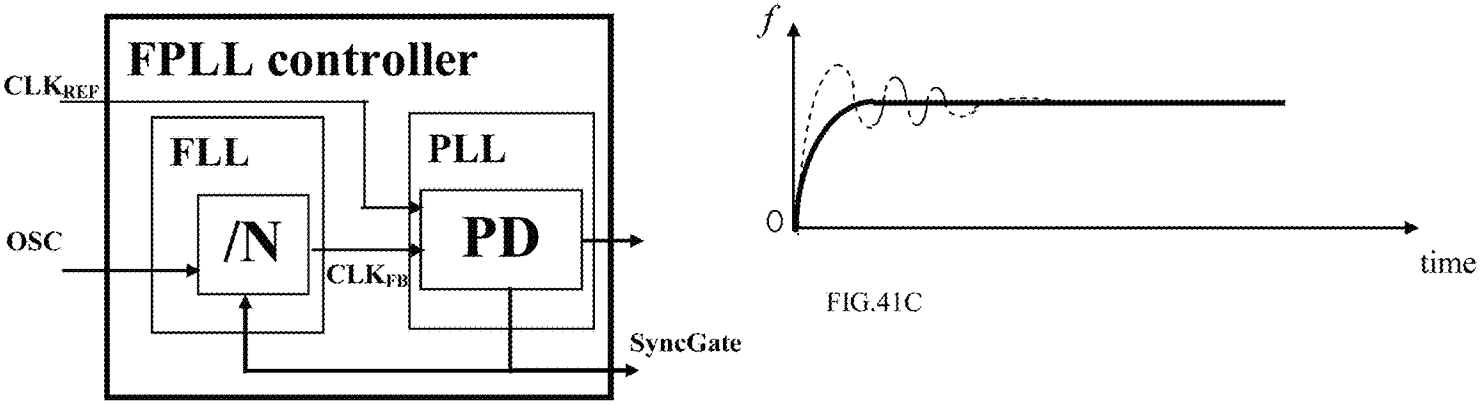
FIG.41B
FIG.41C
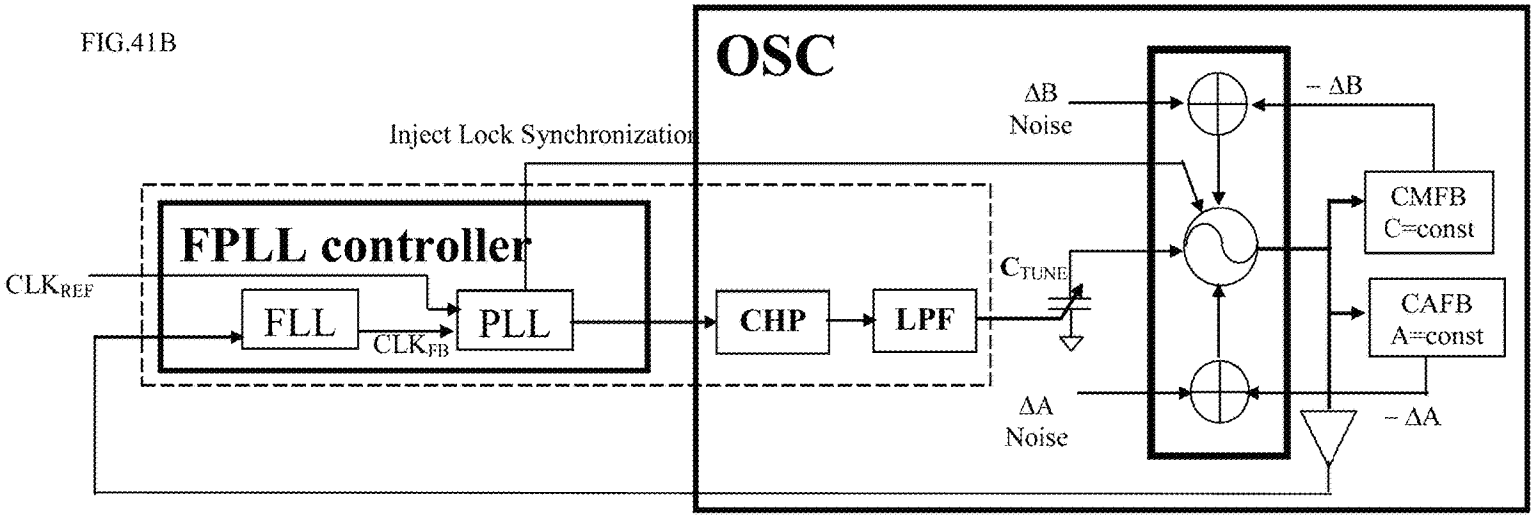
FIG.41D

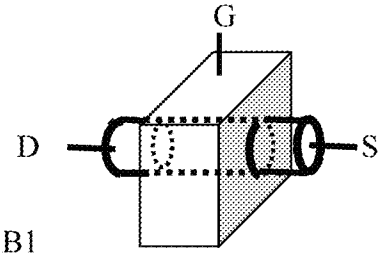
FIG.42B1
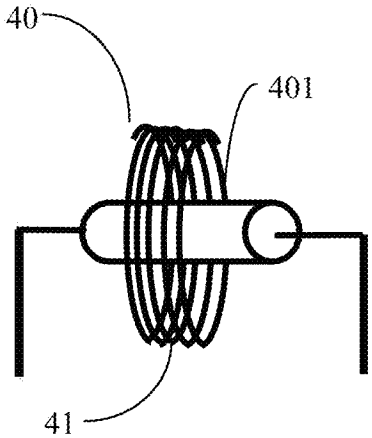
FIG.42B2
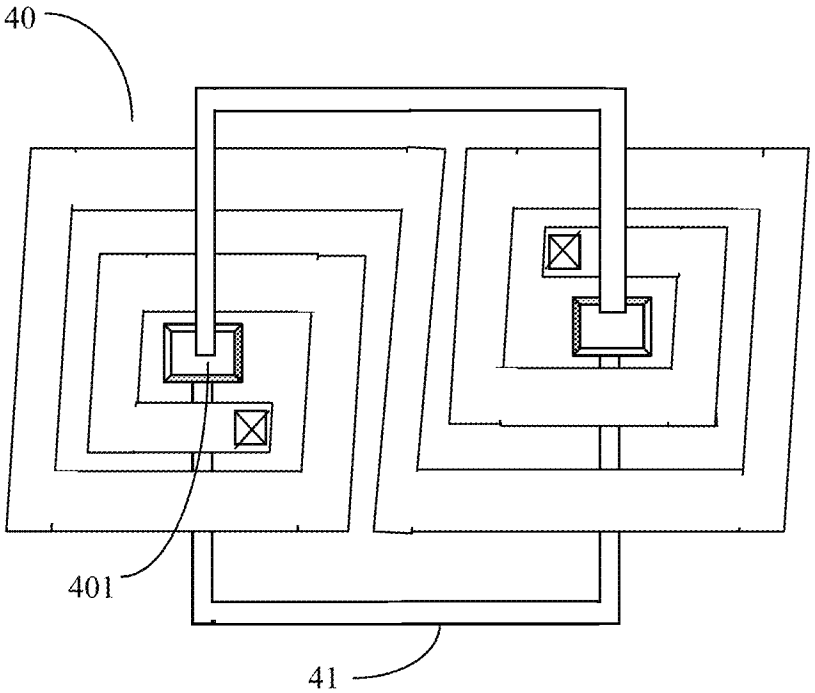
FIG.42A

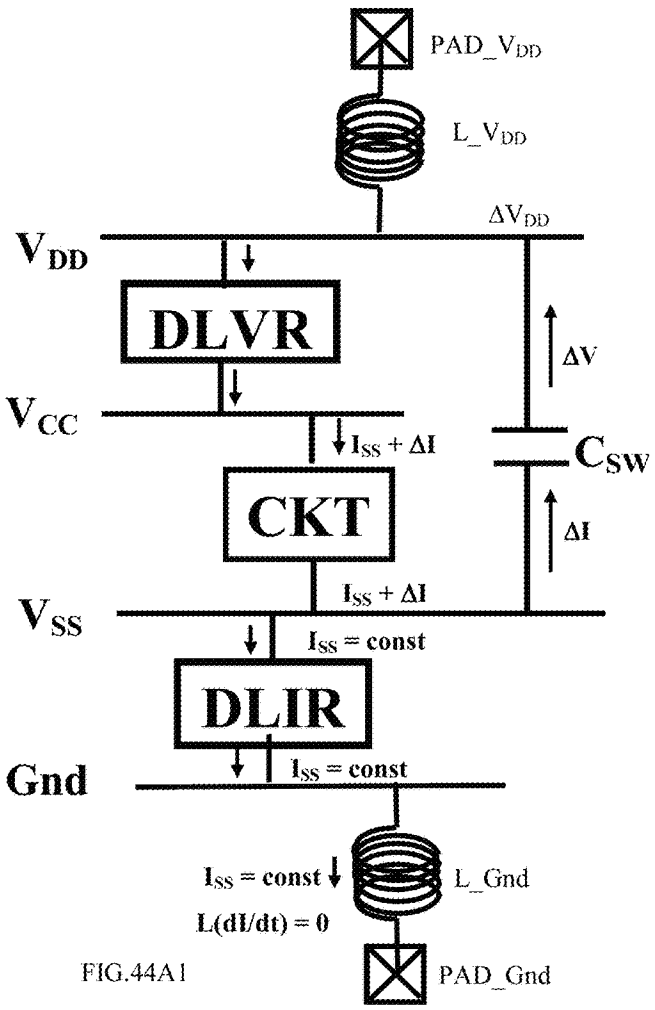
FIG.44A1

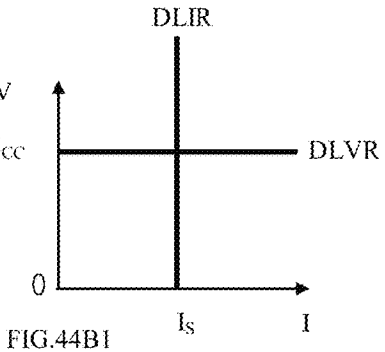
FIG.44B1
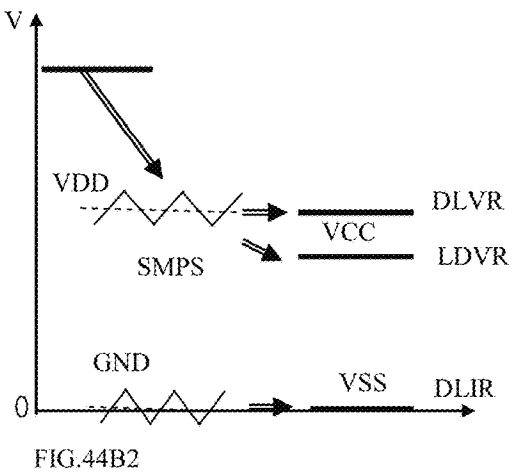
FIG.44B2
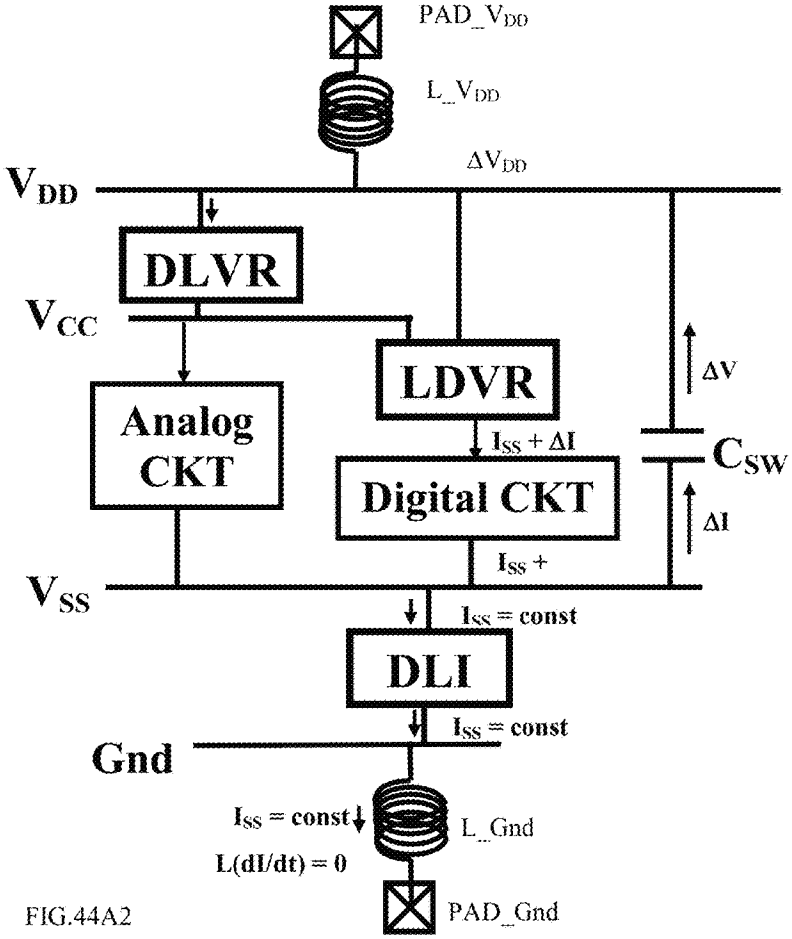
FIG.44A2

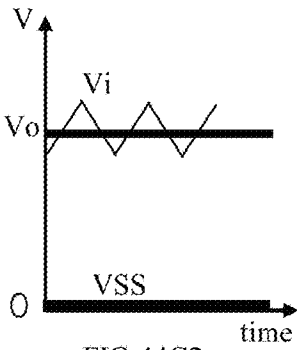
FIG.44C2
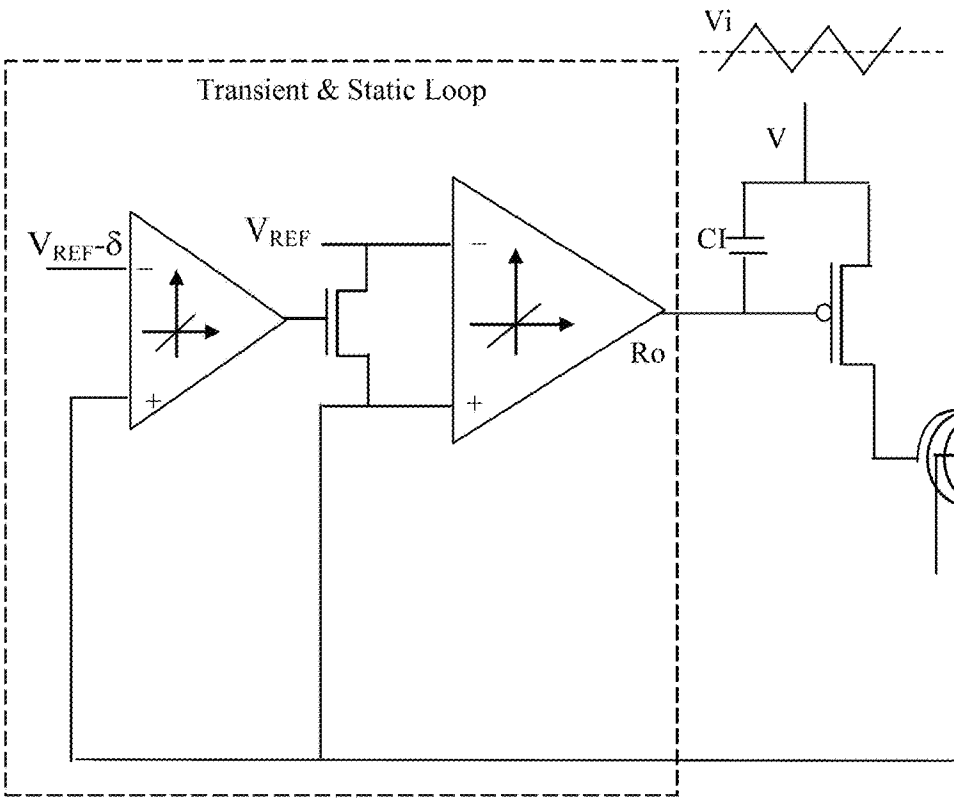
FIG.44C1

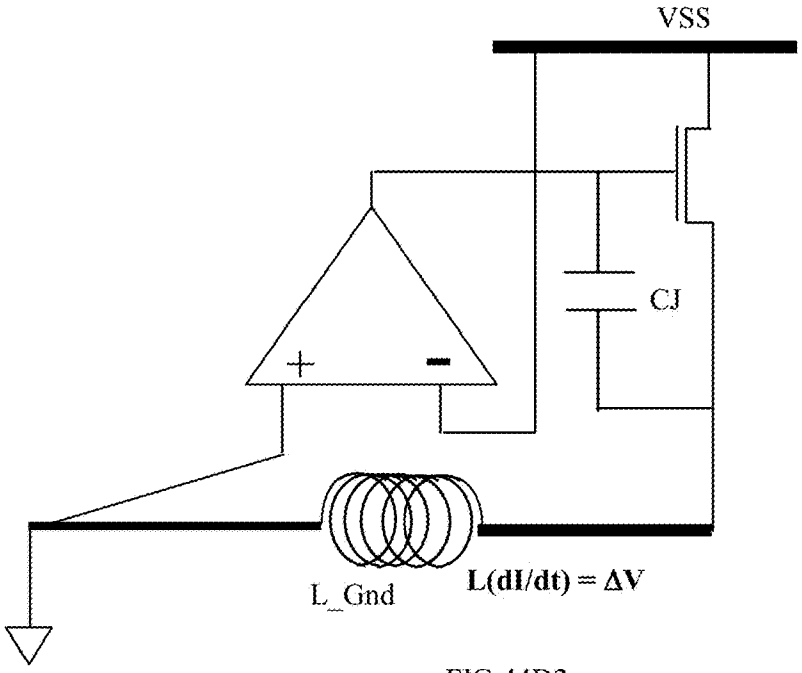
FIG.44D2
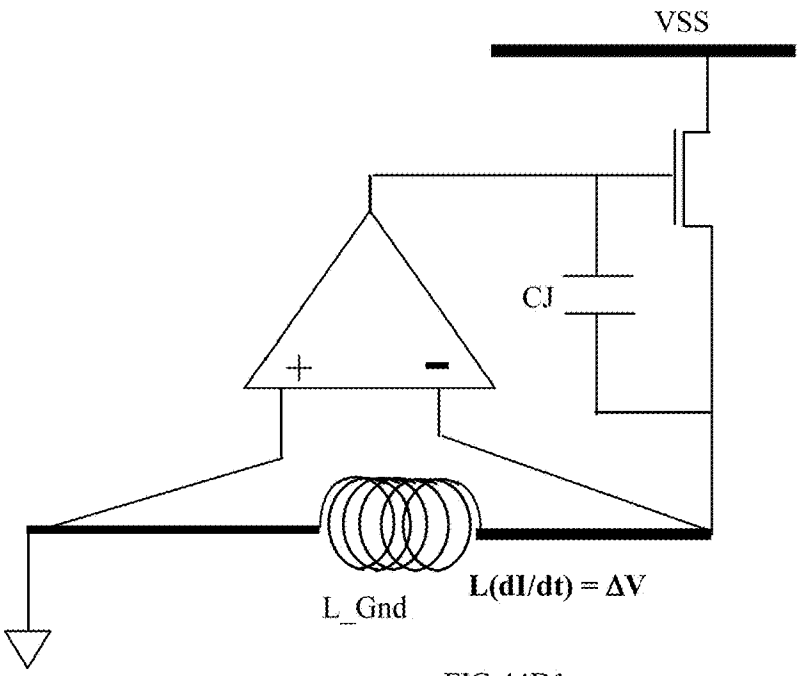
FIG.44D1

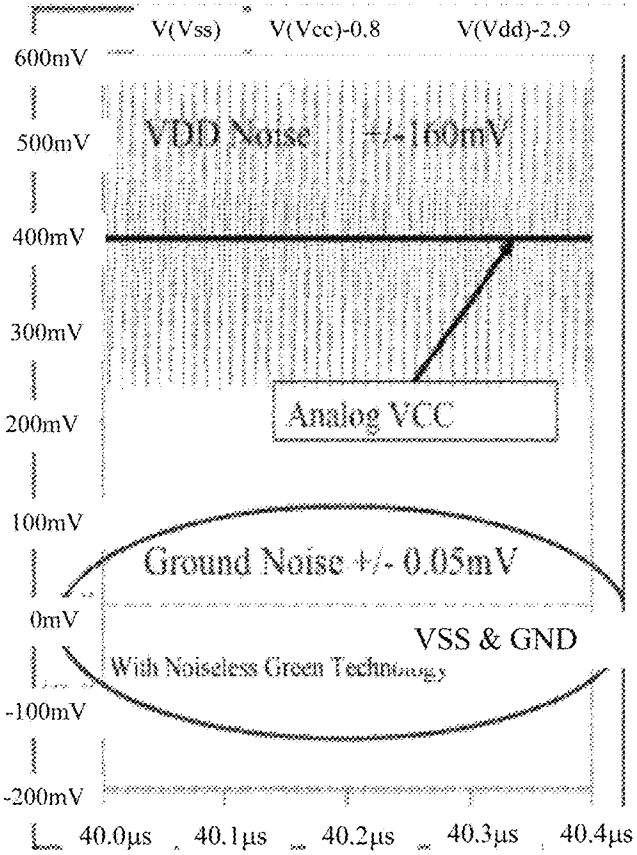
FIG.44H2
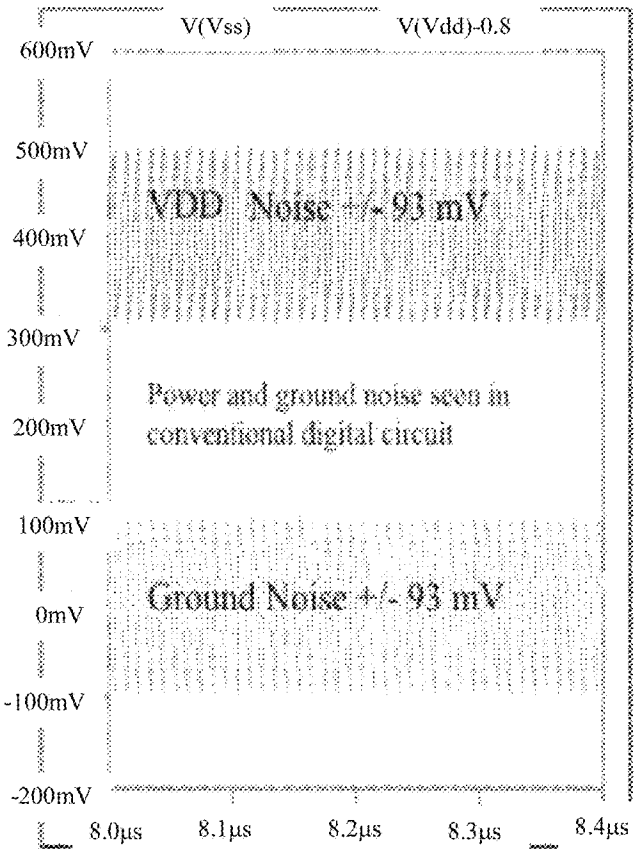
FIG.44H1

DISCLUB GOLF: DISCLUB, GOLFDISC AND DISCOPTER

RELATED APPLICATIONS

This is a Continuation in Part application claims priority of patent applications of U.S. patent application Ser. No. 15/472,262 filed Mar. 28, 2017, Ser. No. 14/541,152 filed Nov. 14, 2014 now U.S. Pat. No. 9,855,510 issued on Jan. 2, 2018, Ser. No. 13/918,989 filed Jun. 16, 2013, U.S. patent application Ser. No. 12/422,719 filed Apr. 13, 2009; U.S. patent application Ser. No. 12/317,973, filed Dec. 31, 2008, now U.S. Pat. No. 8,089,324 issued on Jan. 3, 2012; U.S. patent application Ser. No. 12/291,984, filed Nov. 12, 2008; U.S. patent application Ser. No. 12/291,618, filed Nov. 12, 2008, now U.S. Pat. No. 7,876,188 issued on Jan. 25, 2011; U.S. patent application Ser. No. 12/288,770, filed Oct. 23, 2008, now U.S. Pat. No. 7,663,349 issued on Feb. 16, 2010; U.S. patent application Ser. No. 12/229,412, filed Aug. 23, 2008, now U.S. Pat. No. 8,089,323 issued on Jan. 3, 2012; U.S. patent application Ser. No. 12/157,785, filed Jun. 14, 2008, now U.S. Pat. No. 7,857,718 issued on Dec. 28, 2010; U.S. patent application Ser. No. 12/074,143, filed Feb. 29, 2008, now U.S. Pat. No. 7,794,341 issued on Sep. 14, 2010; U.S. patent application Ser. No. 11/210,306, filed Aug. 24, 2005, now U.S. Pat. No. 7,422,531 issued on Sep. 9, 2008; U.S. patent application Ser. No. 10/842,739, filed May 10, 2004, now U.S. Pat. No. 7,101,293 issued on Sep. 5, 2006; U.S. patent application Ser. No. 09/127,255, Jul. 31, 1998, now U.S. Pat. No. 6,193,620 issued on Feb. 27, 2001; U.S. patent application Ser. No. 12/082,601, filed Apr. 12, 2008; U.S. patent application Ser. No. 12/079,179, filed Mar. 25, 2008, now U.S. Pat. No. 8,089,353 issued on Jan. 3, 2012; U.S. patent application Ser. No. 11/593,271, filed Nov. 6, 2006, now U.S. Pat. No. 7,511,589; U.S. patent application Ser. No. 11/500,125, filed Aug. 5, 2006, now U.S. Pat. No. 7,525,392 issued on Apr. 28, 2009; U.S. patent application Ser. No. 892,358, filed Jul. 14, 1997, now U.S. Pat. No. 5,850,093; U.S. patent application Ser. No. 854,800, filed Mar. 23, 1992, now U.S. Pat. No. 5,280,200; U.S. patent application Ser. No. 81,074, filed Jun. 22, 1993, now U.S. Pat. No. 5,793,125; U.S. patent application Ser. No. 577,792, filed Sep. 5, 1990, now U.S. Pat. No. 5,198,691; U.S. patent application Ser. No. 577,791, filed Sep. 5, 1990, now U.S. Pat. No. 5,111,076; which herein incorporated by reference in its entirety.

FIELD OF THE INVENTION

SAVE GOLF COURSE with DisClub Golf: Golf does not die, Long Live the Golf!

The conventional golf sport is the ball golf. The ball of golf sport is named as golf ball. To play the ball golf sport, Ball Golf is to use the two hands to swivel the club to have the snap hit on the golf ball to fly.

The conventional disc golf sport is the disc golf. To play the disc golf sport, disc golf is to use the single hand to swivel the hand to have the snap force to throw the disc to fly.

The DisClub Golf is a new golf sport invented by the Tarng Family. The disc of DisClub Golf is named as golfdisc. To play the disc golf sport, the disclub golf is to use the two hands to swivel the disclub to have the snap force to launch the golfdisc to fly.

Furthermore, to search the golfdisc in the golf course, the disclub golfer can use the discopter to search the lost golfdisc in the discgolf course. The discopter is headwear on the head of disclub golfer. The discopter can take off from the head of disc golfer. With the smart phone and video camera carried by the discopter, the disclub golfer can identify the lost golfdisc in the golf course or discgolf course.

All the golf sports, golf ball, disc golf and disclub golf, have something in common such as snap action. However, the disclub golf has many unique properties. There are many wrong concepts about disclub golf.

The snapping force in the golf sport is very important concept. At the instant of the launching time, there is the snapping action of suddenly applying the impulse force. The ball golf is to hit the still ball with the club head. It has the natural snapping force in the ball golf.

In the disc golf, as the hand swivels, the disc moves along with the hand to build the disc momentum. The hand grasps the disc firmly. However, the disc is already moving in the swivel of hand. At the launching point of disc, the golfer suddenly applies the impulse force to the disc with the snapping action. The snapping action of hand is made along the tangent direction of the disc trajectory. Due to the firm grasp of hand, all the snapping impulse momentum is transmitted to the disc to be the disc flying momentum efficiently.

Similarly, to have the snapping throw of the golfdisc, the golfdisc cannot dangle freely on the disclub head. In the disclub golf sport, to transfer the energy from the disclub to the golfdisc efficiently, the disclub head has to grasp the golfdisc firmly. The cam locking is adopted to hold the golfdisc to the disclub head to transfer the snapping impulse momentum from the disclub to golfdisc efficiently.

The disc has the best performance is to have the same profile in all the directions. The disc of conventional disc golf is perfect symmetry to have the best performance. The golfdisc of the disclub golf is different from the disc of disc golf. The modifications of the conventional disc with the addition of discap to be the golfdisc will deteriorate the disc flying performance. Therefore, it is to modify the disc of disc golf to be the golfdisc of disclub golf with the minimum disturbance of the airflow. The following principles must be followed to modify golfdisc to keep the best performance of the original disc of disc golf.

The principles to modify disc and the rule of thumbs of the golfdisc design are as follows.

(1) All the discap of the golfdisc is embedded in the disc.

(2) The size of the discap opening is minimized.

(3) To minimize the cap opening,

The middle portion of the discap is filled up with whistle type plateau.

(4) (A) The disc takes off the disclub head is in the horizontal direction with the slicing action that the bottom plate is flat and horizontal.

(B) To minimize the effect of discap, the air does not blow into the discap.

The bottom edge is 0 degree that the air will not blow into the discap.

The bottom edge serves as the horizontal stabilizer.

(5) At the front edge, the trail flap is a triangle to increase the lift.

At the right and left edges, the trail flap serves as the vertical stabilizer.

At the rear edge, the trail flap reduces the air injecting into the cavity of discap to reduce the drag.

Many thanks to Mrs. Shun-Yu Nieh and Jwu-Ing Tarng, the King of Golf is back. It is the disclub golf saving both the golf and the golf course. Even for the previous old version of disclub golf, there are already many people expressing to buy the disclub golf. However, we hold it until we have made the technology breakthrough of cam locking and Super-Drift Tangs-Force golfdisc as disclosed in this patent application. For the popular convenience, the people who are interested to buy the cutting-edge dual phone DP, discopter, golfdisc and disclub of disclub golf, please contact Dr. Min Ming Tang as follows: Nobleman Son School, Golf/DisClub Golf Kid School, Kedi Art School/Kids of Jedi School, and Zedi Art School/the Last Jedi School, PDCGA, TANG SYSTEM, 4225 Borina Drive, San Jose, Calif. 95129, Tel: (408)-446-3163; (408)-504-7530(Cellular), Email: pdcfga@gmail.com, tangsystem@gmail.com; the official Profession DisClub Golf Association PDCGA Website: http://www.PDCFGA.com. The Kedi is the Kid of Jedi. The Kedi Art School teaches the versatile modern Jedi arts including the DisClub Golf of DisClub and GolFrisbee.

Long Live the Golf ! Golf does not die, Golf just becomes the next generation DisClub Golf. Ball Golf is dying. Even though the Disc Golf is rising, however, due to the Disc Golf requirement of body strength, the Disc Golf cannot be the next generation Golf, either. The only hope is the DisClub Golf which is the hybrid of Ball Golf and Disc Golf.

DisClub Golf—the Greatest Innovation in Golf and Disc Golf: (1) Enjoy Disc Golf w/o the requirements of strong body; (2) Bring the kids, ladies, wife and grandparents together to enjoy healthy Family Golf sport; (3) it might SAVE GOLF COURSE with DisClub Golf. The Professional DisClub Golf Association (PDCGA) head quarter is located at 4225 Borina Drive, San Jose, Calif. 95129. PDCGA not only has the DisClub Golf Proshop selling the DisClub and GolFrisbee but also "ZeDi Camp: NxGen Kids Golf School/Class" provides three classes in series:

(1) Noble/Nobleman Son/Kid School(貴胄子弟聖學堂);
(2) Golf/Golfman Son/Kid School(高夫兒女聖學堂) (Kedi Art School/Kids of Jedi School);
(3) Zedi/Zediman Son/Kid School (絕代武士聖學堂) (Zedi Art School/the Last Jedi School).

The Nobleman Son School is to train the whole body Snap force capability and the Nobleman Son academic Sage studies of the greatest Oriental Emperor's knowledge and Performance. The Golfman Son School is to train the DisClub Snap force capability and the ball and disc air dynamic academic studies. Zediman Son School is to train the last Jedi the supernatural and inter-star mental communication capability for the star war of Zediman Son.

The FaceBook Group of PDCGA:Professional DisClub Golf Association is https://www.facebook.com/groups/217281025597009/

The Snap is the most important factor in the Long Drive of DisClub Golf. The Grand Demo of DisClub Golf is posted on the Youtube, https://www.youtube.com/watch?v=W_mJrLPDMfk The Grand Demo of DisClub Golf:

(1) the Long Drive Demo with the "Prototype" of Disclub Golf made of "Fishing Pole";
(2) the Putt Demo with the GolFrisbee and Golf Club of the 2nd Generation DisClub Golf; and
(3) the Grand Demo with the 1st Generation GolfRing.

For the safety purposes, in this Grand Demo, the Golf Ring was thrown into the cloud like the arrow did. Due to the swivel to fly with the club, the golfring flied so fast that you hardly saw it until it fell downward. In the future, for the coming the 4th Generation DisClub sample, the club of the DisClub Golf will be made of the Golf Club and swivel as the Golf does.

BACKGROUND FIELD OF INVENTION

The disclub golf is the disc golf for the old retired man. The old retired man stands still and swivels the disclub to launch the disc. It is similar to the traditional ball golf. With the flagpole being replaced by the inverted umbrella type flagpole, the disclub golf can play on the golf course, too.

Disclub golf is the new golf sport invented by the Tarng Family. It is dedicated for the old retired men who liked the disc golf as they were young. However, as the disc golfers become old, they are no more able to play the disc golf in the rough disc golf course. The old disc golfer can play the disclub golf in the plain golf course. The disclub golf is compatible with the ball golf to play in the same golf course.

The golf ball can be hit with the launching angle to be 45° relative the ground. The 45° is to have the maximum throwing distance for golf ball. However, the conventional disc is thrown with 0° relative to the ground.

Furthermore, on the golf ball, there are dimples to enhance the golf ball flying distance. The golf ball dimples use the Magnus force to enhance the flying distance. However, in the conventional disc, the surface of disc is flat. There are no dimples on disc surface to enhance the distance.

On our invention Tarng golfdisc, there are dimples on the surface of disc. With the dimples, the Tarng Force can increase the launch angle from 0° to 45°, etc. With the increment of the launching angle from 0° to 45°, the dimples on the Tarng golfdisc surface can enhance the flying distance of the Tarng disc.

For the single piece aerofoil, the subsonic aerofoil has the round head. The supersonic aerofoil has the sharp triangle. The conventional disc is in subsonic operation range. However, the edge of the bottom edge of golfdisc is in the sharp triangle shape.

Furthermore, for the two-piece aerofoil, there is a flap at the tail edge of the aerofoil. To increase the lift force, the flap rotates downward.

The super-lift Tang golfdisc combines the above characteristics to be unique high lift disc. The golfdisc has the right triangle rim. The bottom edge of the rim is horizontal. The tail edge of the bottom edge has a triangle flap. At the front rim of the disc, the triangle flap servers as the downward flap to increase the lift. At the side rim of the disc, the triangle serves as the stability fin. At the rear rim of the disc, the triangle flap reduces the air blowing into the bore of the discap to reduce the drag. The super-lift Tang golfdisc can increase the drift capability and the gliding distance of the disc.

The super-lift Tang golfdisc of the disclub golf is different from the conventional disc of disc golf. As the super-lift Tang golfdisc launches from the disclub head, it is in the horizontal slicing action. The horizontal bottom plane can increase the horizontal operation angle of the launching disc. Furthermore, the horizontal bottom plane can reduce the air blowing into the bore to reduce the drag force of golfdisc.

The disc golf course usually locates in the rugged terrain. To make it easy to carry the disclub, the telescopic disclub is adopted. The telescopic disclub uses the screws to adjust and fix the length of disclub. Due to the swivel of the disclub, the reaction force of the disc will twist the telescopic disclub. The screw must be self-tighten due to the twist of the telescopic disclub. Therefore, there are the right-hand telescopic disclub and left-hand telescopic disclub.

The headwear discopter is to search the lost golfdisc in the golf course or discgolf course. There is a smart phone and video camera carried by the discopter. The headwear discopter takes off from the head of the disc golfer and searches the lost golfdisc in the golf course. The video is transmitted from the smart phone and video camera and transmitted back to the wrist-wear monitor for the disclub golfer to identify the lost golfdisc.

BACKGROUND-DESCRIPTION OF PRIOR ART

The ball golf is dead. It is declared by Lisa Gray, the Gray Matters Columnist, Houston Chronicle.

http://www.houstonchronicle.com/local/gray-matters/article/Golf-is-dead-5589999.php In the following article, Golfs/Disc Golf Decline: 5 Reason Why Golf/Disc Golf are Dying Sport|Money—Time Jun. 13, 2014–"While other sports have embraced new technology and innovation with open arms, traditionalists strive to protect the game of golf and keep them exactly as they love them-even in the face of suffering courses and shrinking audiences."

http://www.time.com/money/2871511/golf-dying-tiger-woods-elitist/

The disc golf is going to replace the ball golf. The conventional disc is hand thrown disc. It uses the hand to grasp the disc to swivel the disc to build up the momentum to maintain the flying direction and stability. As the disc is launched to fly, the hand uses the snapping action to apply the impulse force to the disc.

However, the ball golf is for the old retired man. The disc golf is for the young sportsman. They are two different segments of the sporting population. There is no disc golf for the old retired man. The conventional disc golf needs to run and throw the disc as the diskette does. The old retired man is too old to play the conventional disc golf.

All the conventional disc is thrown horizontally. It cannot use the increment of the launch angle to increase the disc flying distance. Furthermore, the conventional disc does not have the dimples to increase the flying distance.

There is no disclub golf before. There is no disclub to throw the disc. There is no disclub having the capability to apply the snapping force to launch the disc to fly. For the conventional disc, there is no disc having the super-lift at the low speed to increase the drift and gliding distance.

DisClub Golf is allowed to use both Disclub and hand to throw the disc. However, to avoid the snap causing the disc golf sporting injuries, for more than 400 feet throw, it strongly suggests to use the disclub as the "golf wood club" to throw disc. Disc Golf uses the arm as the Golf wood club. The golfer can change the broken wood club with the new Golf wood club. However, the disc golfer cannot change his wound arm with a new arm.

As shown in the following medical reports in journals,

Jun. 25, 2015 Disc Golf, a Growing Sport: Description and Epidemiology of Injuries . . . .

http://journals.sagepub.com/doi/full/10.1177/2325967115589076

Disc golf is a sport played much like traditional golf, but rather than using a ball and club, players throw flying discs with various throwing motions. It has been played by an estimated 8 to 12 million people in the United States. Like all sports, injuries sustained while playing disc golf are not uncommon. Although formalized in the 1970s, it has grown at a rapid pace; however, disc golf-related injuries have yet to be described in the medical literature. More than 81% of respondents stated that they had sustained an injury playing disc golf, including injuries to the elbow (n=325), shoulder (n=305), back (n=218), and knee (n=199). The injuries were most commonly described as a muscle strain (n=241), sprain (n=162), and tendinitis (n=145).

Objects and Advantages

To have the long distance drive, the snapping action is needed. The cam locking enables the snapping action of the disclub to apply the impulse force on the golfdisc. The dimples on the Tarng disc surface can increase the launch angle to enhance the flying distance to the disc. To enhance the flying distance, the super-lift disc has the flat bottom with the triangle flap to increase the drift and gliding distance of the golfdisc. The telescopic disclub is easy to carry in the rugged terrain. The head-wearing golfdisc or discopter can serve as the hat. The head-wearing discopter has the smart phone and camera, etc. to transmit the video signal to the wrist-wear monitor. Having the joints, with the smart phone and video camera, the golfdisc mounting on telescopic disclub serves as the self-portrait camera.

DRAWING FIGURES

FIG. 1A1 is the raising position to start the swivel of the basic disclub; FIG. 1A2 is the disclub at the snapping position of the swivel; FIG. 1A3 is the golfdisc at the launching position being ready to fly; FIG. 1A4 is the golfdisc taking off to fly in the sky; FIG. 1B1 is the raising position to start the swivel of the golf-club style disclub; FIG. 1B2 is the golf-club style disclub at the snapping position; FIG. 1B3 is the golfdisc at the launching position of the golf-club style disclub being ready to fly; FIG. 1B4 is the golfdisc of the golf-club style disclub taking off to fly in the sky; FIG. 1C1 is the telescopic disclub in the elongation position; FIG. 1C2 is the telescopic disclub in the shortened position; FIG. 1C3 is the extendable disclub in the extended position; FIG. 1C4 is the extendable disclub in the shortened position; FIG. 1C5 is the top view of the DisClub in the extendable disclub in the extended position; FIG. 1C6 is the top view of the DisClub in the extendable disclub in the shortened position; FIG. 1C7 is the side view of the DisClub in the extendable disclub in the extended position; FIG. 1C8 is the side view of the DisClub in the extendable disclub in the shortened position; FIG. 1D1 is the adjustable angle golf-club style disclub launching the disc to fly; it shows the DisClubGolfdisc combining with DisGolf; FIG. 1D2A is the adjustable angle golf-club style disclub at the launching position; swiveling the club to throw the golf ring on the flag pole as the quoits does; FIG. 1D2B is the adjustable angle golf-club style disclub in the folded position; FIG. 1E1 is the telescopic disclub at the self-portrait position; FIG. 1E2 is the telescopic disclub in the normal discgolf operation. They are the operations of the basic disclub golf, golf-club style disclub golf, telescopic disclub and golf-club style telescopic disclub.

FIG. 2A is the trajectories of the golf ball; FIG. 2B 1 is velocity profiles of the golf ball; FIG. 2B2 is the Magnus force applied to the analysis of the velocity profiles of the golf ball.

FIG. 3A is the disc attitudes varying along the flying velocity; FIG. 3B1 is the disc attitudes varying along the flying path; FIG. 3B2 is the disc attitudes having the Tarng force varying along the flying path.

FIG. 4A1 is the isometric top view of the super-lift golfdisc; FIG. 4A2 is the transparent solar cell version of the isometric top view of the super-lift golfdisc; FIG. 4B 1 is the top view of the super-lift golfdisc; FIG. 4B2 is the transparent solar cell version of the top view of the super-lift golfdisc; FIG. 4C1 is the isometric bottom view of the super-lift golfdisc; FIG. 4C2 is the transparent solar cell version of the isometric bottom view of the super-lift golfdisc; FIG. 4D is the side view of the super-lift golfdisc; FIG. 4E is the transparent solar cell version of the side view of the super-lift golfdisc; FIG. 4F is the section version of the side view of the super-lift golfdisc.

FIG. 5A1 is the dynamic analysis of the disc in the high speed air flow with the center of pressure being located at the rear of the center of gravity in the counter-clockwise rotation of disc; FIG. 5A2 is the dynamic analysis of the disc in the high speed air flow with the center of pressure being located at the front of the center of gravity in the counter-clockwise rotation of disc; FIG. 5B1 is the dynamic analysis of the disc in the high speed air flow with the center of pressure being located at the rear of the center of gravity in the clockwise rotation of disc; FIG. 5B2 is the dynamic analysis of the disc in the high speed air flow with the center of pressure being located at the front of the center of gravity in the clockwise rotation of disc; FIG. 5C is the trajectory of the flying disc; FIG. 5C1 is the dynamic analysis of the disc in the high speed air flow with the center of pressure being located at the rear of the center of gravity in the clockwise rotation of disc as shown in FIG. 5C; FIG. 5C2 is the dynamic analysis of the disc in the high speed air flow with the center of pressure being located at the front of the center of gravity in the clockwise rotation of disc as shown in FIG. 5C.

FIG. 6A1 is the isometric top view of the super-lift Tarng golfdisc having the Tarng force; FIG. 6A2 is the transparent version of the isometric top view of the super-lift Tarng golfdisc having the Tarng force; FIG. 6B1 is the isometric bottom view of the super-lift Tarng golfdisc having the Tarng force; FIG. 6B2 is the transparent version of the isometric bottom view of the super-lift Tarng golfdisc having the Tarng force; FIG. 6C1 is the transparent version of the side view of the super-lift Tarng golfdisc having the Tarng force; FIG. 6C2 is the transparent version of the section view of the super-lift Tarng golfdisc having the Tarng force to be implemented with the concave dimples; FIG. 6C3 is the transparent version of the section view of the super-lift Tarng golfdisc having the Tarng force to be implemented with the convex dimples.

FIG. 7A1 is the golfdisc having the Tarng force in the counter-clockwise rotation; FIG. 7A2 is the dynamic analysis of the golfdisc for the Tarng force in the counter-clockwise rotation; FIG. 7B 1 is the golfdisc having the Tarng force in the clockwise rotation; FIG. 7B2 is the dynamic analysis of the golfdisc for the Tarng force in the clockwise rotation;

FIG. 8A1 is the dynamic analysis for the golfdisc having the Tarng force rotating in the counter-clockwise direction having the center of pressure CP located after the center of gravity CG; FIG. 8A2 is the dynamic analysis for the golfdisc having the Tarng force rotating in the counter-clockwise direction having the center of pressure CP located before the center of gravity CG; FIG. 8B1 is the dynamic analysis for the golfdisc having the Tarng force rotating in the clockwise direction having the center of pressure CP located after the center of gravity CG; FIG. 8B2 is the dynamic analysis for the golfdisc having the Tarng force rotating in the clockwise direction having the center of pressure CP located before the center of gravity CG.

FIG. 9A is the side view of the flying trajectory and attitudes of the Tarng golfdisc having the Tarng force; FIG. 9B is the front view of the flying trajectory and attitudes of the Tarng golfdisc having the Tarng force; FIG. 9C is the dynamic analysis of the Tarng golfdisc having the Tarng force.

FIG. 10A1 is the isometric top view of the super-lift Tarng golfdisc having the Tarng force on top side and bottom side; FIG. 10A2 is the transparent version of the isometric top view of the super-lift Tarng golfdisc having the Tarng force on both top side and bottom side; FIG. 10B1 is the isometric bottom view of the super-lift Tarng golfdisc having the Tarng force on both top side and bottom side; FIG. 10B2 is the transparent version of the isometric bottom view of the super-lift Tarng golfdisc having the Tarng force on both top side and bottom side.

FIG. 11A is the transparent version of the top view of the super-lift Tarng golfdisc having the Tarng force on both top side and bottom side; FIG. 11B is the section view along the center line $CL_L$-$CL_L$ for the super-lift Tarng golfdisc having the Tarng force to be implemented with the concave dimples having the Tarng force on both top side and bottom side; FIG. 11C is the section view along the center line $CL_R$-$CL_R$ for the super-lift Tarng disc having the Tarng force to be implemented with the concave dimples on both top side and bottom side.

FIG. 12A1 is the isometric top view of the super-lift Tarng golfdisc having the rim adaptor, FIG. 12A2 is the transparent version of isometric top view of the super-lift Tarng golfdisc having the rim adaptor; FIG. 12B1 is the isometric bottom view of the super-lift Tarng golfdisc having the rim adaptor; FIG. 12B2 is the transparent version of isometric bottom view of the super-lift Tarng golfdisc having the rim adaptor; FIG. 12C is the section view of the super-lift Tarng golfdisc having the rim adaptor.

FIG. 13A is the top view of the discopter super-lift Tarng golfdisc having the rim adaptor; FIG. 13B is the bottom view of the discopter super-lift Tarng golfdisc having the rim adaptor; FIG. 13C is the side view of the discopter super-lift Tarng golfdisc having the rim adaptor.

FIG. 14A1 is the isometric top view of the discopter; FIG. 14A2 is the transparent version of the isometric top view of the discopter; FIG. 14B 1 is the isometric bottom view of the discopter; FIG. 14B2 is the transparent version of the isometric bottom view of the discopter.

FIG. 15A1 is the isometric top view of the discopter having the smart phone and microphone; FIG. 15A2 is the solar cell version of the isometric top view of the discopter having the smart phone and microphone; FIG. 15B1 is the isometric bottom view of the discopter having the smart phone and microphone; FIG. 15B2 is the solar cell version of the isometric bottom view of the discopter having the smart phone and microphone.

FIG. 16A1 is the isometric top view of the discopter in the disc-ring shape having the smart phone and microphone; FIG. 16A2 is the solar cell version of the isometric top view of the discopter in the disc-ring shape having the smart phone and microphone; FIG. 16B 1 is the isometric bottom view of the discopter in the disc-ring shape having the smart phone and microphone; FIG. 16B2 is the solar cell version of the isometric bottom view of the discopter in the disc-ring shape having the smart phone and microphone; FIG. 16C1 is the section view of the discopter in the disc-ring shape having the smart phone and microphone; FIG. 16C2 is the section view of the discopter in the disc-ring shape having the propellers; FIG. 16C3 is the top isotropic view to show the discopter serving as for the Head Wearing Device of the Smart Hat of iHat; FIG. 16C4 is the front view to show the discopter serving as for the Head Wearing Device of the Smart Hat of iHat.

FIG. 17A1 is the isometric top view of the discopter in the disc-ring shape having the adjustable rim for the different size of the head; FIG. 17A2 is the solar cell version of the isometric top view of the discopter in the disc-ring shape having the adjustable rim for the different size of the head; FIG. 17B1 is the isometric bottom view of the discopter in the disc-ring shape having the adjustable rim for the different size of the head; FIG. 17B2 is the solar cell version of the isometric bottom view of the discopter in the disc-ring shape having the adjustable rim for the different size of the head; FIG. 17C1 is the side view of the thick golfring; FIG. 17C2 is the section isotropic view of the thick golfring; FIG. 17C3 is the bottom isotropic view of the thick golfring; FIG. 17D1 is the side view of the thin golfring; FIG. 17D2 is the section isotropic view of the thin golfring; FIG. 17D3 is the bottom isotropic view of the thin golfring.

FIG. 18A1 is the isometric top view of the discopter in the disc shape having the adjustable rim for the different size of the head; FIG. 18A2 is the solar cell version of the isometric top view of the discopter in the disc shape having the adjustable rim for the different size of the head; FIG. 18B 1 is the isometric bottom view of the discopter in the disc shape having the adjustable rim for the different size of the head; FIG. 18B2 is the solar cell version of the isometric bottom view of the discopter in the disc shape having the smart phone.

FIG. 19A1 is the isometric top view of the discopter in the flexible hat shape having the adjustable rim for the different size of the head; FIG. 19A2 is the solar cell version of the isometric top view of the discopter in the flexible hat shape having the adjustable rim for the different size of the head; FIG. 19B1 is the isometric bottom view of the discopter in the flexible hat shape having the adjustable rim for the different size of the head; FIG. 19B2 is the solar cell version of the isometric bottom view of the discopter in the flexible hat shape having the smart phone.

FIG. 20A is the side view of the super-lift disc to show the golfdisc profile of the disclub golf; FIG. 20B is the transparent version of the side view of the super-lift golfdisc to show the discap structure and the golfdisc profile of the disclub golf; FIG. 20C is the section view of the super-lift golfdisc to show the discap structure and the golfdisc profile of the disclub golf.

FIG. 21A is the side view of the super-lift Tarng golfdisc to show the golfdisc profile of the disclub golf; FIG. 21B is the section view of the super-lift Tarng golfdisc to show the discap structure and the golfdisc profile of the disclub golf having low air drag force; FIG. 21C1 is the enlarged section view of the super-lift Tarng golfdisc to show the discap structure and the golfdisc profile of the disclub golf having the low air drag force; FIG. 21C2 is the enlarged section view of the super-lift Tarng golfdisc to show the golfdisc profile of the disclub golf having the low air drag force.

FIG. 22A is the side view of the super-lift Tarng golfdisc to show the golfdisc having the subsonic aerofoil with flat bottom profile of the disclub golf; FIG. 22B is the transparent version of the side view of the super-lift Tarng golfdisc having the subsonic aerofoil with flat bottom to show the discap structure and the golfdisc profile of the disclub golf having the adaptable rim; FIG. 22C is the section view of the super-lift Tarng golfdisc having the subsonic aerofoil with flat bottom to show the discap structure and the golfdisc profile of the disclub golf having the adaptable rim; FIG. 22D is the bottom view of the super-lift Tarng golfdisc having the subsonic aerofoil with concave bottom to show the discap structure and the golfdisc profile of the disclub golf having the adaptable rim; FIG. 22E is the section view of the super-lift Tarng golfdisc having the subsonic aerofoil with concave bottom to show the discap structure and the golfdisc profile of the disclub golf having the adaptable rim; FIG. 22F is the section view of the rim for the super-lift Tarng golfdisc having the subsonic aerofoil with concave bottom to show the discap structure and the golfdisc profile of the disclub golf having the adaptable rim; FIG. 22G is the section view of the adaptor embedded in the rim for the super-lift Tarng golfdisc having the subsonic aerofoil with concave bottom to show the discap structure and the golfdisc profile of the disclub golf having the adaptable rim; FIG. 22H is the bottom view of the adaptor embedded in the rim for the super-lift Tarng golfdisc having the subsonic aerofoil with concave bottom to show the discap structure and the golfdisc profile of the disclub golf having the adaptable rim; FIG. 22I is the side transparent view of the DisClub Head for the super-lift Tarng golfdisc having the subsonic aerofoil with concave bottom to show the discap structure and the golfdisc profile of the disclub golf having the adaptable rim; FIG. 22J the flap and slat structure of the golfrisbee; FIG. 22K is the alternative view of the wing-fin-flap and slat structure of the golfrisbee; FIG. 22L is the bottom view of the wing-fin-flap and slat structure of the golfrisbee; FIG. 22M is the isotropic view of the wing-fin-flap and slat structure of the golfrisbee, FIG. 22N is the top view of the wing-fin-flap and bumper-fin-slat structure of the golfrisbee; FIG. 22O is the top view of the wing-fin-flap and bumper-fin-slat structure of the golfrisbee; FIG. 22P is the top view of the wing-fin-flap and bumper-fin-slat structure of the golfrisbee; FIG. 22Q is the injection module of the golfrisbee.

FIG. 23A is the isometric section view of the discopter to show the discap structure; FIG. 23B is the isometric section view of the discopter to show the smart phone structure; FIG. 23C is the isometric section view of the discopter to show the propeller structure.

FIG. 24A is the cam locking clip mechanism in the lock position; FIG. 24B is the force analysis of the cam locking clip mechanism.

FIG. 25A is the bottom view of discap having the single cam locking clip mechanism; FIG. 25B is the isometric bottom view of discap having single cam locking clip mechanism; FIG. 25C is the isometric top view of discap having three anti-thrust poles.

FIG. 26A is the top view of the disclub head having single cam locking clip mechanism; FIG. 26B is the isometric top view of the disclub head having the single cam locking clip mechanism; FIG. 26C is the isometric bottom view of the disclub head having the single cam locking clip mechanism; FIG. 26D1 is the disclub head of the extendable disclub; FIG. 26D2 is the transparent view of the disclub head for the extendable disclub.

FIG. 27A is the top transparent view of the single cam locking clip mechanism in the lock position; FIG. 27B is the top transparent view of the single cam locking clip mechanism in the release position.

FIG. 28A1 is the bottom view of discap having the triple cam locking clip mechanism; FIG. 28A2 is the top view of disclub head having the triple cam locking clip mechanism; FIG. 28B1 is the isometric bottom view of discap having the triple cam locking clip mechanism; FIG. 28B2 is the isometric top view of disclub head having the triple cam locking clip mechanism.

FIG. 29A is the top view of the triple cam locking clip mechanism in the release position; FIG. 29B is the top view of the triple cam locking clip mechanism in the first lock position; FIG. 29C is the top view of the triple cam locking clip mechanism in the second lock position; FIG. 29D is the top view of the triple cam locking clip mechanism in the third lock position; FIG. 29E1 shows the discap embedded in the golfrisbee; FIG. 29E2 shows the cave of the discap embedded in the golfrisbee after the discap being removed for the discap as shown in FIG. 29E5; FIG. 29E3 shows the bottom view of the discap; FIG. 29E4 shows the top view of the discap having the anti-shock stubs; FIG. 29E5 shows the top view of the discap having the concave structure for the plastic injection to reduce the shrinkage; FIG. 29F1 shows the adaptable discap embedded in the golfrisbee; FIG. 29F2 shows the bottom view of the adaptable discap; FIG. 29F3 shows the top view of the adaptable discap having the anti-shock stubs; FIG. 29F4 shows the cave of the adaptable discap embedded in the golfrisbee after the adaptable discap being removed for the discap as shown in FIG. 29F3; FIG. 29F5 shows the top view of the adaptable discap having the concave structure for the plastic injection to reduce the shrinkage; FIG. 29F6 shows the cave of the adaptable discap embedded in the golfrisbee after the adaptable discap being removed for the discap as shown in FIG. 29F5; FIG. 29G1 shows the foil stamping of golfrisbee; FIG. 29G2 shows the foil stamping of golfrisbee; FIG. 29H1 shows the foil stamping of golfrisbee; FIG. 29H2 shows the foil stamping of golfrisbee; FIG. 29I is the LOGO for Professional Woman DisClub Golf Association; FIG. 29J is the LOGO for DisClub Golf; FIG. 29K is the symbol of DisClub Golf.

Figure 32B:
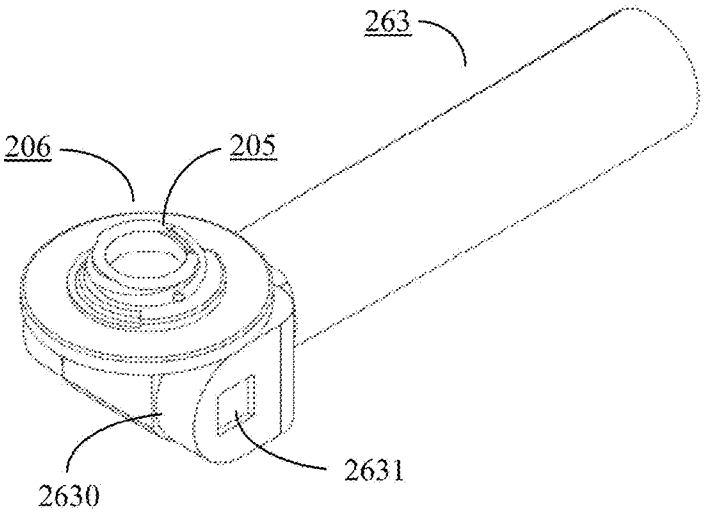
Figure 32A:
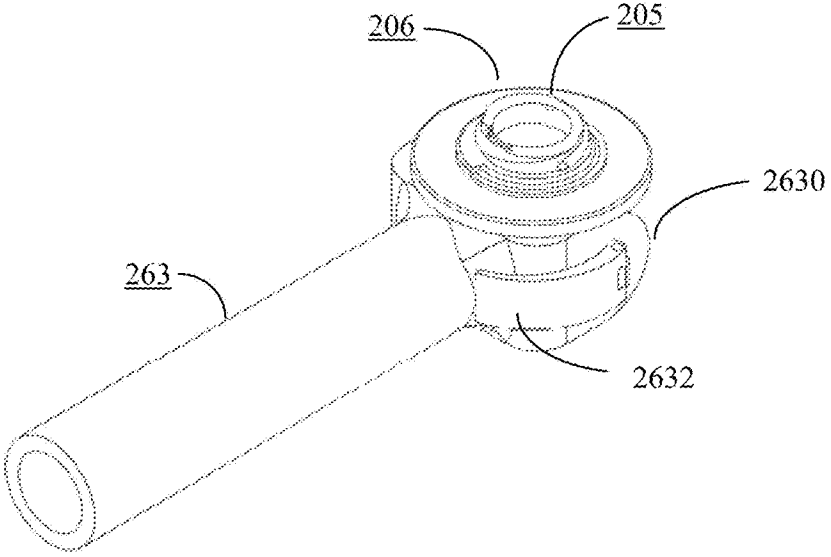

FIG. 32A is the right isometric view of the adjustable disclub head; FIG. 32B is the left isometric view of the adjustable disclub head; FIG. 32C 1 is the bottom view of the adjustable disclub head; FIG. 32C2 is the bottom transparent view of the adjustable disclub head; FIG. 32D1 is the right isometric view of the rotatable head of the adjustable disclub head; FIG. 32D2 is the transparent version of the right isometric view of the rotatable head for the adjustable disclub head; FIG. 32E1 is the right isometric view of the adaptive fork of the adjustable disclub head; FIG. 32E2 is the transparent version of the right isometric view of the adaptive fork of the adjustable disclub head; FIG. 32F is the isometric view of the engaging plug for the adjustable disclub head.

Figures 33A, 33B:
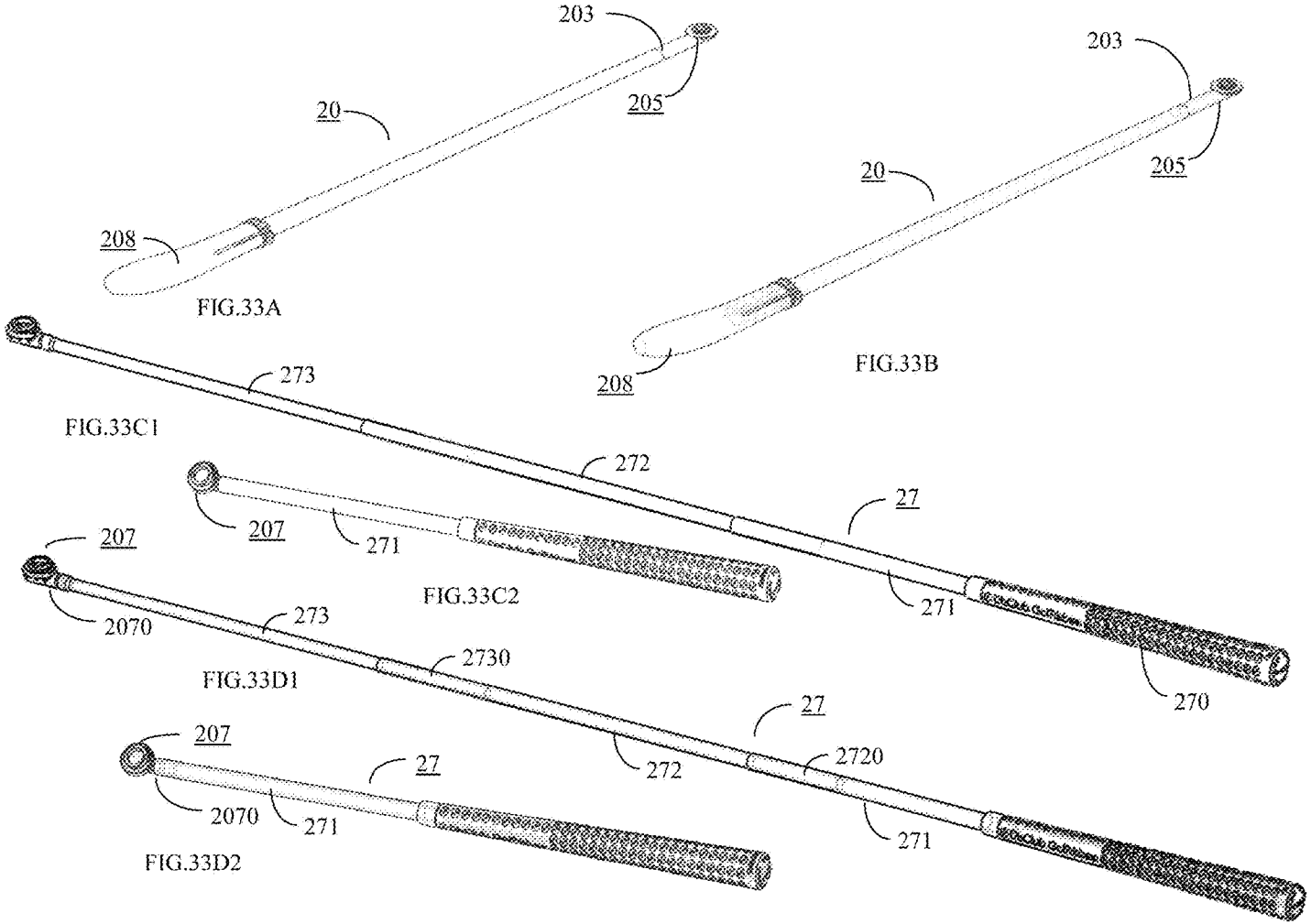

FIG. 33A is the isometric view of the basic disclub; FIG. 33B is the transparent version of the isometric view of the basic disclub; FIG. 33C 1 is the extendable disclub in the extended position; FIG. 33C2 is the extendable disclub in the shortened position; FIG. 33D1 is the transparent view of the extendable disclub in the extended position; FIG. 33D2 is the transparent view of the extendable disclub in the shortened position.

Figure 34B:
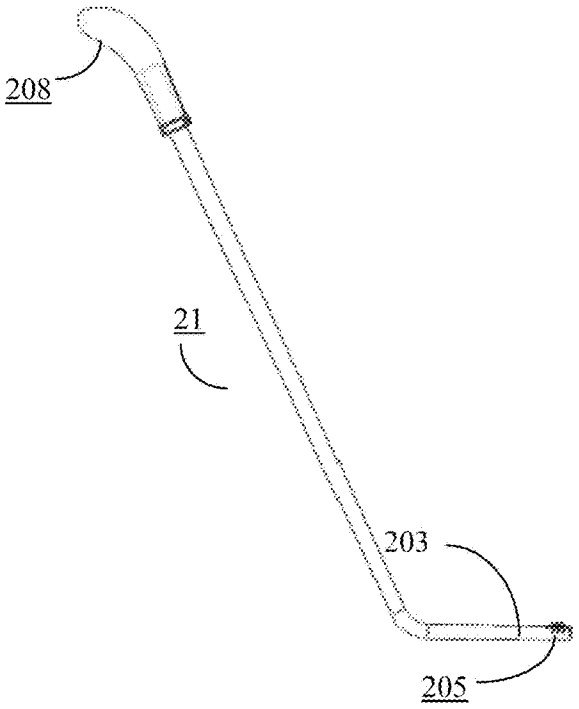
Figure 34A:
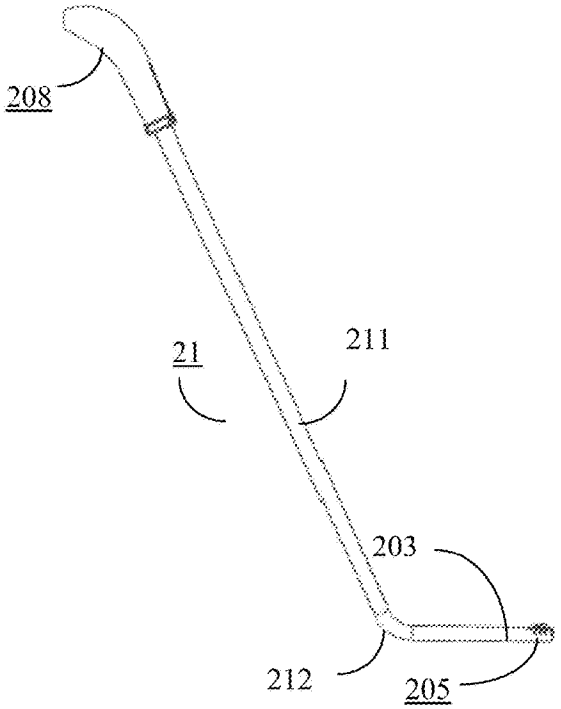

FIG. 34A is the isometric view of the golf-club style disclub; FIG. 34B is the transparent version of the isometric view of the golf-club style disclub.

Figure 35A:
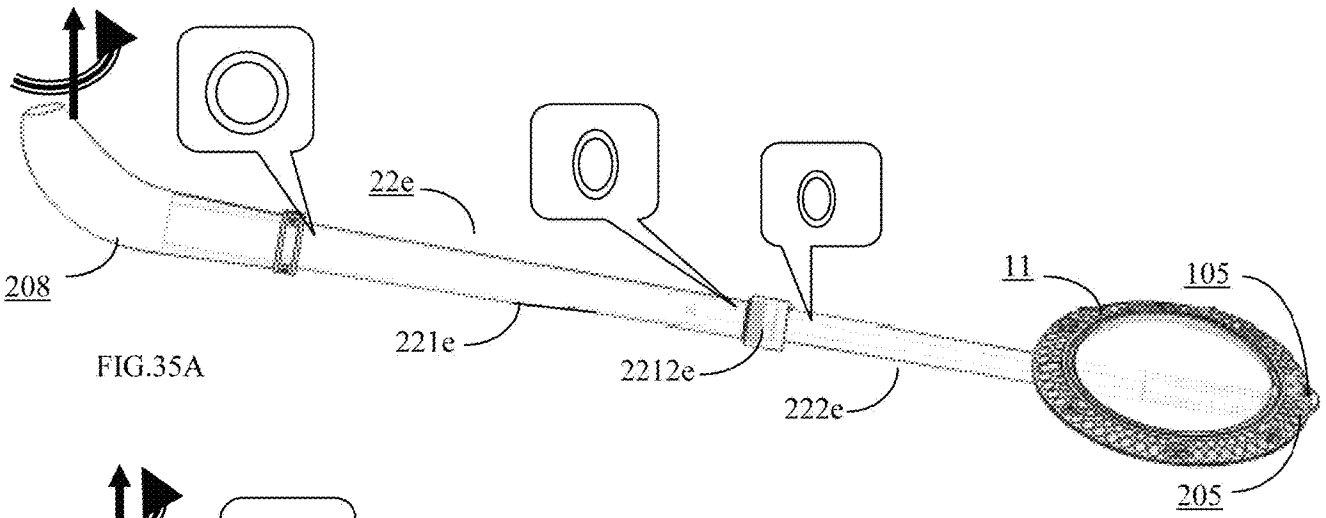
Figure 35B:
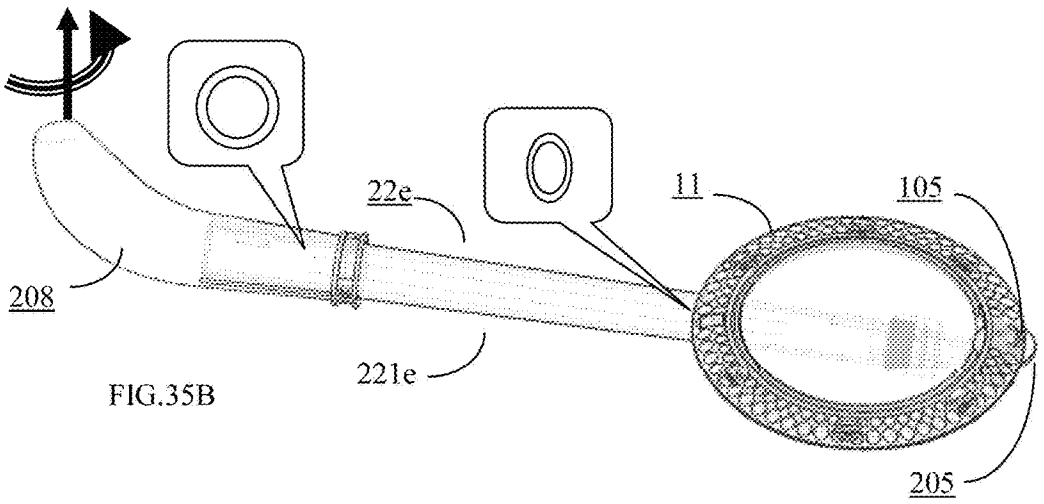

FIG. 35A is the golfdisc mounted on telescopic disclub in the elongation position having the callouts to show section views of disclub; FIG. 35B is the golfdisc mounted on the telescopic disclub in the shortened position having the callouts to show section views of disclub.

FIG. 36A1 is the isometric view of the telescopic disclub in the elongation position having the callouts to show section views of disclub; FIG. 36A2 is the transparent view of the isometric view of the telescopic disclub in the elongation position having the callouts to show section views of disclub; FIG. 36A3 is the isometric view of the torqueless telescopic disclub in the elongation position; —FIG. 36B 1 is the isometric view of the telescopic disclub in the shortened position having the callouts to show section views of disclub; FIG. 36B2 is the transparent view of the isometric view of the telescopic disclub in the shortened position having the callouts to show section views of disclub; FIG. 36B3 is the isometric view of the torqueless telescopic disclub in the shortened position.

Figure 37A:
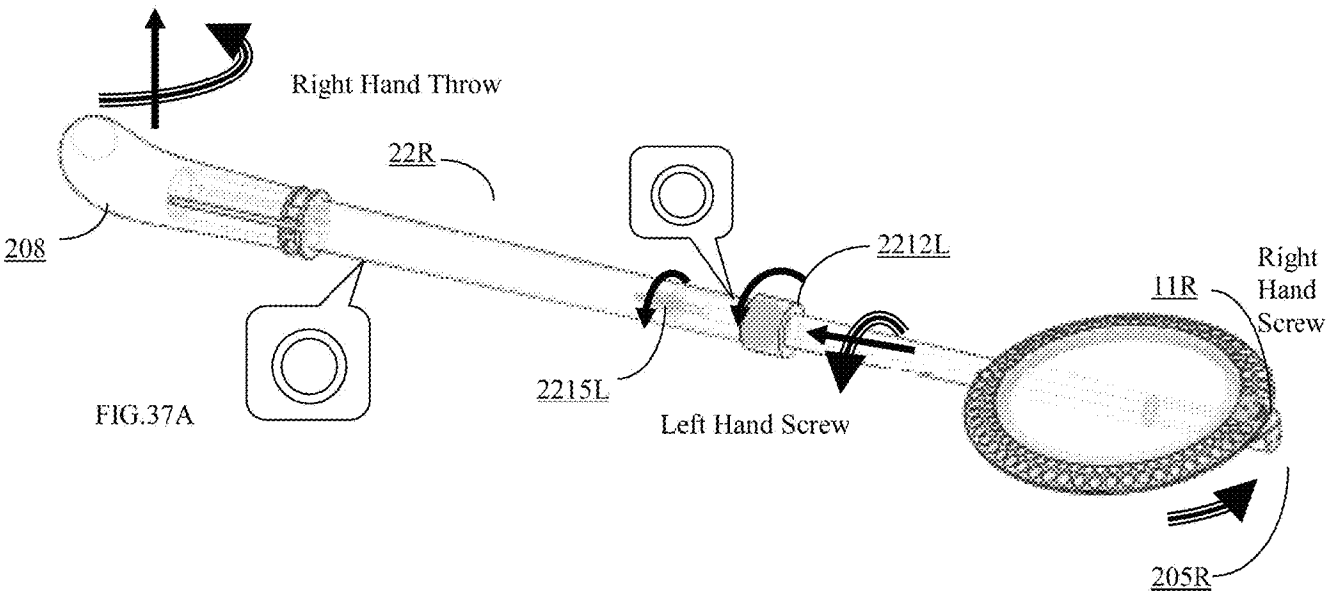
Figure 37B:
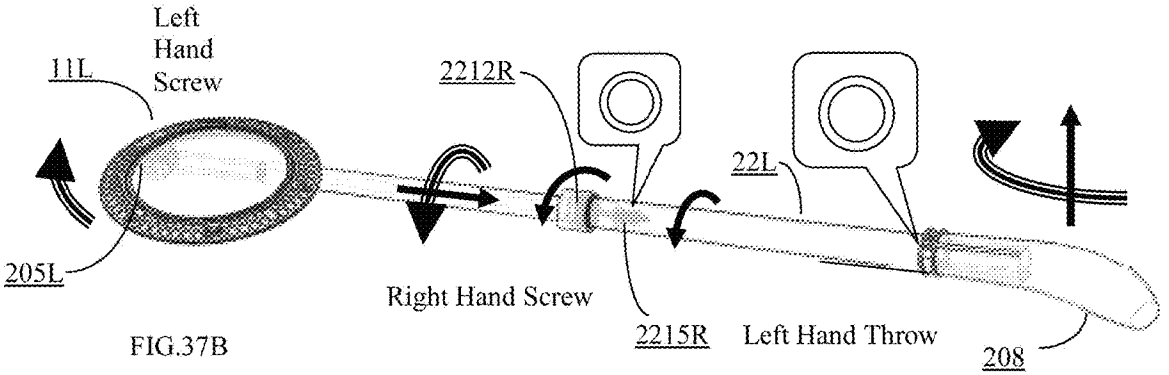

FIG. 37A is the locking screw design for the right hand throw telescopic disclub golf having the callouts to show section views of disclub; FIG. 37B is the locking screw design for the left hand throw telescopic disclub golf having the callouts to show section views of disclub; FIG. 37C is the transparent view of the extendable disclub in the extended position; FIG. 37D is the transparent view of the extendable disclub in the shortened position.

Figure 38I:
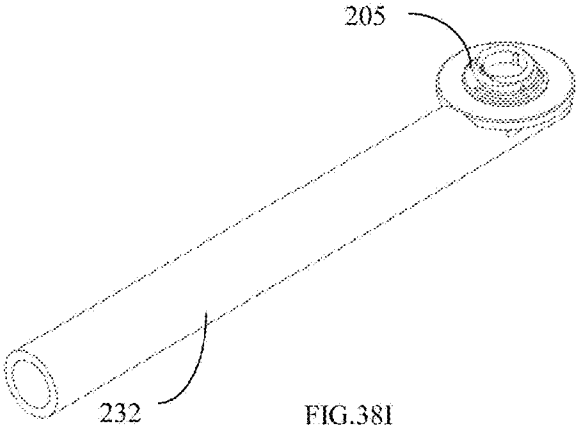
Figure 38K:
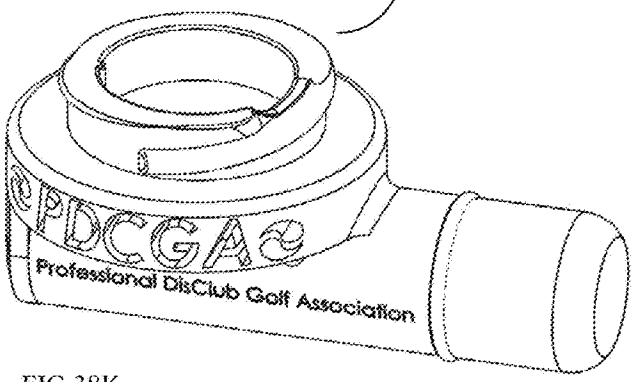
Figure 38H:
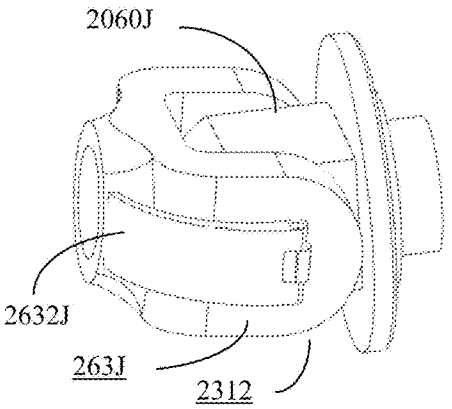
Figure 38J:
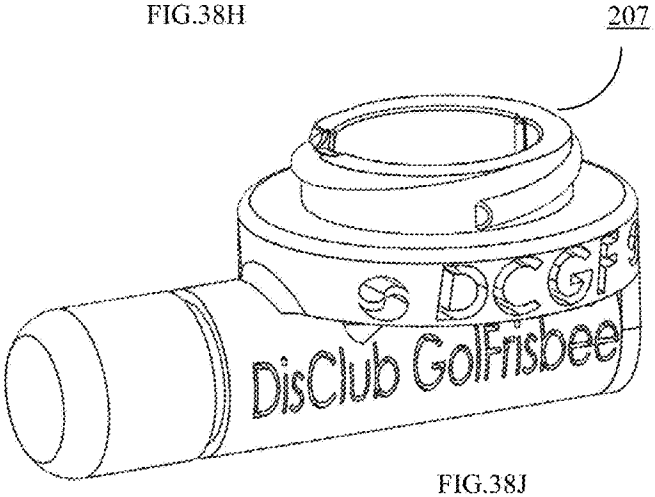
Figure 38N:
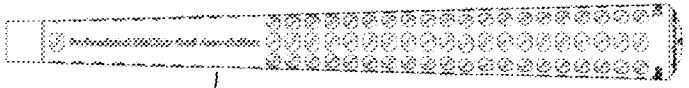
Figure 38M:
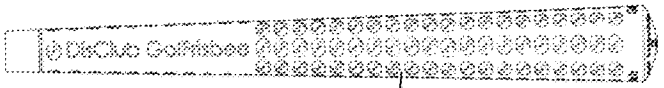
Figure 38L:
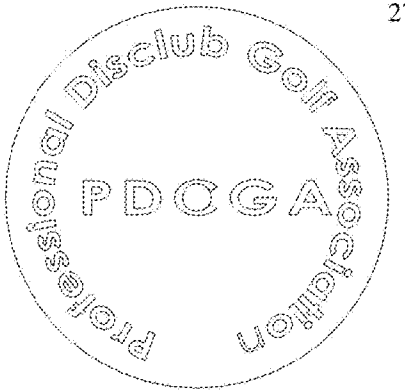
Figure 38P:
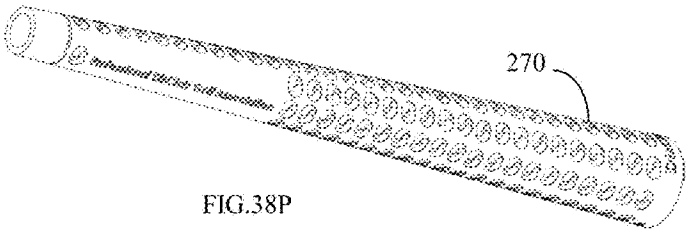
Figure 38O:
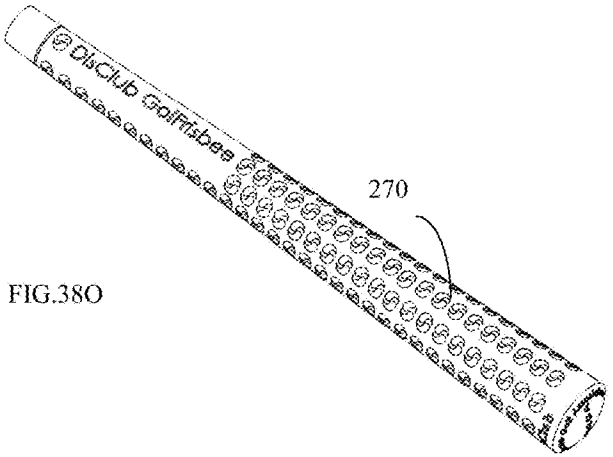
Figures 38Q, 38R, 38S, 38T, 38U, 38V:
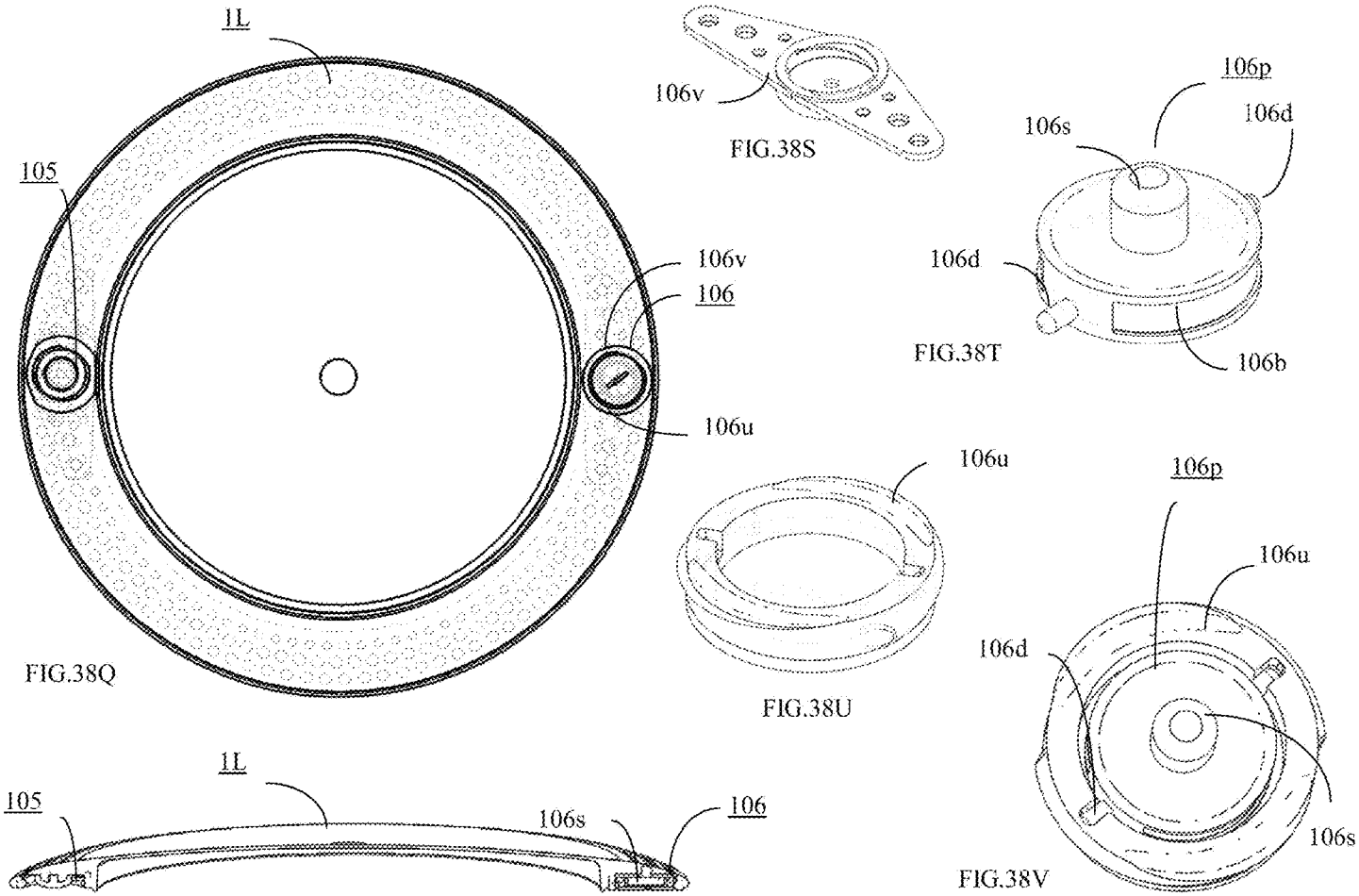
Figure 38W:
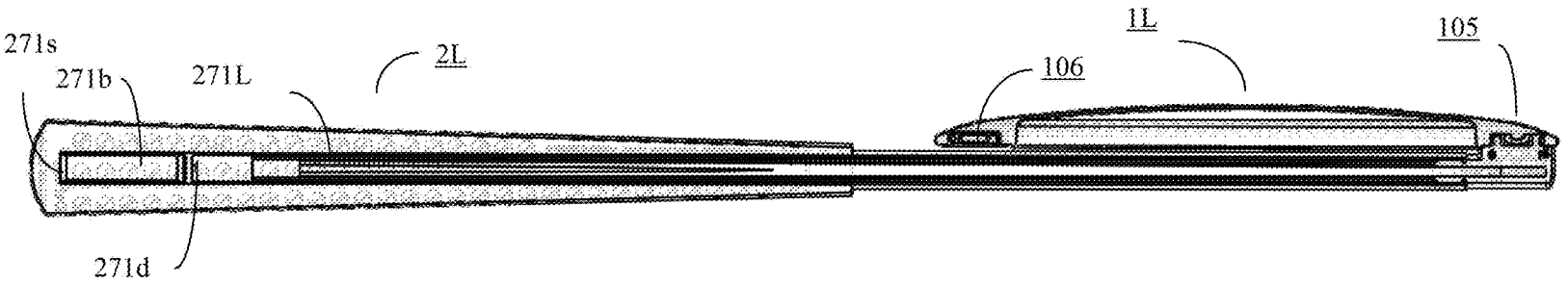
Figure 38Y:
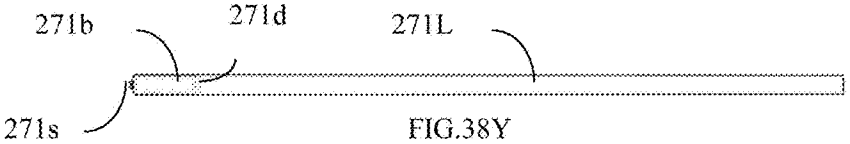
Figure 38Z:
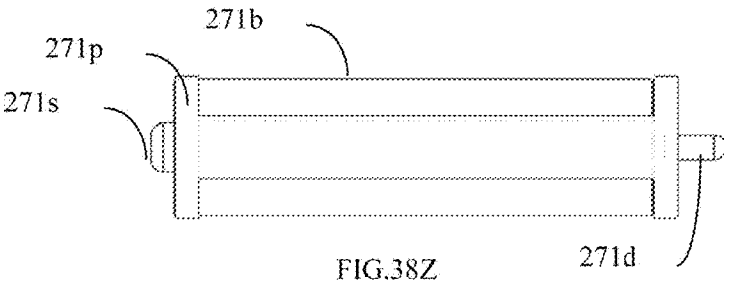
Figure 38X:
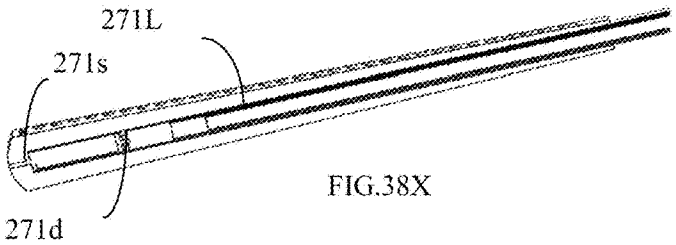

FIG. 38A1 is the right isometric view of the handle of the disclub; FIG. 38A2 is the left isometric view of the handle of the disclub; FIG. 38B1 is the exterior tube of the telescopic disclub having elliptical or non-circular section; FIG. 38B2 is the transparent view of the exterior tube of the telescopic disclub having circular section; FIG. 38B3 is the section view of telescopic disclub joint having elliptical section; FIG. 38B4 is the alternative section view of telescopic disclub joint having elliptical section; FIG. 38C1 is the interior pole of the telescopic disclub; FIG. 38C2 is the interior pole of the telescopic disclub; FIG. 38D1 is the pole of the interior pole of the telescopic disclub; FIG. 38D2 is the transparent view of the pole of the interior pole of the telescopic disclub; FIG. 38E1 is the friction claw mechanism of the interior pole of the telescopic disclub; FIG. 38E2 is the transparent version of the friction claw mechanism of the interior pole of the telescopic disclub; FIG. 38F is the claw of the friction claw mechanism of the interior pole of the telescopic disclub; FIG. 38G is the driving screw of the friction claw mechanism of the interior pole of the telescopic disclub; FIG. 38H is the joint of the adjustable angle golf-club style disclub; FIG. 38I is the short bar having disclub head for the adjustable angle golf-club style disclub; FIG. 38J shows the isotropic view of the disclub head; FIG. 38K shows the isotropic view of the disclub head; FIG. 38L shows the bottom view of the gripper; FIG. 38M shows the side view of the gripper; FIG. 38N shows the side view of the gripper; FIG. 38O shows the isotropic view of the gripper; FIG. 38P shows the isotropic view of the gripper; FIG. 38Q shows the golfrisbee having light; FIG. 38R shows the section view of the golfrisbee having light; FIG. 38S is the adaptor for light packet; FIG. 38T shows the isometric view of the light packet of the golfrisbee; FIG. 38U shows the screwed adaptor for light adaptor, FIG. 38V shows the top view of the light of the golfrisbee; FIG. 38W shows the side view of the lighted Disclub and GolFrisbee; FIG. 38X shows the grip having the lighted first tube; FIG. 38Y shows the lighted first tube; FIG. 38Z shows the light packet in the lighted first tube.

Figure 39B:
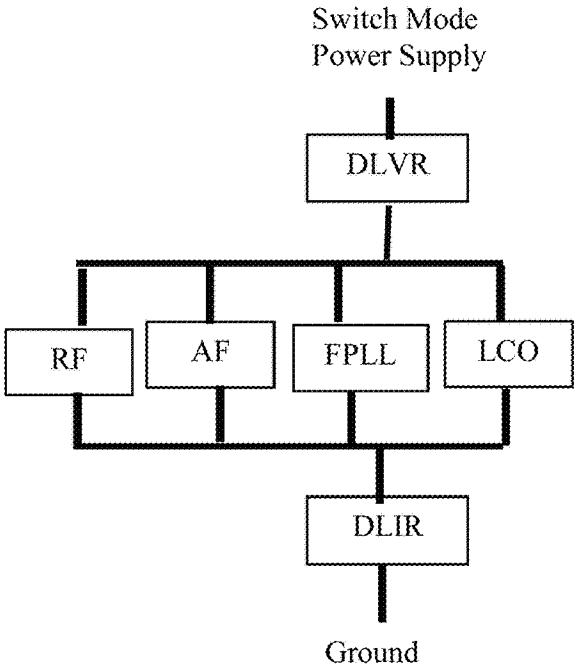
Figure 39A:
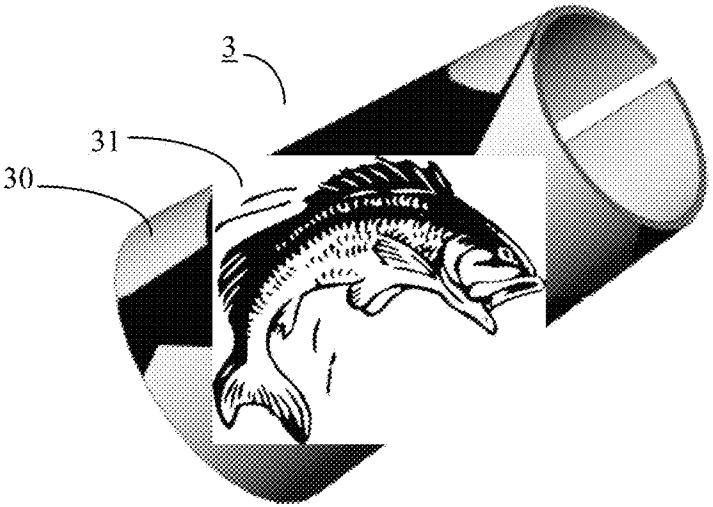

FIG. 39A is the wrist-wearing watch monitor for the remote smart phone and video camera; FIG. 39B is the system and architecture of power, clock and circuit of the wrist wearing watch monitor and the remote smart phone and video camera.

FIG. 40A1 is the system and architecture of the jitterless spurfree fast-lock clock for the wrist wearing watch monitor and the remote smart phone and etc.; FIG. 40A2 is the circuit of the jitterless spurfree fast-lock clock for the wrist wearing watch monitor and the remote smart phone and etc.; FIG.

40B is the system model for the voltage controlled oscillator VCO for the jitterless spurfree fast-lock clock; FIG. 40C is the spectrum analysis of the voltage controlled oscillator VCO for the jitterless spurfree fast-lock clock.

FIG. 41A1 is the timing waveform for the Frequency-Phase Lock Loop FPLL as the frequency of $CLK_{FB}$ is higher than the $CLK_{REF}$; FIG. 41A2 is the timing waveform for the Frequency-Phase Lock Loop FPLL as the frequency of $CLK_{FB}$ is lower than the $CLK_{REF}$; FIG. 41B is the architecture of Frequency-Phase Lock Loop FPLL; FIG. 41C is the frequency waveform of the clock oscillation; FIG. 41D is the system and architecture of the jitterless spurfree fast-lock clock Frequency-Phase Lock Loop FPLL.

FIG. 42A is the planar inductor having the magnetic conductor and magnet sensor; FIG. 42B1 is the structure of TubeFET; FIG. 42B2 is the structure of the inductor having the magnet sensor.

Figure 43B:
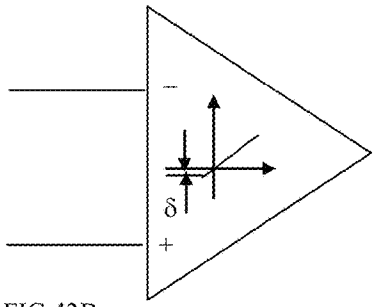
Figure 43A:
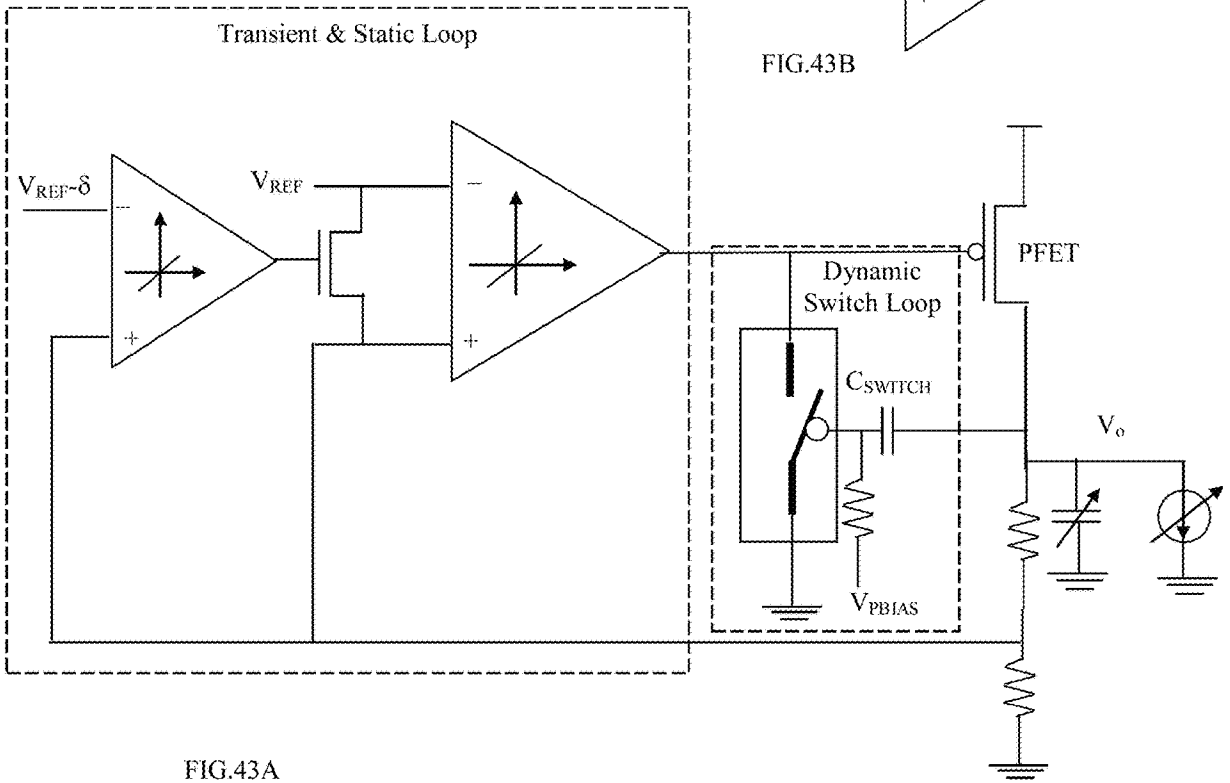
Figure 43C:
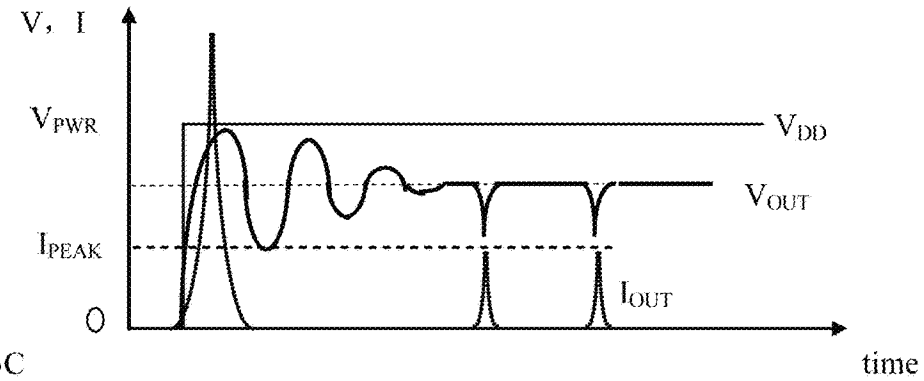
Figure 43D:
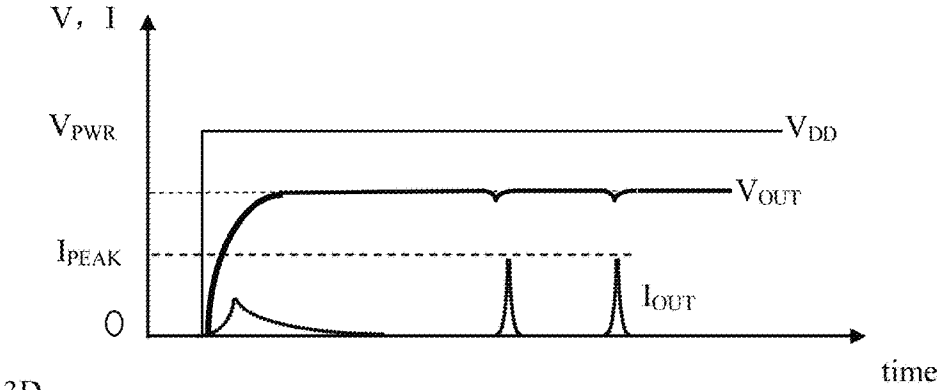

FIG. 43A is the architecture of the rippless and capless smart LDVR Low Drop Voltage Regulator; FIG. 43B is the symbol of the nonlinear single side amplifier; FIG. 43C is the input and output voltage waveform of the conventional LDVR Low Drop Voltage Regulator; FIG. 43D is the input and output voltage waveform of the rippless and capless smart LDVR Low Drop Voltage Regulator.

Figure 44E:
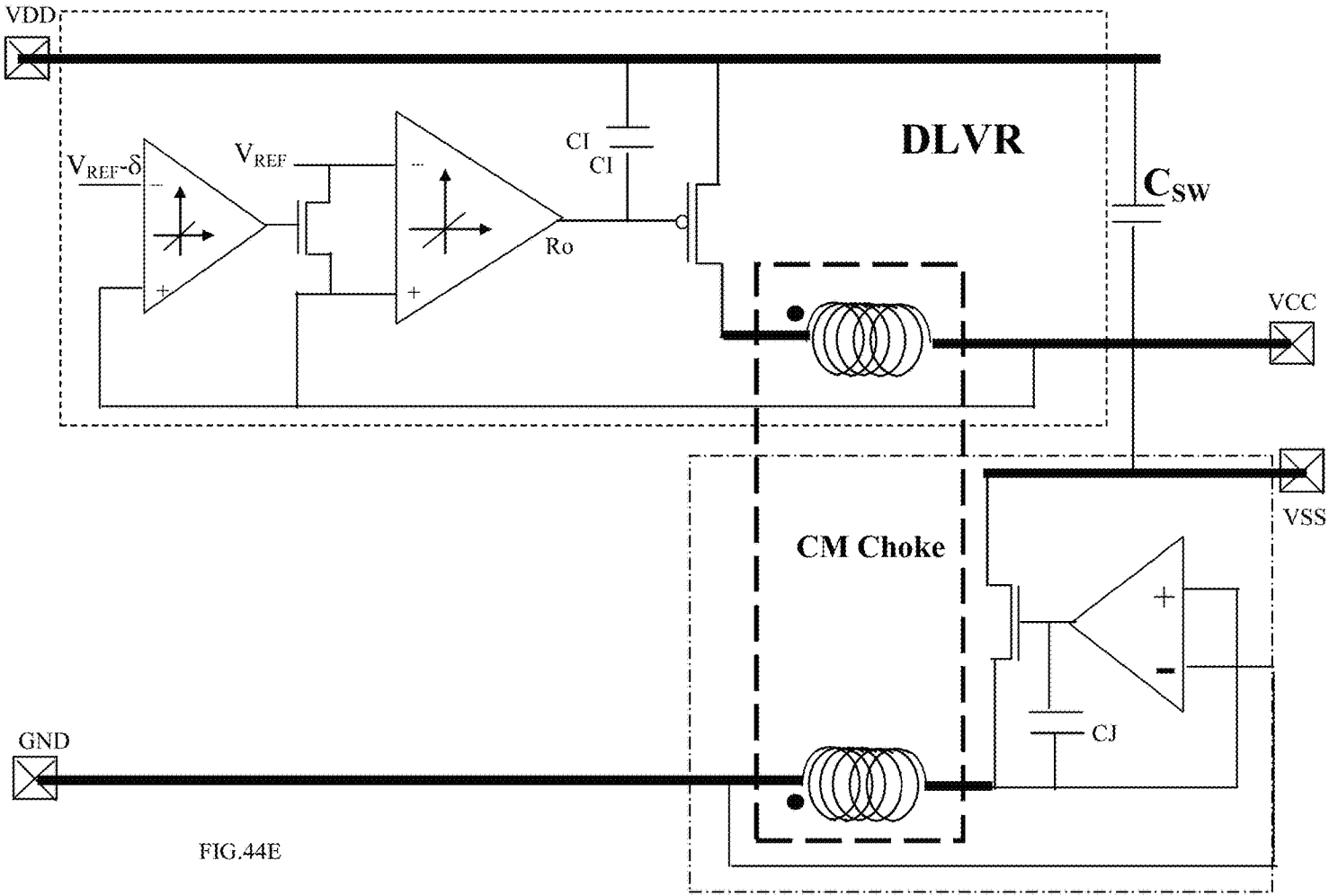
Figure 44G:
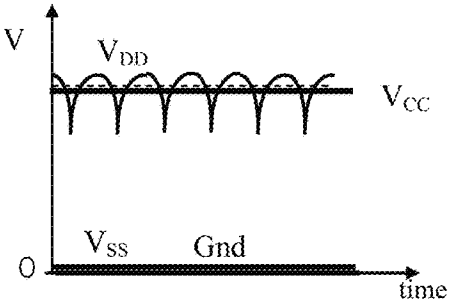
Figure 44F:
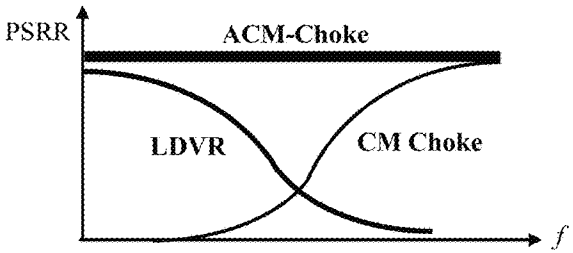
Figure 44I:
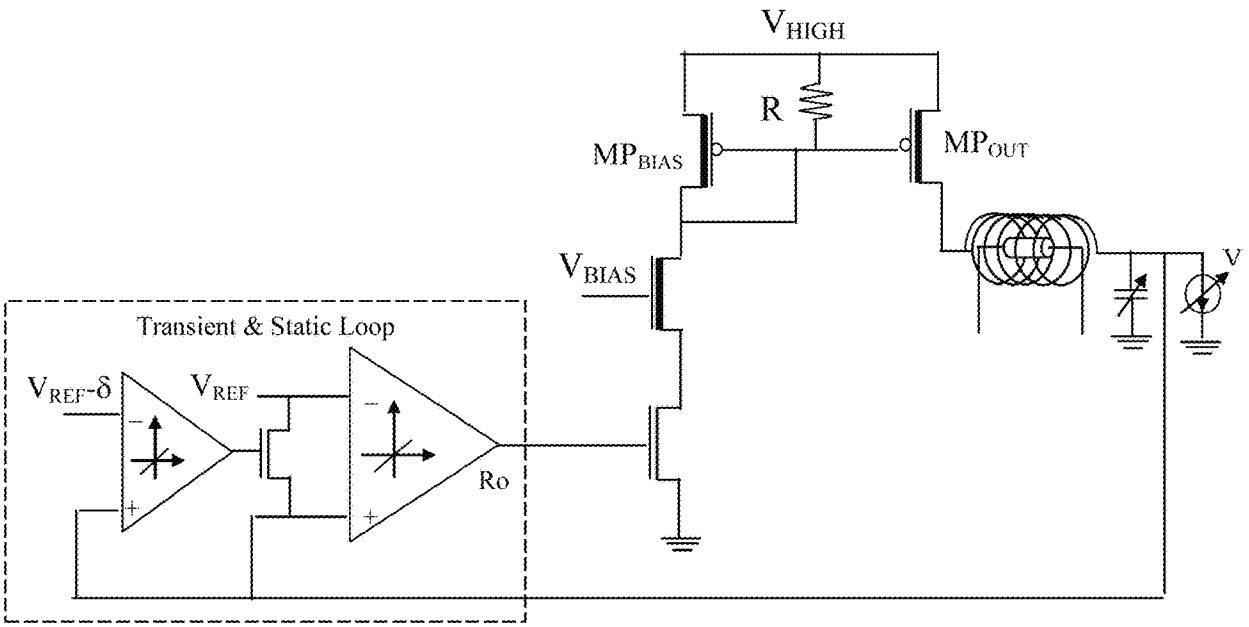

FIG. 44A 1 is the general architecture and system of noiseless green power P&G architecture; FIG. 44A2 is the chip level architecture and system of noiseless green power P&G architecture; FIG. 44B1 is the characteristic curves of DropLess Voltage Regulator DLVR and DropLess Current Regulator DLIR; FIG. 44B2 is the Real DC/DC conversion of the DropLess Voltage Regulator DLVR and DropLess Current Regulator DLIR; FIG. 44C1 is the schematics of the DLVR DropLess Voltage Regulator for the saw-tooth voltage input of the switch mode power supply; FIG. 44C2 is the waveform of the input of the saw-tooth voltage which is the output of the switch mode power supply and the voltage of the output power of the DLVR DropLess Voltage Regulator; FIG. 44D1 is the schematics of the DLIR Low Drop Current Regulator; FIG. 44D2 is the alternative schematics of the DLIR DropLess Current Regulator; FIG. 44E the board level architecture and system of noiseless green power P&G architecture of the active CM choke implemented with the DropLess Voltage Regulator DLVR and DropLess Current Regulator DLIR; FIG. 44F the Power Supply Rejection Ratio PSRR of the Common Mode Choke CM Choke, LDVR and the Active Common Mode Choke ACM Choke; FIG. 44G is the power and ground waveforms of the architecture of noiseless Green Power P&G architecture; FIG. 44H1 is the power and ground waveform of the conventional digital circuit; FIG. 44H2 is the power and ground waveform of the Green Power P&G architecture and system; FIG. 44I is the schematics of the DLVR DropLess Voltage Regulator for the high voltage input of the switch mode and/or high voltage dynamic varying power supply.

Figure 45A:
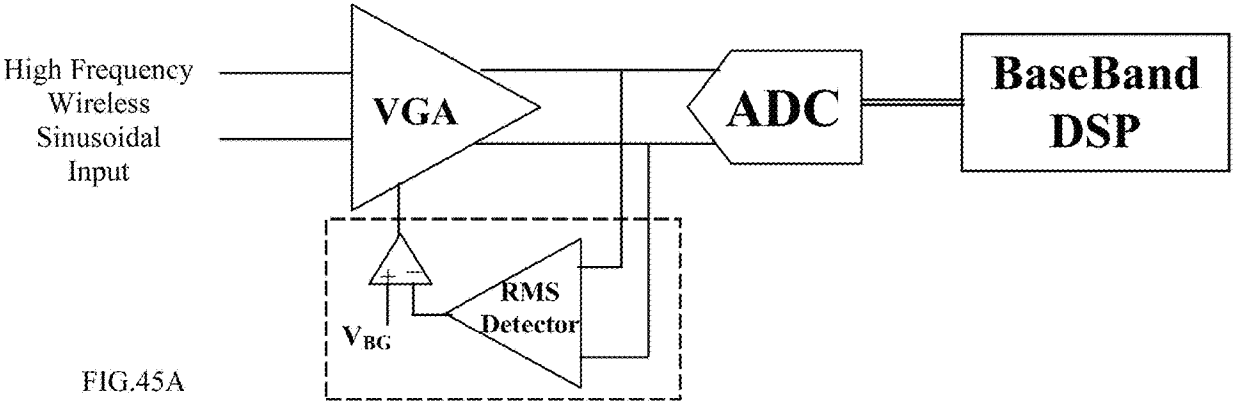
Figure 45B:
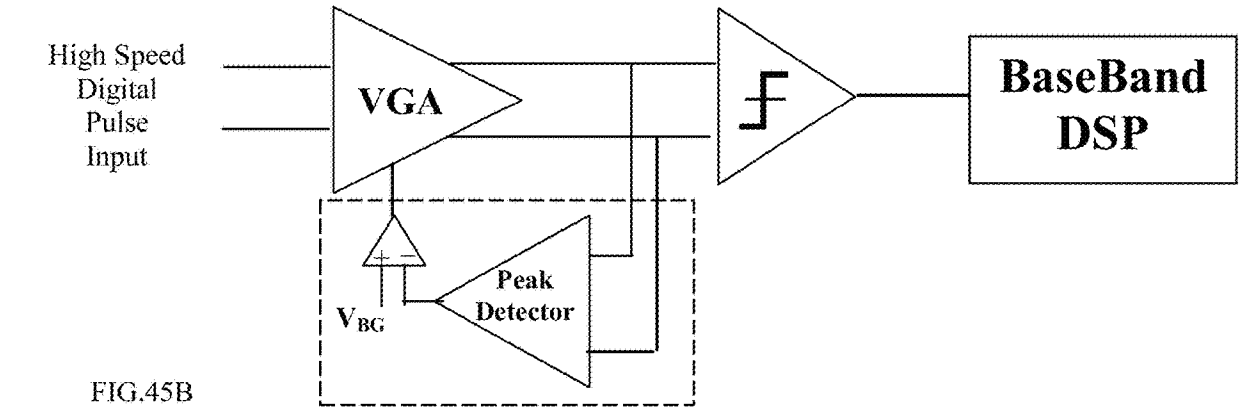

FIG. 45A is the architecture and system of the analog front for the High Frequency Wireless Sinusoidal Input; FIG. 45B is the architecture and system of the analog front for the High Speed Digital Pulse Input.

Figure 46C:
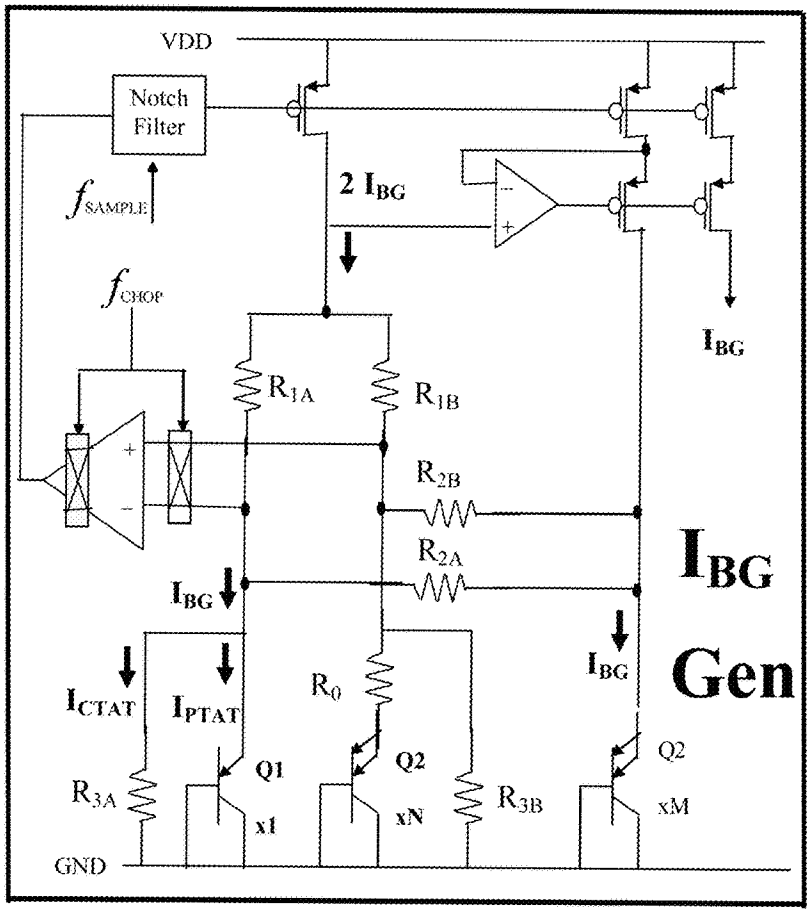
Figure 46A:
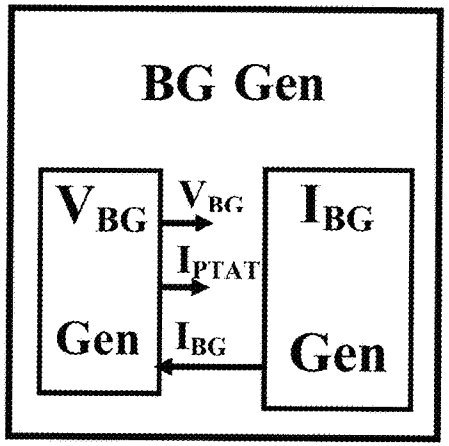
Figures 46B, 46D:
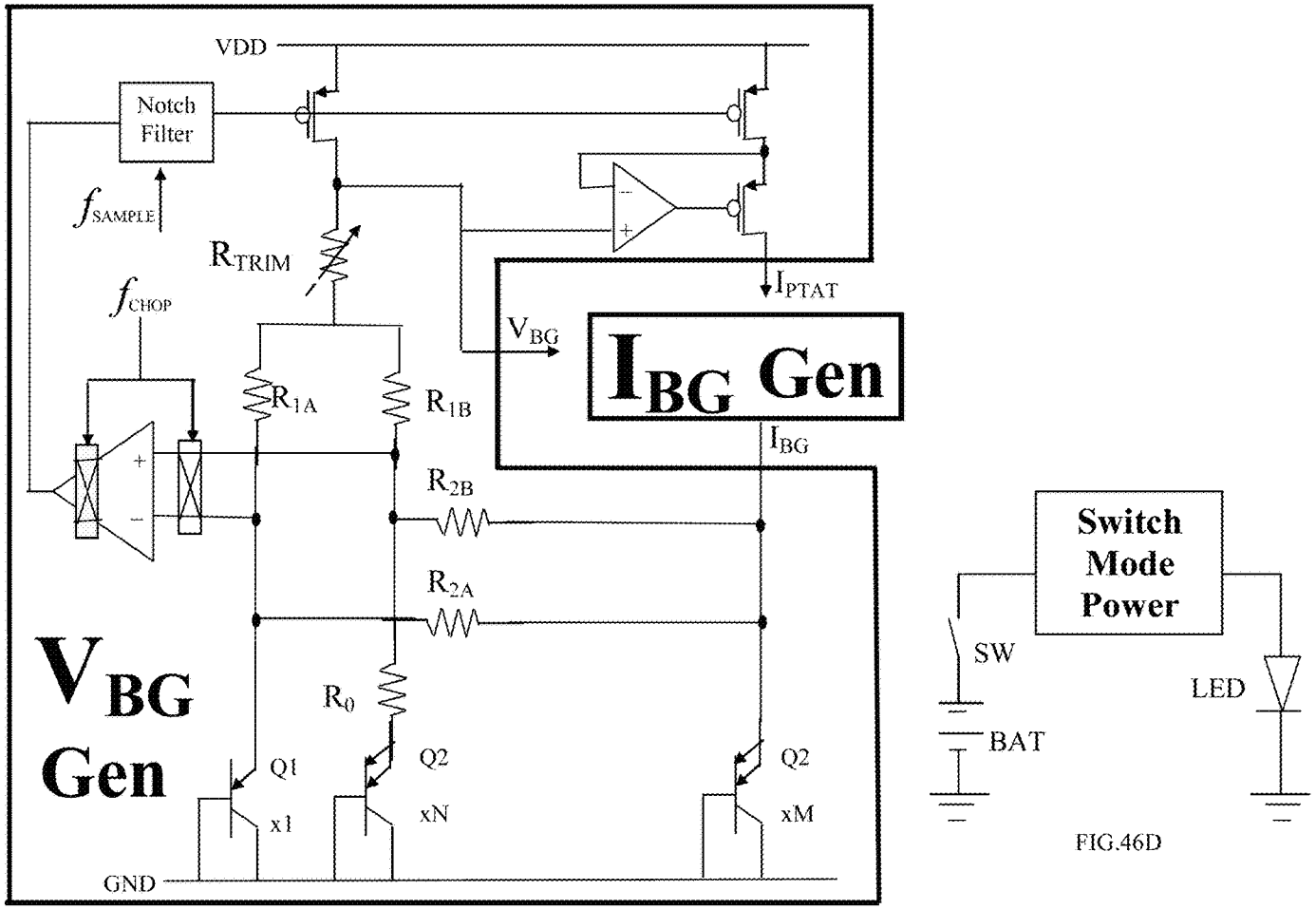

FIG. 46A is the architecture and system of the conjugate Bandgap Generator made of Bandgap Voltage Generator and Bandgap Current Generator; FIG. 46B is the schematics and circuit of the conjugate Bandgap Generator made of Bandgap Voltage Generator and Bandgap Current Generator, FIG. 46C is the schematics and circuit of the Bandgap Current Generator; FIG. 46D shows the switching mode power for the lighted DisClub Golf.

Figure 47:
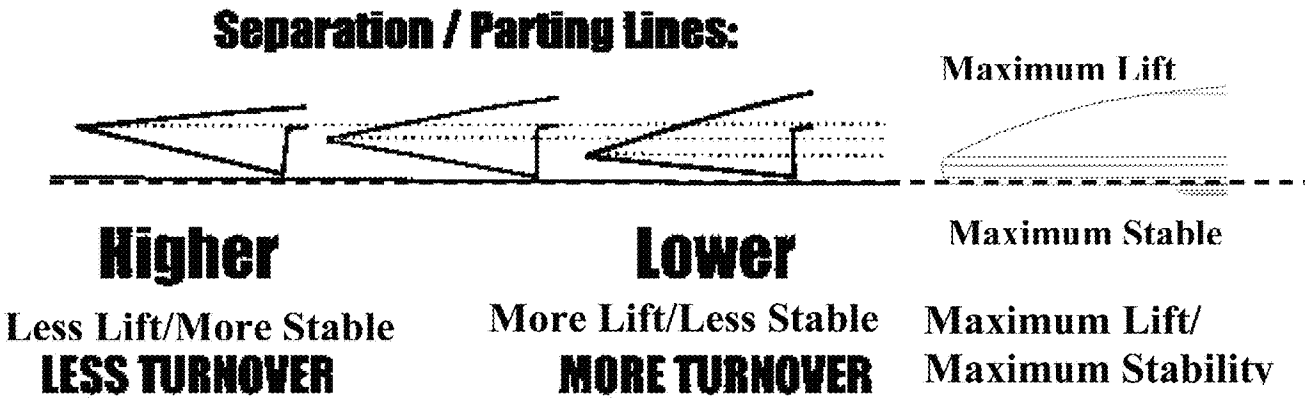

FIG. 47 is the separation/parting line analysis for the conventional disc and golfdisc.

Figure 48:
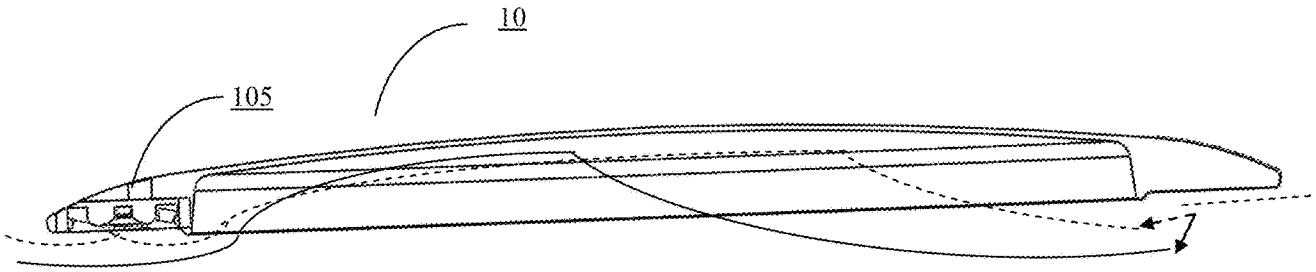

FIG. 48 is the aerodynamics analysis of the super-lift golfdisc and conventional disc.

DESCRIPTION AND OPERATION

Figure 1D:
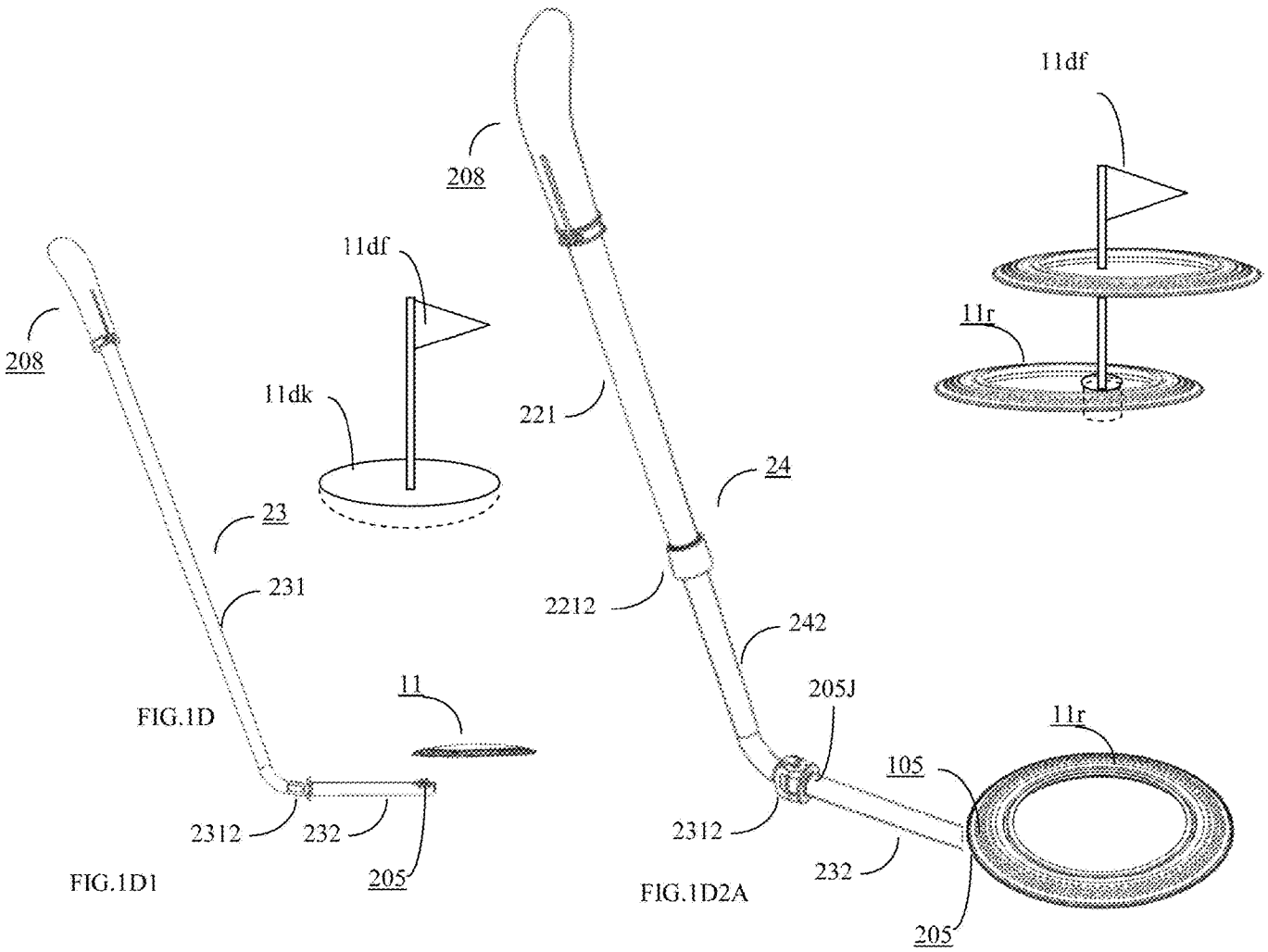

The disclub golf has versatile disclubs to play the disclub golf in different ways. To make the golf course compatible, as shown in FIG. 1D1, the disc can throw into a cave as the discolf does. However, as shown in FIG. 1D2A, the best golf course compatible solution is to toss the golfring as the quoits does. The disclub golf uses the golfdisc to throw to avoid the tree blockage. At the last stage, the golfdisc is changed to be the golfring to toss the golfring at the flagpole as the quoits does. As shown in FIG. 1A1, FIG. 1A2, FIG. 1A3 and FIG. 1A4, they show the continuous operational pictures of the basic disclub golf.

As shown in FIG. 1A2, FIG. 1A4, FIG. 4F and FIG. 20A, the disclub golf comprises a gliding golfdisc 1 and disclub 2. The gliding golfdisc 1 comprises a closed rim airfoil 10.

As shown in FIGS. 1A2 & FIG. 33A, the disclub 2 has a straight pole 20. The disclub head 205 being mounted on the end of said straight pole 20.

Figure 20A:
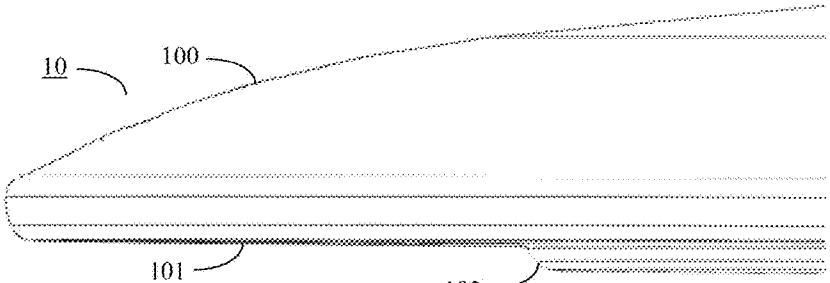
Figure 20B:
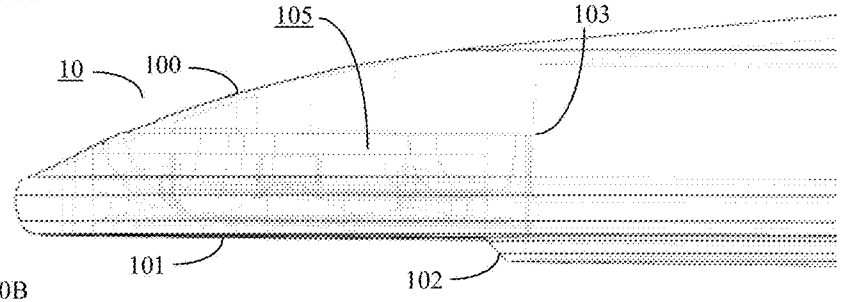
Figure 20C:
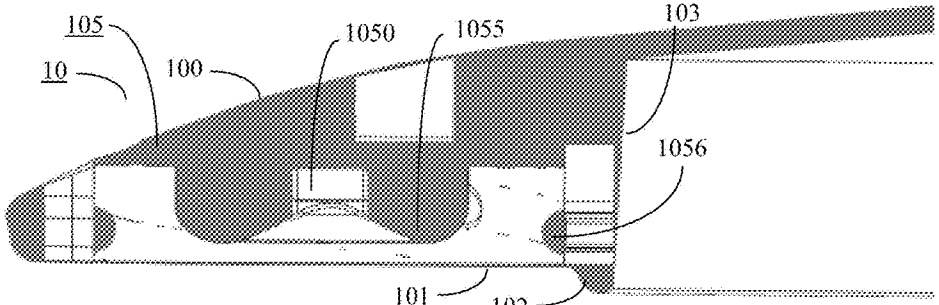

As shown in FIG. 20A, FIG. 20B and FIG. 20C, the rim airfoil 10 has a substantially right angle triangular cross-section. An outer rounded corner and curved hypotenuse are the upper airfoil edge of the closed rim airfoil 10. The closed rim airfoil 10 further comprises discap 105. The disclub 2 further comprises disclub head 205. The discap 105 rotationally screws on and engages with the disclub head 205. Swiveling the disclub 2, due to the eccentric force, the discap 105 and the gliding golfdisc 1 rotates and launches to fly in the sky.

The disclub golfer holds the adjustable handle 208 to swivel the disclub 20. In the FIG. 1A1, the disclub 20 is raised up to be ready to swivel. As shown in FIG. 1A2, the basic disclub 20 is swiveled to the horizontal position. As shown in FIG. 1A3, FIG. 28A1, FIG. 28A2, FIG. 29A and FIG. 29B, applying the snapping action, the cam locking clip mechanism in the discap 105 and disclub head 205 is suddenly released and the disclub golfdisc 1 rotates very fast 180 degrees. As shown in FIG. 1A4, the disclub golfdisc 1 takes off from the disclub head 205 flying in the sky. As shown in FIG. 14A1, FIG. 23B, FIG. 30A and FIG. 30B, the disclub golfdisc 1 carries the smart phone and video camera. The video signal transmits back to the wristwatch monitor 3.

As shown in FIG. 1B2, FIG. 34A and FIG. 38I, the golf-style disclub 21 has one end of pole 211 connecting to short bar 213 with one bent joint 212. The disclub head 205 is mounted on the end of short bar 213.

As shown in FIG. 1B1, FIG. 1B2, FIG. 1B3 and FIG. 1B4, they show the continuous operational pictures of the golf-style disclub golf. The golfdisc 10 is mounted on the bent short bar 213 of the golf-style disclub 21. In the FIG. 1B1, the golf-style disclub 21 is raised up being ready to swivel. As shown in FIG. 1B2, the golf-style disclub 21 is swiveled to the horizontal position. As shown in FIG. 1B3, applying the snapping action, the cam locking clip mechanism in the discap 105 and disclub head 205 is suddenly released and the golfdisc 1 rotates very fast 180 degrees. As shown in FIG. 1B4, the golfdisc 1 takes off from the disclub head 205 flying in the sky.

As shown in FIG. 1C1, FIG. 1C2, FIG. 1C3, FIG. 1C4, FIG. 1C5, FIG. 1C6, FIG. 1C7, FIG. 1C8, FIG. 26D1, FIG. 26D2, FIG. 33C1, FIG. 33C2, FIG. 33D1, FIG. 33D2, FIG. 35A, FIG. 35B, FIG. 36A1, FIG. 36B1, FIG. 36A2, FIG.

36B2, FIG. 36A3, FIG. 36B3, FIG. 37C and FIG. 37D, the disclub is extendable disclub. The extendable disclub comprises a pole sliding in a tube. The disclub head is mounted on the end of the pole. As shown in FIG. 35A, FIG. 35B, FIG. 36A1, FIG. 36B1, FIG. 36A2 and FIG. 36B2, there are callouts to show the cross section of the extendable disclub. In the middle of the extendable disclub, there are elliptical or non-circular sections that the extendable disclub can resist the twist torque of the extendable disclub.

Figures 11A, 11B, 11C:
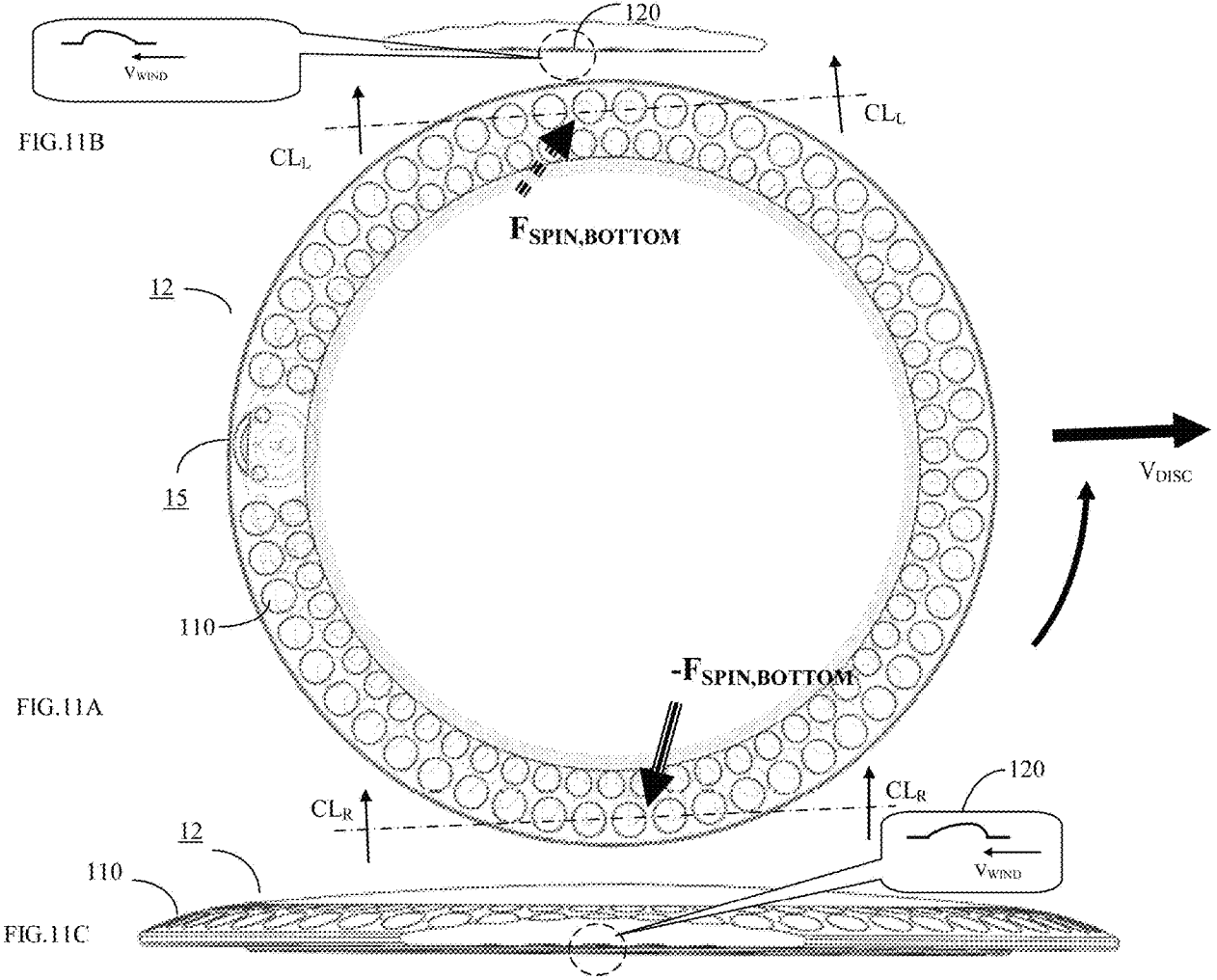

As shown in FIG. 1C1, the Tarng golfdisc 11 is mounted on the telescopic disclub 22 in the elongated position. As shown in FIG. 1C2, the telescopic disclub 22 in the shortened position. The pole 222 slides in the tube 221. The pole 222 is locked with the tube 221 with the locking screw 2212. The handle 208 is locked to the tube 221. The Tarng golfdisc 1 is mounted on the disclub head 205 with the discap 105. As shown in FIG. 1C3 and FIG. 1C4, the extendable disclub 27 has the grip 270 mounted on the first tube 271. The second tube 272 slides inside the first tube 271. The third tube 273 slides inside the second tube 272. The disclub head 207 mounts at the end of the third tube 273, FIG. 1C3 is the disclub 27 in the extended position. FIG. 11C4 is the disclub 27 in the shortened position.

As shown in FIG. 1D1, the golf-style disclub 23 has the angle-adjusted joint 2312 to adjust the launch angle of Tarng disc 11. The pole 231 has the bent end. The adjusted joint 2312 is mounted on the bent end of pole 231. The disclub head 205 is mounted on the end bar 232. In this drawing, the golfrisbee 11 is thrown with disclub into the target hole 11*dk* of the discolf having the flag 11*df*.

As shown in FIG. 1D2A, the golf-style telescope angle-adjusted disclub 24 comprises the bent pole 242 sliding in the tube 221. The bent pole 242 is locked to the tube 221 with the locking screw 2212. The disclub head 205 is mounted on the short bar 232. The Tarng golfdisc 11 is mounted on the disclub head 205 with discap 105. As shown in FIG. 1D2B, the bent pole 242 is retracted to be carried easily. The adjusted joint 2312 rotates to turn the short bar 232 to fold the golf-style telescope angle-adjusted disclub 24.

Figure 30B:
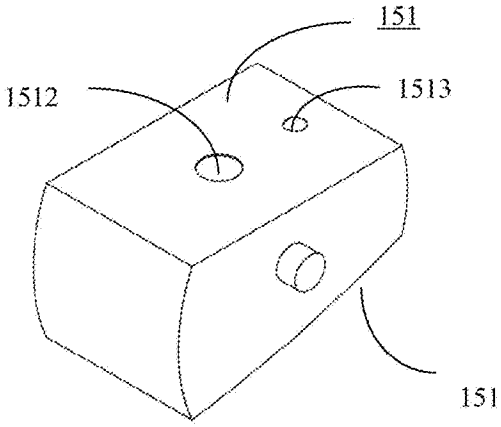
FIG. 30B is the isometric bottom view of the smart phone and video camera.
Figure 30A:
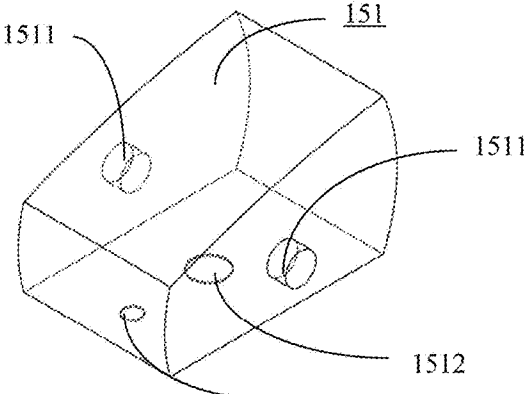
FIG. 30A is the isometric top view of the smart phone and video camera.

As shown in FIG. 1E1 and FIG. 30A, the telescopic disclub 26 and golfdisc 12 can serve as the self-portrait. The smart phone or camera 151 is mounted on the Tarng golfdisc 12. The angle-adjusted joint 263 is mounted at the telescopic disclub 26. The Tarng golfdisc 12 is flipped at the self-portrait position to take the photo and video, etc with the smart phone and video camera 151. As shown in FIG. 1E2, the Tarng golfdisc 12 is flipped back to the normal disclub swiveling operation position. As shown in FIG. 19A1, the Tarng golfdisc 12 can be the head-wearing golfdisc 18 to wear on the head. The telescopic disclub 26 serves as the Alpenstock as shown in FIG. 1E2.

As shown in FIG. 2A, it is the golf ball-throwing trajectory. The golf ball-launching angle is 45° to have the maximum flying distance. As shown in FIG. 2B2, the golf ball 9 rotates. As shown in FIG. 2B and FIG. 2B2, the top airflow is speeded up and the pressure is reduced. As shown in FIG. 2B1 and FIG. 2B2, the speed of the bottom airflow is reduced and the pressure is increased. The golf ball floats up due to the pressure difference between the top air and the bottom air. This is referred to be Magnus force.

As shown in FIG. 3A, as the disc 10 flies, the speed reduced and the angle of attack is increased. As shown in FIG. 3B1, the disc 10 flies and rotates. Due to the conservation of the rotational momentum of gyroscopic force, the disc 10 keeps the same orientation. As the disc 10 falls down, the angle of attack becomes much larger. The disc 10 is more like the parachute dropping to the ground. The potential energy of disc 10 does not convert to the dynamic flying energy of the glider. The flying distance of the falling trajectory of the disc 10 is much less than the flying distance of the rising trajectory of the disc 10. As shown in FIG. 3B2, with the Tarng golfdisc 11, the rising trajectory and falling trajectory are symmetrical. Therefore, the gliding Tarng golfdisc 11 is more like the glider to be named as the gliding disc. The flying distance of gliding Tarng golfdisc 11 is larger than the disc 10.

As shown in FIG. 4A1, it is the isometric top view of the frictionless super-lift golfdisc 10. As shown in FIG. 4A2, it is the transparent isometric top view of the frictionless super-lift solar cell golfdisc 1*s*. As shown in FIG. 4B1, it is the bottom view of the frictionless super-lift golfdisc 10. As shown in FIG. 4B2, it is the transparent isometric bottom view of the frictionless super-lift solar cell golfdisc 1*s*. As shown in FIG. 4C1, it is the isometric bottom view of the frictionless super-lift golfdisc 10. As shown in FIG. 4C2, it is the transparent isometric bottom view of the frictionless super-lift solar cell golfdisc 1*s*. The discap 105 is embedded in the frictionless super-lift golfdisc 10.

Figure 4D:
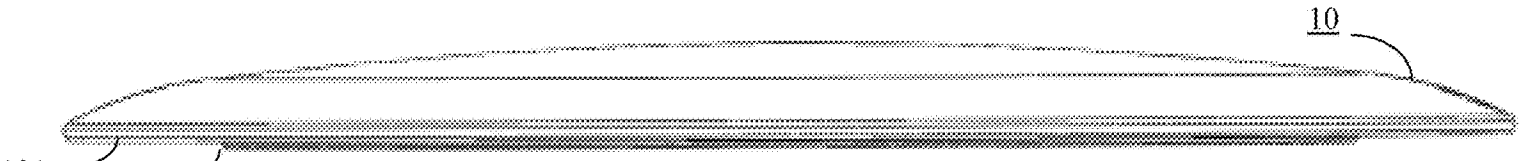
Figure 4E:
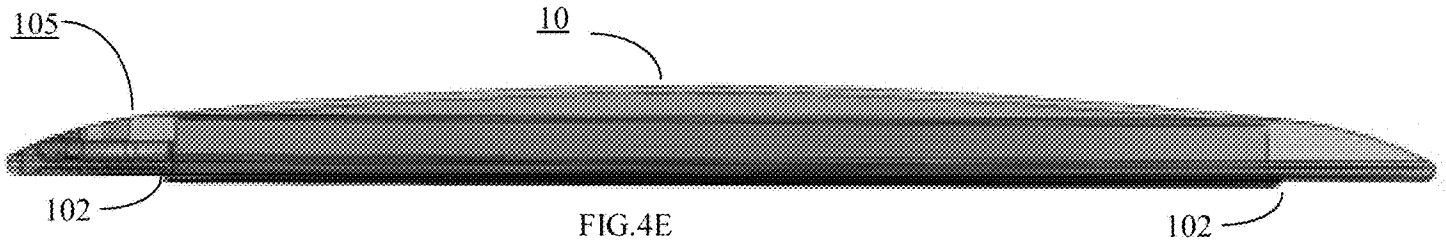
Figure 4F:
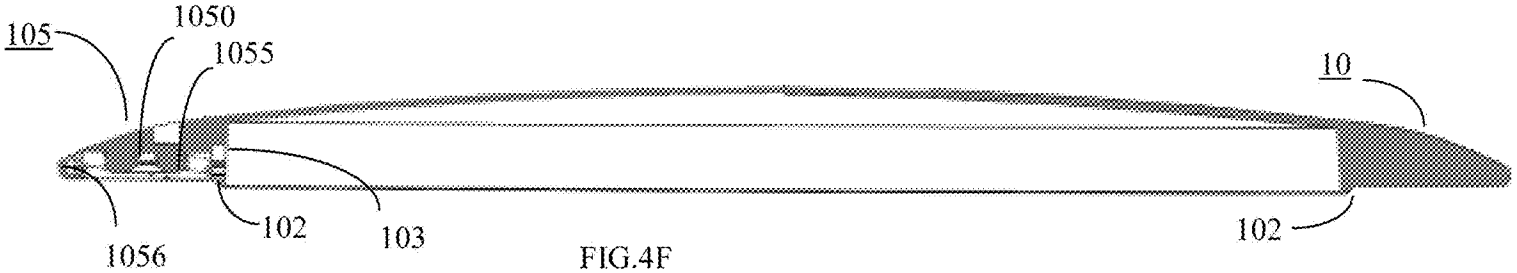

As shown in FIG. 4D, FIG. 4E and FIG. 4F, it shows the side view of the frictionless super-lift golfdisc 10. As shown in FIG. 20A, the bottom edge 101 of the frictionless super-lift golfdisc 10 is flat. The triangle flap 102 is at the tail end of said bottom edge 101. The stability edge 103 is to maintain the side stability of the frictionless super-lift golfdisc 10. However, the stability edge 103 will cause the stagnation point generating the drag force at the trailing edge of the frictionless super-lift golfdisc.

FIG. 4E is the transparent side view of the frictionless super-lift golfdisc 10. It shows the discap 105 embedded in the triangle rim of the frictionless super-lift golfdisc 10. FIG. 4F is the section view to show the structure of the discap 105 and the dome structure of the frictionless super-lift golfdisc 10.

Figure 26A:
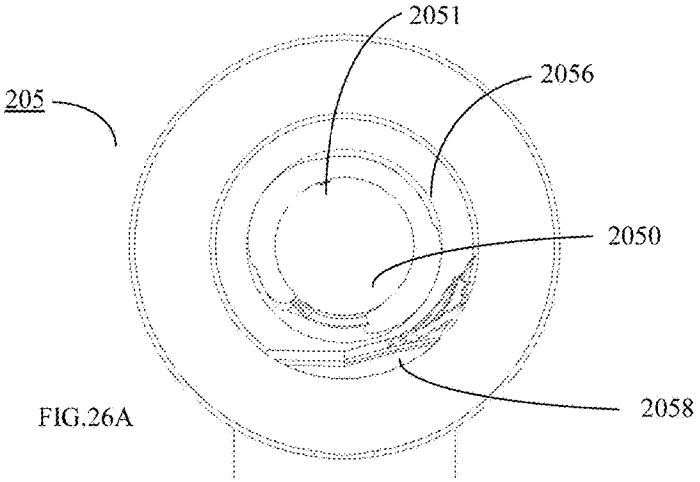
Figure 26B:
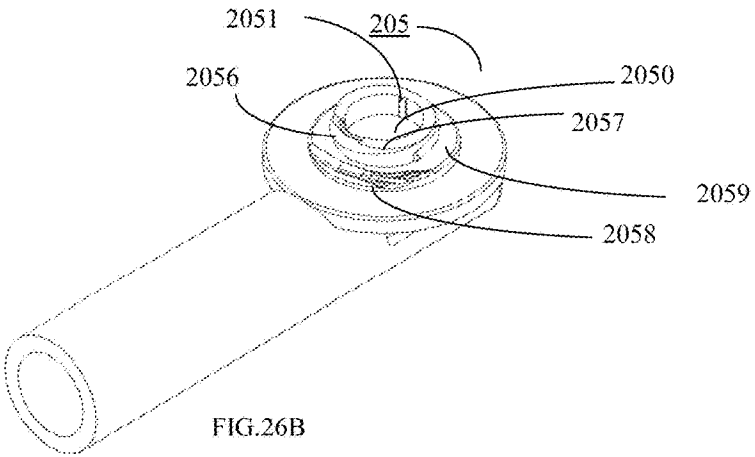

As shown in FIG. 4E, FIG. 4F, FIG. 6C2 and FIG. 6C3, the plateau 1055 inside the discap 105 is to reduce the air flowing into the discap to minimize the air drag force. The hole 1050 embedded inside the plateau 1055 is for the plastic module injection of the golfdisc 10. The screw 1056 embedded inside the discap 105 is to rotationally mount the discap 105 on the screw 2056 of the disclub head 205 as shown in FIG. 26A and FIG. 26B.

As shown in FIG. 5A1, the disc 10 flies with velocity $V_{DISC}$ and rotates counter-clockwise with $V_{SPIN}$. The weight of disc 10 is simplified to be the gravity force $F_G$ at the Center Of Gravity CG. All the air pressure force is simplified to be the $F_{LIFT}$ applied at the Center Of Pressure CP. As the Center Of Pressure CP is located after the Center Of Gravity CG, the lift force $F_{LIFT}$ generates positive pitch moment $MP_{LIFT}$. To make the analysis simple with the intuition, due to the gyroscopic force, the lift force $F_{LIFT}$ and spin $V_{SPIN}$ generate the equivalent pseudo force $PR_{LIFT}$ to generate the left banking moment $MB_{LIFT}$.

As shown in FIG. 5A2, the disc 10 flies with velocity $V_{DISC}$ and rotates counter-clockwise with $V_{SPIN}$. The weight of disc 10 is simplified to be the gravity force $F_G$ at the Center Of Gravity CG. All the air pressure force is simplified to be the $F_{LIFT}$ applied at the Center Of Pressure CP. The Center Of Pressure CP is located before the Center Of Gravity CG. The lift force $F_{LIFT}$ generates negative pitch moment $MP_{LIFT}$. The lift force $F_{LIFT}$ and spin $V_{SPIN}$ generate the pseudo force $FR_{LIFT}$ to generate the right banking moment $MB_{LIFT}$.

As shown in FIG. 5B1, the disc 10 flies with velocity $V_{DISC}$ and rotates clockwise with $V_{SPIN}$. The weight of disc 10 is simplified to be the gravity force $F_G$ at the Center Of Gravity CG. All the air pressure force is simplified to be the $F_{LIFT}$ applied at the Center Of Pressure CP. The Center Of Pressure CP is located after the Center Of Gravity CG. The lift force $F_{LIFT}$ generates positive pitch moment $MP_{LIFT}$. The lift force $F_{LIFT}$ and spin $V_{SPIN}$ generate the pseudo force $FR_{LIFT}$ to generate the right banking moment $MB_{LIFT}$.

As shown in FIG. 5B2, the disc 10 flies with velocity $V_{DISC}$ and rotates clockwise with $V_{SPIN}$. The weight of disc 10 is simplified to be the gravity force $F_G$ at the Center Of Gravity CG. All the air pressure force is simplified to be the $F_{LIFT}$ applied at the Center Of Pressure CP. The Center Of Pressure CP is located before the Center Of Gravity CG. The lift force $F_{LIFT}$ generates negative pitch moment $MP_{LIFT}$. The lift force $F_{LIFT}$ and spin $V_{SPIN}$ generate the pseudo force $PR_{LIFT}$ to generate the left banking moment $MB_{LIFT}$.

As shown in FIG. 5C, it is the trajectory and attitude of the conventional disc. As shown in FIG. 5C, FIG. 5C1 and FIG. 3B1, at the beginning of trajectory, the velocity of disc 10 is fast and the CP is located after CG. The disc 10 rotates clockwise and the disc 10 bank right. The flying distance of the rising trajectory is much longer. As shown in FIG. 5C, FIG. 5C2 and FIG. 3B1, at the end of trajectory, the velocity of disc 10 is slow and the CP is located before CG. The disc 10 rotates clockwise and the disc 10 bank left. The flying distance of the falling trajectory is much shorter.

As shown in FIG. 3B2, FIG. 6A1, FIG. 6A2, FIG. 6B1, FIG. 6B2 and FIG. 6C1, to enhance the flying distance of disc, the Tarng Disc 11 is adopted. There are many dimples on the rim of the Tarng Disc 11. As shown in FIG. 6C2, the dimples are concave holes. As shown in FIG. 6C3, the dimples are convex bumps.

As shown in FIG. 7A1, the Tarng Disc 11 having the dimples 110 on the rim of disc 11. The Tarng Disc 11 moves forward with velocity $V_{DISC}$ and spin counter-clockwise with velocity $V_{SPIN}$. As shown in FIG. 7A1, on the left side of the Tarng Disc 11, the air velocity is $V_{AIR}+V_{SPIN}$. As shown in FIG. 7A2, the air pressure is reduced and there is up-lift force is ($+F_{SPIN}$). As shown in FIG. 7A1, on the right side of the Tarng Disc 11, the air velocity is ($V_{AIR}-V_{SPIN}$). As shown in FIG. 7A2, the air pressure increases and there is downward force is ($-F_{SPIN}$). Due to the counter-clockwise spin of Tarng Disc 11, the pseudo-force ($+FR_{SPIN}$) and ($-FR_{SPIN}$) generate the positive pitching moment $MP_{SPIN}$. The Tarng Disc 11 banks right.

As shown in FIG. 7B1, the Tarng Disc 11 has the dimples 110 on the rim of disc 11. The Tarng Disc 11 moves forward with velocity $V_{DISC}$ and spin clockwise with velocity $V_{SPIN}$. As shown in FIG. 7B1, on the left side of the Tarng Disc 11, the air velocity is ($V_{AIR}-V_{SPIN}$). As shown in FIG. 7B2, the air pressure is increased and there is downward force is ($-F_{SPIN}$). As shown in FIG. 7B1, on the right side of the Tarng Disc 11, the air velocity is ($V_{AIR}+V_{SPIN}$). As shown in FIG. 7B2, the air pressure reduces and there is upward force is ($+F_{SPIN}$). Due to the clockwise spin of Tarng Disc 11, the pseudo-force ($+FR_{SPIN}$) and ($-FR_{SPIN}$) also generate the positive pitching moment $MP_{SPIN}$. The Tarng Disc 11 banks left. In other words, both clockwise and counter-clockwise rotations generate the positive pitching moment for the parabolic trajectory as shown in FIG. 3B2.

Figure 9A:
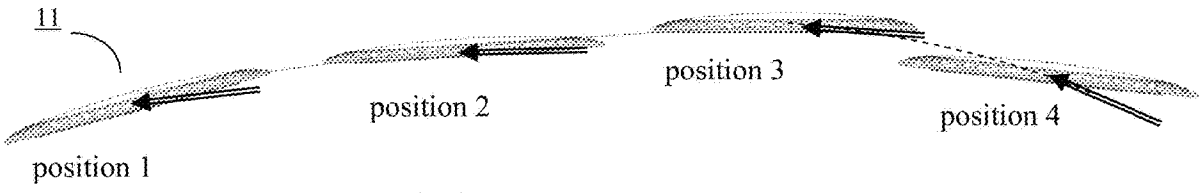
Figure 9B:
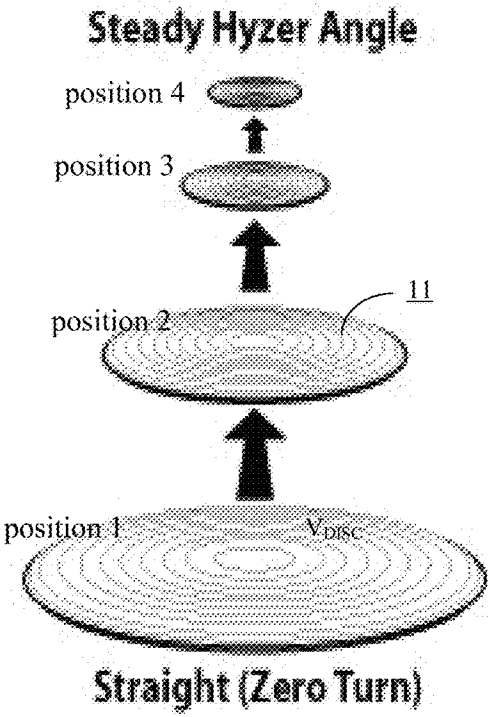
Figure 9C:
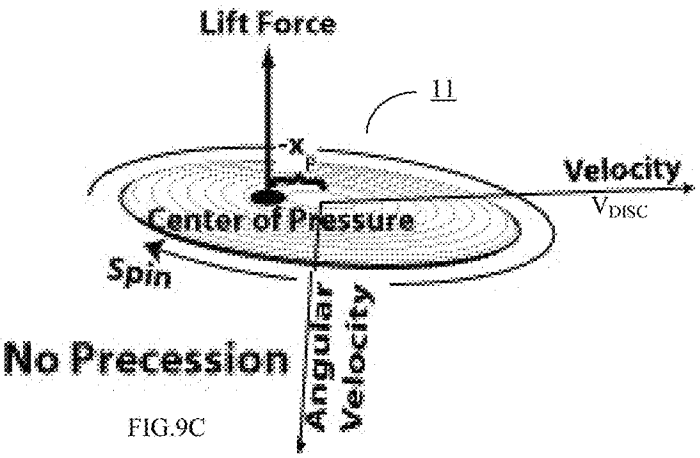

As shown in FIG. 8A, the Tarng Disc 11 has all the forces and moments are included in one picture. The forces and moments are pressure, Tarng Force and weight forces and the momentums generated by the pressure and Tarng force on the flying and rotating disc. The Tarng Disc 11 rotates counter-clockwise. The Center of Pressure CP is located after the Center of Gravity CG. It is noted that both $MP_{LIFT}$ and $MP_{SPIN}$ are positive pitching moments. Therefore, the launch angle can be larger than 0°. As shown in FIG. 3B2 and FIG. 9A, the flying trajectory is parabolic and the flying distance is enhanced. The bank moments $MB_{LIFT}$ and $MB_{SPIN}$ cancel each other. Therefore, as shown in FIG. 9C, the Tarng Disc 11 moves forward without tilting as shown in FIG. 9B. This case is the best performance of the Tarng Disc 11. Therefore, we try to operate in this case.

As shown in FIG. 8A2, the Tarng Disc 11 has all the forces and moments are included in one picture. The forces and moments are pressure. Tarng Force and weight force and the momentums generated by the pressure and Tarng force on the flying and rotating disc. The Tarng Disc 11 rotates counter-clockwise. The Center of Pressure CP is located before the Center of Gravity CG. It is noted that $MP_{LIFT}$ is negative pitching moment and $MP_{SPIN}$ is positive pitching moment. The moments $MP_{LIFT}$ and $MP_{SPIN}$ cancel each other. Therefore, the launch angle is 0°. Both the bank moments $MP_{LIFT}$ and $MP_{SPIN}$ bank right. The Tarng Disc 11 tilts right. Therefore, we try not to operate in this case. This is the launching angle limit for the Tarng Disc 11.

As shown in FIG. 8B1, the Tarng Disc 11 has all the forces and moments are included in one picture. The forces and moments are pressure, Tarng Force and weight force and the momentums generated by the pressure and Tarng force on the flying and rotating disc. The Tarng Disc 11 rotates clockwise. The Center of Pressure CP is located after the Center of Gravity CG. It is noted that both $MP_{LIFT}$ and $MP_{SPIN}$ are positive pitching moments. Therefore, the launch angle can be larger than 0°. As shown in FIG. 3B2 and FIG. 9A, the flying trajectory is parabolic and the flying distance is enhanced. The bank moments $MP_{LIFT}$ and $MP_{SPIN}$ cancel each other. Therefore, as shown in FIG. 9C, the Tarng Disc 11 moves forward without tilting as shown in FIG. 9B. This case is the best performance of the Tarng Disc 11. Therefore, we try to operate in this case.

As shown in FIG. 8B2, the Tarng Disc 11 has all the forces and moments are included in one picture. The forces and moments are pressure, Tarng Force and weight force and the momentums generated by the pressure and Tarng force on the flying and rotating disc. The Tarng Disc 11 rotates clockwise. The Center of Pressure CP is located before the Center of Gravity CG. It is noted that $MP_{LIFT}$ is negative pitching moment and $MP_{SPIN}$ is positive pitching moment. The moments $MP_{LIFT}$ and $MP_{SPIN}$ cancel each other. Therefore, the launch angle is 0°. The bank moments $MP_{LIFT}$ and $MB_{SPIN}$ bank left. Therefore, the Tarng Disc 11 tilts left. Therefore, we try not to operate in this case. This is the launching angle limit for the Tarng Disc 11.

As shown in FIG. 8A and FIG. 8B1, the dimples on the top surface of Tarng Disc 11 have the same effect for the clockwise direction and counter-clockwise direction. Therefore, the dimple on the top of Tarng Disc 11 can be the round bump or round cavity which is universal in all directions.

As shown in FIG. 10A1, FIG. 10A2, FIG. 10B1 and FIG. B2, the dimples 120 of Tarng Disc 12 also locate on the bottom plate of the Tarng Disc 12. However, as shown in FIG. 11B and FIG. 11C, the dimples 120 are uni-directional dimples. There are different lift forces in the right bottom plate and left bottom plate. The lift force is more like the aerofoil lift force. Therefore, the section of the dimple is different to be the uni-directional dimples.

As shown in the FIG. 11B and FIG. 11C, the dimple has the unsymmetrical concave. The unsymmetrical concave dimple is similar to the arch of the bottom plate of the aerofoil. It has the different lift forces in the different directions. As shown in FIG. 11B, the lift force is larger than the lift force as shown in FIG. 11C. As shown in FIG. 11A, the ($+F_{SPIN,BOTTOM}$) pushes the disc 12 upward and the ($-F_{SPIN,BOTTOM}$) pulls the disc 12 downward. Comparing FIG. 8A with FIG. 11A, the ($+F_{SPIN,BOTTOM}$) in FIG. 11A is the addition to the ($+F_{SPIN}$) in FIG. 8A1 the ($-F_{SPIN,BOTTOM}$) in FIG. 11A is the addition to the ($-F_{SPIN}$) in FIG. 8A1.

As shown in FIG. 11A, FIG. 11B and FIG. 11C, on the bottom airfoil edge of the gliding golfdisc has dimples. The dimples on the bottom edge have directional sense. As shown in FIG. 11A, this is the clockwise Tarng disc 12 having the dimples on the bottom surface of Tarng disc 12. Being similar to the clockwise Tarng disc 12 in FIG. 11A, just flip the dimple in the horizontal direction as shown in the FIG. 11B and FIG. 11C, we can have the counter-clockwise Tarng disc.

As shown in FIG. 12A1, FIG. 12A2, FIG. 12B1, FIG. 12B2 and FIG. 12C, the super-lift Adaptive Tarng Disc 13 has the adaptive fin 130 to reduce the drag during the glide of the super-lift Adaptive Tarng Disc 13. The adaptive fin 130 is to reduce the drag force of the stagnation point of the stability edge 103 at the trailing edge of super-lift Adaptive Tarng Disc 13. The height of the adaptive fin 130 is less than the stability edge 103. At the side edge of disc 13, the stability edge 103 serves as the stability fin. The inside curvature 1030 is much larger that the flow will not generate the stagnation point as the stability 103 does. Therefore, the air drag force of disc 13 is reduced. At the front edge, without the adaptive fin 130, the flow becomes the turbulent flow. The turbulent flow increases the drag force a lot. With the adaptive fin 130, the flow becomes laminar flow. The air drag force of the laminar flow reduces a lot.

Figure 13B:
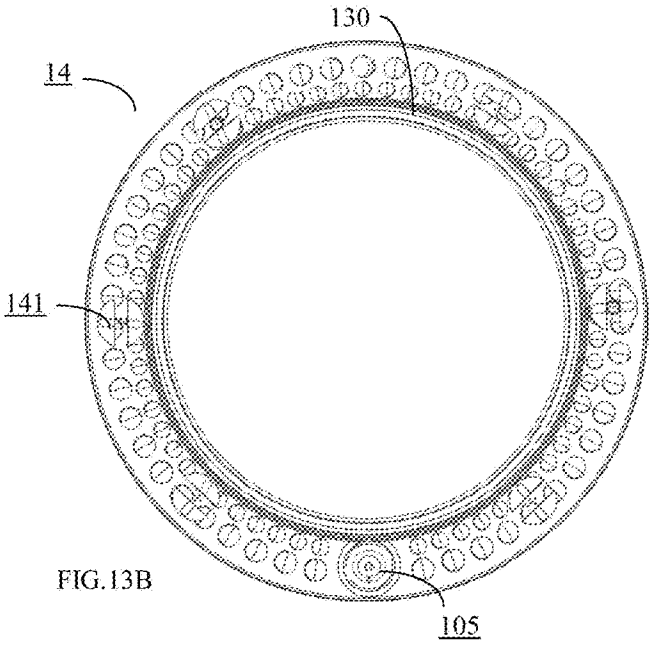
Figure 13A:
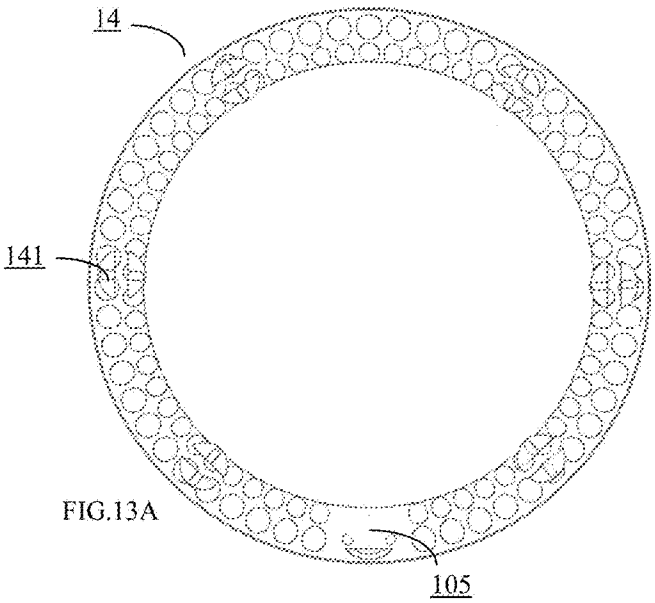
Figure 13C:
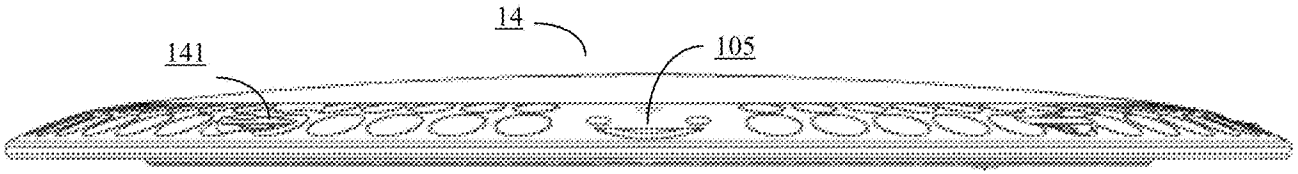

As shown in FIG. 13A, FIG. 13B and FIG. 13C, the propeller 141 of the discopter 14 is mounted on the triangle shaped rim of the super-lift Adaptive discopter Tarng golfdisc 14. The super-lift Adaptive discopter Tarng discgolf 14 can wear on head that the super-lift Adaptive discopter Tarng golfdisc 14 can take off from the head. With the adaptive fin 130, the super-lift Adaptive discopter Tarng golfdisc 14 can wear on head.

As shown in FIG. 14A1, FIG. 14A2, FIG. 14B1, FIG. 14B2, FIG. 15A1, FIG. 15A2, FIG. 15B1 and FIG. 15B2, the remote surveillance super-lift Adaptive discopter Tarng golfdisc 15 has the smart phone and remote surveillance video camera 151. The smart phone and remote surveillance video camera 151 takes the video. The wrist monitor 3 or smart phone 3*r* make the remote control for the smart phone and remote surveillance video camera 151. The video signal is transmitted to the wrist monitor 3 or smart phone 3*r*. As shown in FIG. 15A2 and FIG. 15B2, the solar cell golfdisc 15*s* provides the electricity to the smart camera 151 and discopter 152.

The earphone and microphone 152 is one curved bracket can hide in the space between the adaptor 130 and stability edge 103. The disc golfer wears the golfdisc 15 on his head. As the disc golfer wants to speak, the curved bracket pivotally rotates down and the microphone 152 is close to the disc golfer's mouth to speak.

As shown in FIG. 16A1, FIG. 16A2, FIG. 16B1, FIG. 16B2, FIG. 16C1 and FIG. 16C2, the remote surveillance super-lift Adaptive discopter Tarng golfring 16 has the smart phone and remote surveillance video camera 151. The remote surveillance super-lift Adaptive discopter Tarng golfing 16 can wear on head. As shown in FIG. 16A2 and FIG. 16B2, the solar cell golfdisc 16*s* provides the electricity to the smart camera 151 and discopter 152. FIG. 16C3 and FIG. 16C4 are the discopter serving as for the Head Wearing Device of the Smart Hat of iHat. The adaptor 130 is to have the head to wear the Smart Hat of iHat to take off from the head and land on the head.

As shown in FIG. 17A1, FIG. 17A2, FIG. 17B1 and FIG. 17B2, the remote surveillance super-lift adjustable Adaptive discopter Tarng golfring 17 has the adjustable adaptive ring 170 to fit the different size head. The adjustable adaptive ring 170 has an opening to adapt the different size of the heads and offering the spring force to clamp the head. As shown in FIG. 17A2 and FIG. 17B2, the solar cell golfdisc 17*s* provides the electricity to the smart camera 151 and discopter 152. As shown in FIG. 17C1, FIG. 17C2 and FIG. 17C3, it is the thick golfring 17*a*. As shown in FIG. 17D1, FIG. 17D2 and FIG. 17D3, it is the thin golfring 17*b*. The solar cell s and dimples 110 are on the top surfaces of the thick golfring 17*a* and thin golfring 17*b*. The solar cell s and dimples 120 are on the bottom surfaces of the thick golfring 17*a* and thin golfring 17*b*. The slat-flap-adaptor 17*sfa* not only serves as the slap and flap but also serves as the head adaptor. The golfring 17*a* and 17*b* can be the smart hat of iHat or discoptor 17 as shown in FIG. 17A1 and FIG. 17B1. The smart hat of iHat or discoptor 17 can launch and land on the people's head.

As shown in FIG. 18A1, FIG. 18A2, FIG. 18B1 and FIG. 18B2, the remote surveillance super-lift elastic adjustable Adaptive discopter Tarng golfdisc 18 has the top cover 181 to be elastic in the disc form.

As shown in FIG. 18B2 and FIG. 19B2, the adaptor 181*b* of gliding golfdisc 18 has an opening that the adaptor 181*b* is able to adapt the different size of head. As shown in FIG. 18A2 and FIG. 18B2, the solar cell golfdisc 18*s* provides the electricity to the smart camera 151 and discopter 152.

As shown in FIG. 19A1, FIG. 19A2, FIG. 19B1 and FIG. 19B2, the remote surveillance super-lift elastic adjustable Adaptive discopter Tarng golfdisc 18 has the top cover 181 to be elastic in the hat form. As shown in FIG. 19A2 and FIG. 19B2, the solar cell golfdisc 18*s* provides the electricity to the smart camera 151 and discopter 152.

As shown in FIG. 20A and FIG. 4D, the super-lift disc 10 has the bottom edge 101 to be flat in the horizontal direction. At the trail edge of the bottom edge 101, the flap 102 is in the right triangle shape with fitting curvatures. The flap 102 makes the super-lift disc 10 having the super-lift.

The gliding golfdisc as shown in FIG. 4A2 comprises a closed rim airfoil 10 as shown in FIG. 20A. The rim airfoil 10 has a substantially right angle triangular cross-section with the longer right-angle side being a bottom airfoil edge 101 as shown in FIG. 20C. An outer rounded corner and curved hypotenuse being upper airfoil edge 100 of the closed rim airfoil 10. At the rear portion of the bottom edge 101, the closed rim airfoil 10 further comprises a substantially right triangle flap 102. As shown in FIG. 20C, the triangle flap 102 has a longer right-angle side connecting with the bottom airfoil edge 101. The shorter right-angle side of the rim airfoil 10 and the shorter right-angle side of the triangle flap 102 being in alignment to be one nearly vertical curve 103 of the closed rim airfoil 10.

As shown in FIG. 20B and FIG. 4E, the discap 105 has the bottom edge 101 to be flat. The stability edge 103 is a nearly vertical curve as the conventional disc does. As shown in FIG. 20C and FIG. 4F, to reduce the air drag force, the discap 105 has the plateau 1055. The plateau 1055 fills up the cavity of the discap 105. The plateau 1055 prevents the air flowing into the cavity of discap 105. In the middle of the plateau 1055, there is a rectangle slot 1050. During the plastic injection process, the rectangle slot 1050 is to hold the discap 105 to the wall of the plastic module. The screw 1056 is to engage with the screw 2056 of the disclub head 205 as shown in FIG. 26B.

As shown in FIG. 21A, FIG. 21B, FIG. 21C1, FIG. 21C2 and FIG. 6C1, is super-lift Tarng golfdisc 11 has the trail triangle flap 102, curved dome 104 and the dimples 110. The trail triangle flap 102, curved dome 104 and the dimples 110 makes the super-lift Tarng golfdisc 11 having the superior flying capability. The anti-thrust stubs 1057 are on the top of discap 105. As shown in FIG. 21B, to reduce the air drag to have the long-range drift and glide capability, the curved dome 104 eliminates the stagnation point of the stability edge 103 as shown in FIG. 20B and FIG. 4E. However, the bottom edge of the curved dome 104 is still nearly vertical that it still has the stability function for the golfdisc 11.

As shown in FIG. 22A, FIG. 22B, FIG. 22C and FIG. 12C, the stability edge 103 is lower than the adaptive fin 130. The stability edge 103 is to stabilize the disc 13 at the right side and left side of golfdisc 13. At the rear edge of the golfdisc 13, the adaptive fin 130 is to reduce the drag force of the stagnation point of stability edge 103. At the front edge of the disc 13, the adaptive fin 130 is to reduce the turbulent flow of the stability edge 103.

Figure 22A:
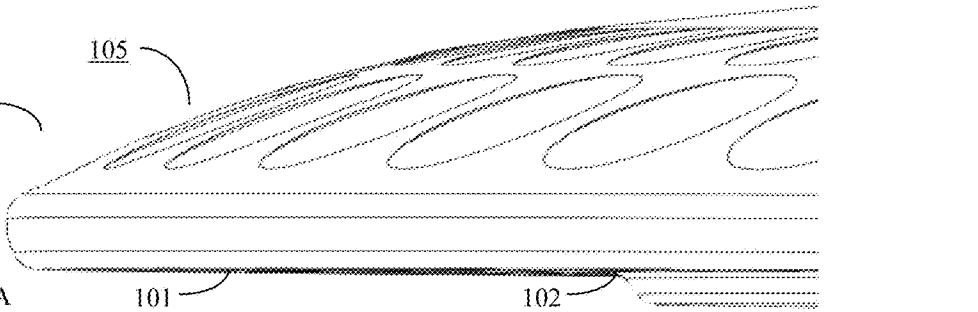
Figure 22B:
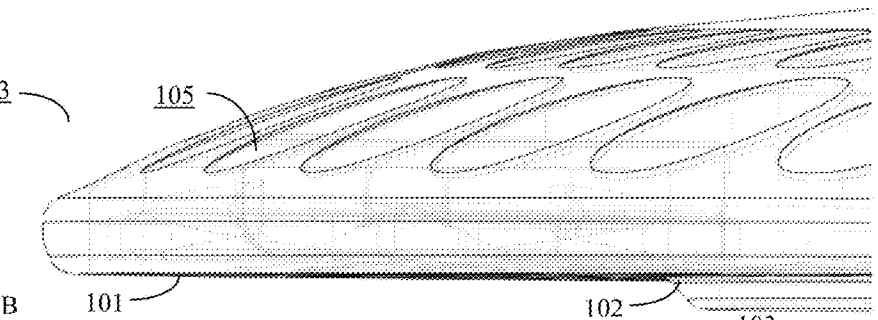
Figure 22C:
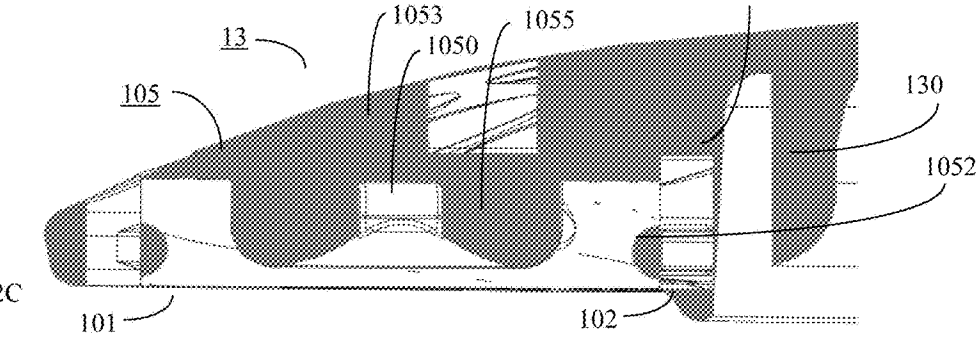
Figure 22E:
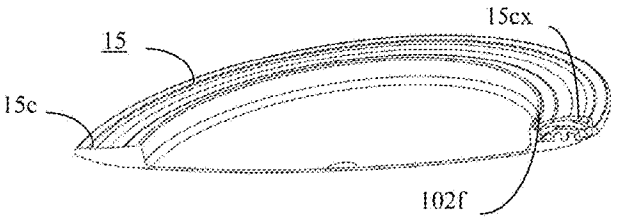
Figure 22G:
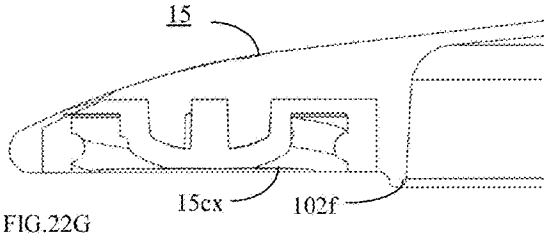

As shown in FIG. 21A and FIG. 22A, the upper surface of the airfoil rim 13 of the gliding golfdisc has dimples.

As shown in FIG. 21C2, the closed rim airfoil of the gliding golfdisc comprises a central section 106 and an annular shoulder 104. The shoulder 104 decreases in thickness from the rim to the central section 106.

As shown in FIG. 22C, FIG. 12C and FIG. 16C1, the closed rim airfoil 13 of the gliding golfdisc comprises an adaptor 130. The adaptor 130 is parallel to the vertical edge 103 of the closed rim airfoil 13. Between the adaptor 130 and the vertical edge 103, there is an open space.

FIG. 22D, FIG. 22E, FIG. 22F, FIG. 22G and FIG. 22H show the super-lift Tarng golfdisc 15 having the subsonic aerofoil with concave bottom 15*c* and 15*cx*. The concave bottom 15*cx* is located on the discap structure 105*x*. The concave bottom 15*c* is located on the golfrisbee 15. The profile of the golfrisbee 15 is in the subsonic aerofoil.

Figure 22I:
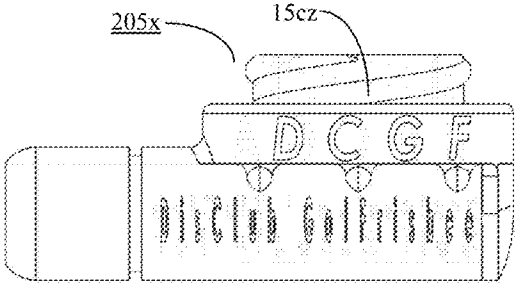
Figure 22D:
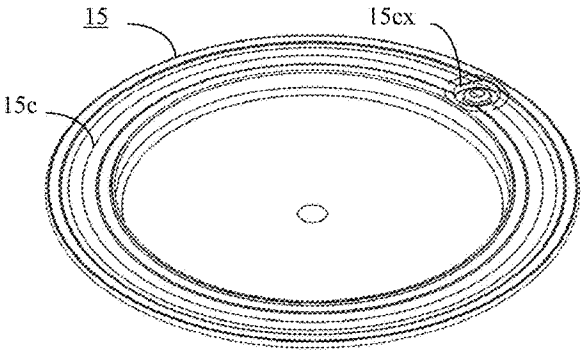
Figure 22F:
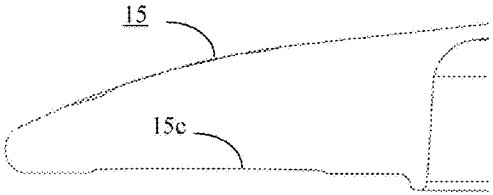
Figure 22H:
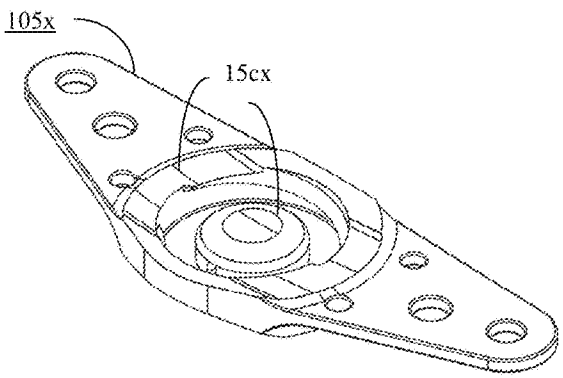

FIG. 22I is the side transparent view of the DisClub Head 205*x* for the super-lift Tarng golfdisc 15 having the subsonic aerofoil with concave bottom 15*cx*. The plateau 15*cz* is to fit the concave 15*cx* of the discap 105*x*.

Figure 22J:
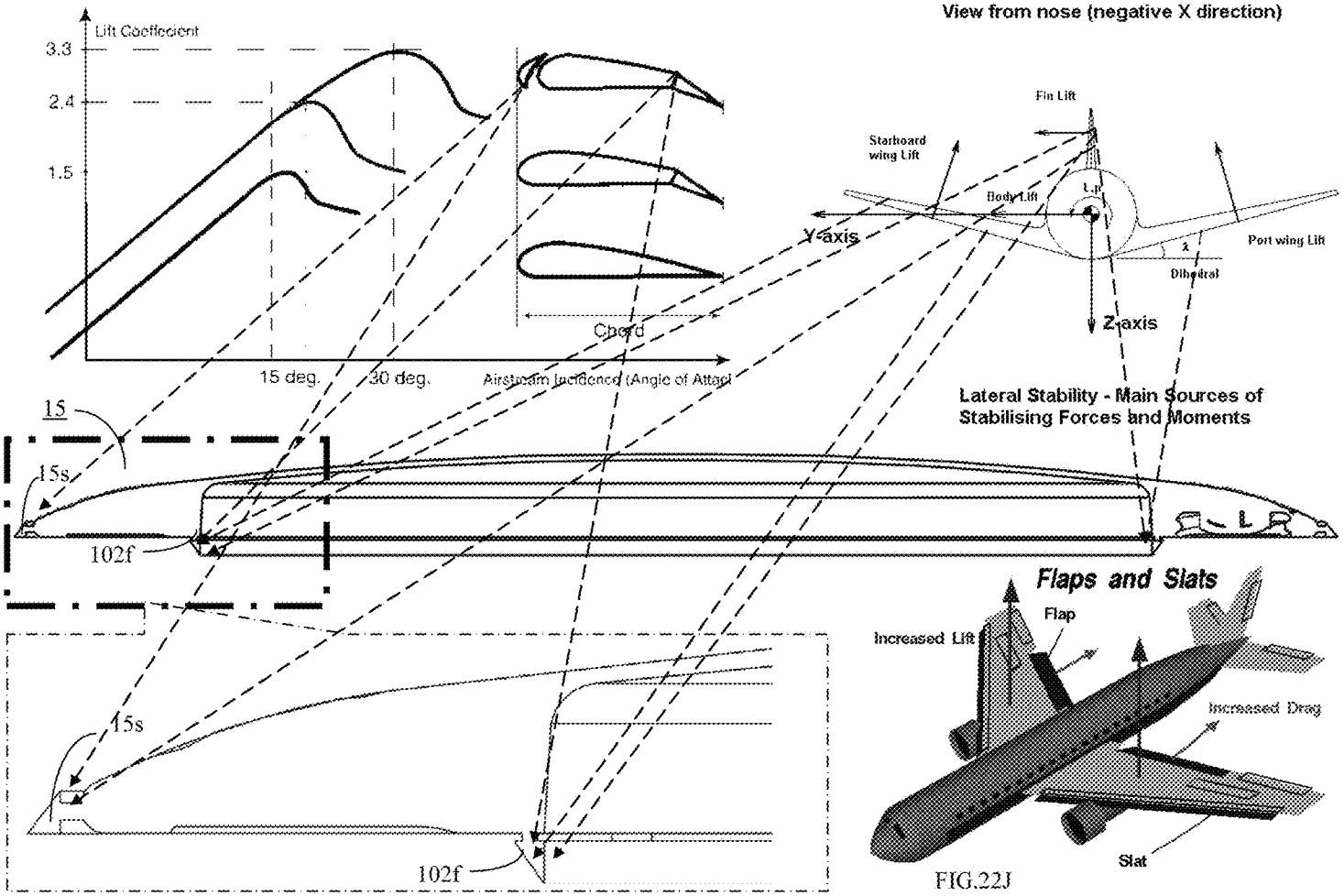

As shown in FIG. 22J, the golfrisbee 15 has the structure of bumper-fin-slat 15*s* and wing-fin-flap 102*f* of the aerofoil.

The bumper-fin-slat 15*s* is the slat having the functions of (1) slat; (2) fin; and (3) bumper as shown by the arrows. As shown in FIG. 22J, the bumper-fin-slat 15*s* has the right triangle shape or the right triangle. The front edge is hypotenuse. The bottom edge and the back edge are legs.

On the front edge of the golfrisbee 15, the bumper-fin-slat 15*s* serves as the slat. The air flows through the air gap to increase the lift at the large angle of attack.

On the side of the golfrisbee 15, the bumper-fin-slat 15*s* serves as the fin to provide the side stability.

As the golfrisbee 15 hit on the other staff, the bumper-fin-slat 15*s* serves as the bumper providing the hit cushion capability.

The wing-fin-flap 102*f* is the flap having the functions of (1) flap; (2) fin; and (3) wing as shown by the arrows. As shown in FIG. 22J, the wing-fin-flap 102*f* has the right triangle shape or the right triangle. The front edge is hypotenuse. The top edge and the back edge are legs.

On the front edge of the golfrisbee 15, the wing-fin-flap 102*f* serves as the flap. The air flow is deflected downward to increase the lift.

On the side of the golfrisbee 15, the wing-fin-flap 102*f* serves as the fin to provide the side stability.

As the golfrisbee 15 hit on the other staff, the wing-fin-flap 102*f* serves as the wing providing the side capability.

Figure 22K:
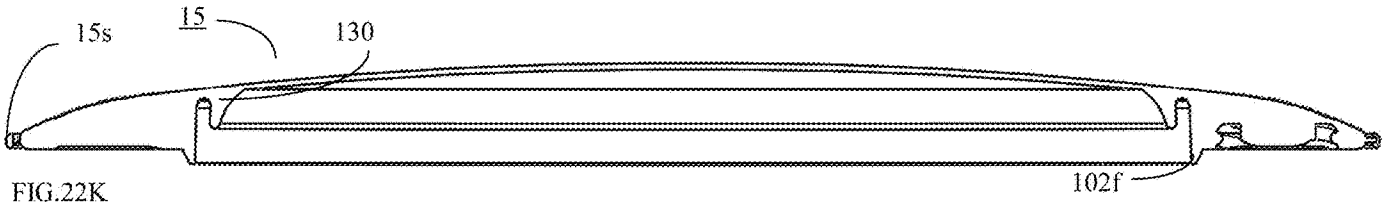
Figure 22L:
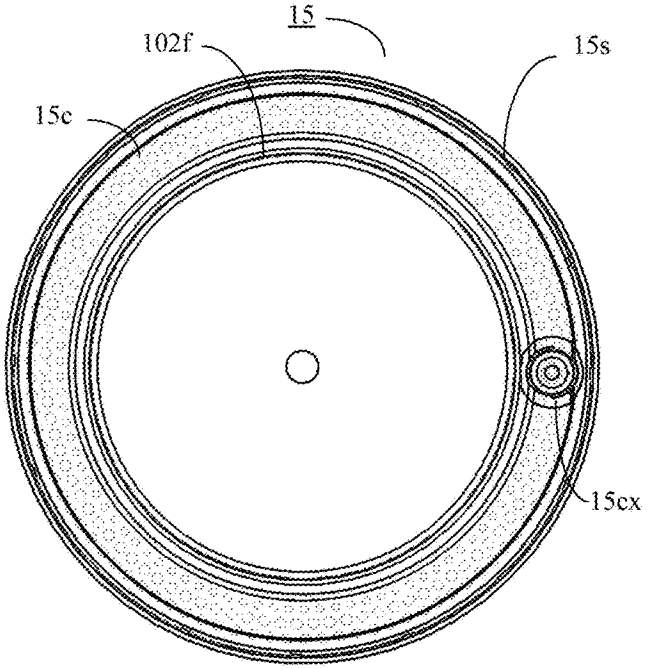
Figure 22M:
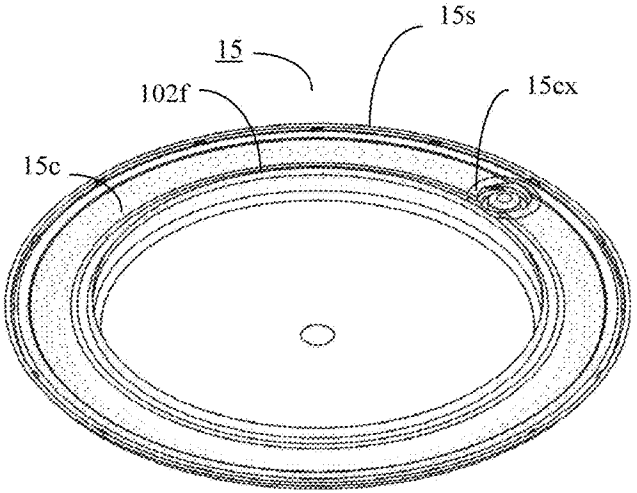

As shown in FIG. 22K, FIG. 22L and FIG. 22M, the wing-fin-flap 102*f* has one option to integrate with the golfrisbee 15. The bumper-fin-slat 15*s* is piece-wise connected to the golfrisbee 15 with the trunks 15*t*, The trunks are short that the air gaps between the golfrisbee 15 and the bumper-fin-slat 15*s* is narrow.

Figure 22Q:
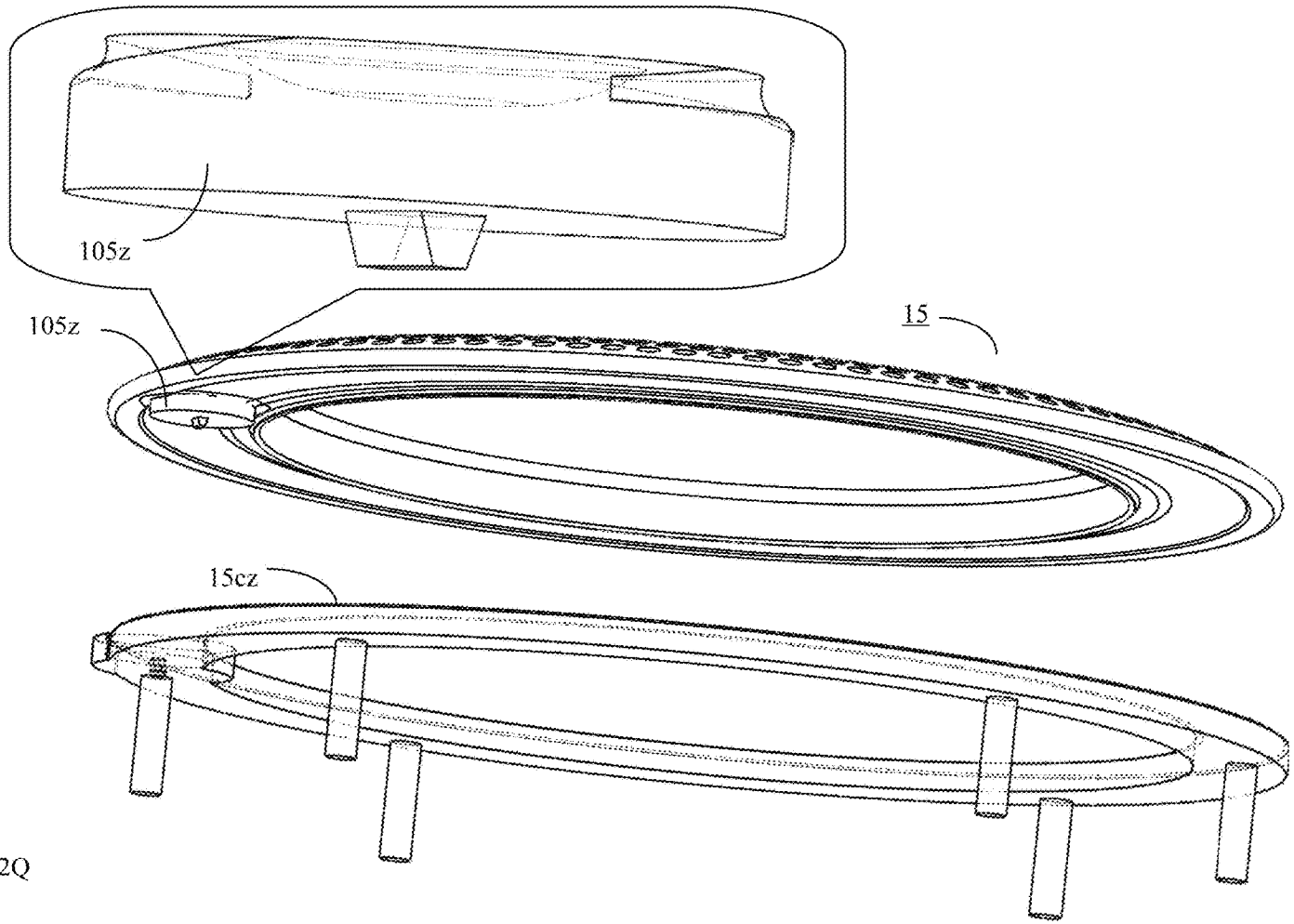

As shown in FIG. 22Q, it shows the module. The discap 105*x* screws on the discap adaptor 105*z*. The discap adaptor 105*z* is mounted on the detached ring 15*cz*.

Figure 23B:
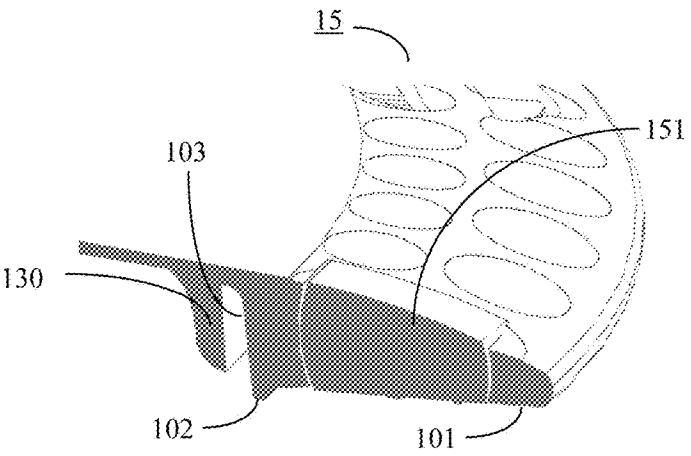
Figure 23A:
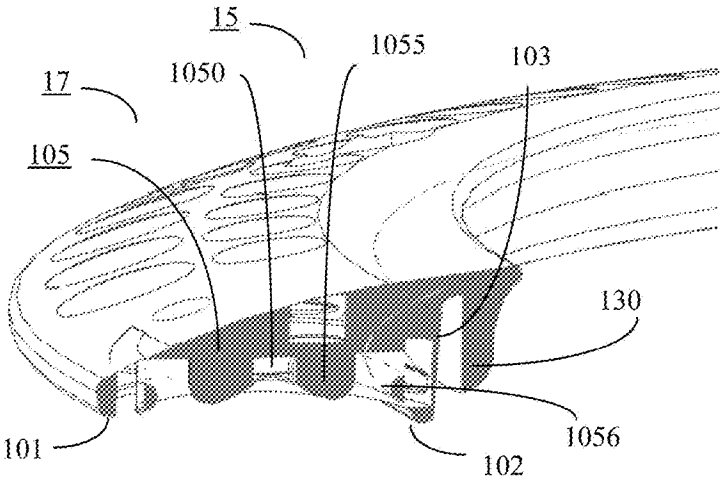
Figure 23C:
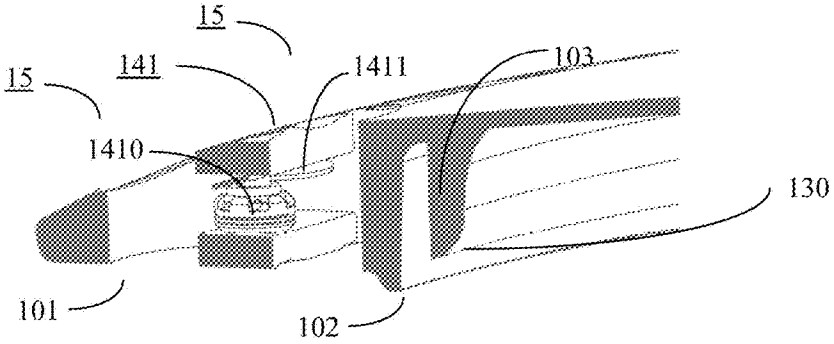

As shown in FIG. 23A and FIG. 17A1, they show the isometric section view of the discopter 17 in the disc-ring shape. As shown in FIG. 23B and FIG. 15A1, they show the isometric section view of the smart phone and camera 151 of the remote surveillance super-lift Adaptive discopter Tarng golfdisc 15. As shown in FIG. 23C and FIG. 15A1, they show the isometric section view of the propeller 141 of the discopter for the remote surveillance super-lift Adaptive discopter Tarng golfdisc 15. The motor 1410 drives the blade 1411 to rotate.

As shown in FIG. 23B, the disc further comprises a smart phone and camera 151. The smart phone and camera 151 is pivotally mounted on said rim airfoil 15.

As shown in FIG. 23C, the gliding golfdisc further comprises the propellers 141 to be the discopter. The rim airfoil 15 has multiple cavities. The discopter 141 is embedded in the cavity of the rim airfoil 15. The discopter 141 has a propeller 1411 mounted on a motor 1410. The motor 1410 drives the propeller 1411 to rotate.

To have the long drive for the disc, being similar to the golf ball hit by the club head, the golfdisc 1 is hit with the disclub head 205. However, as the disc 1 is launched, the disc 1 is moving. To keep the disc 1 to be fixed on the disclub head 205, as shown in FIG. 24A, the cam-locking click point 1051 of the discap 105 is held against the cam-locking click point 2051 of the disclub head 205.

Figure 24B:
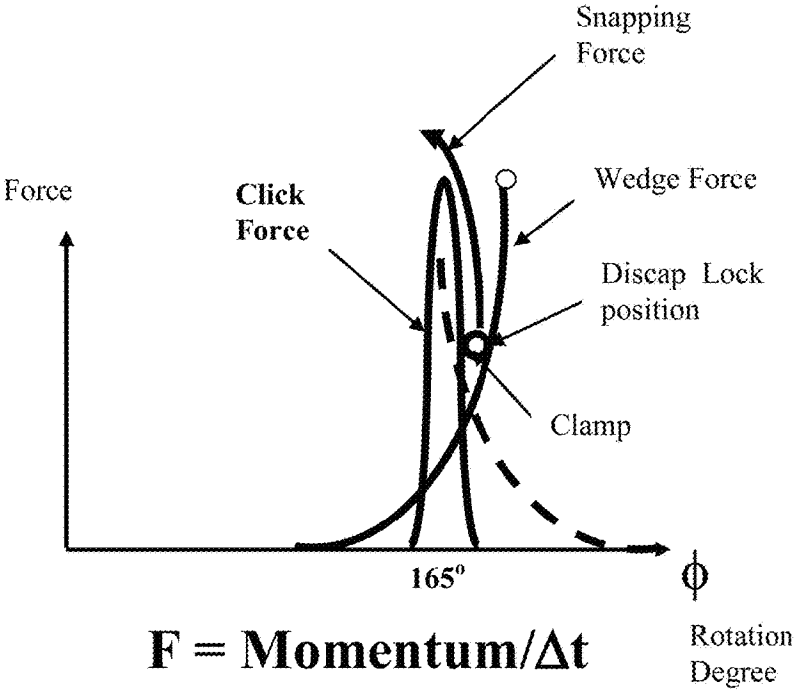
Figure 24A:
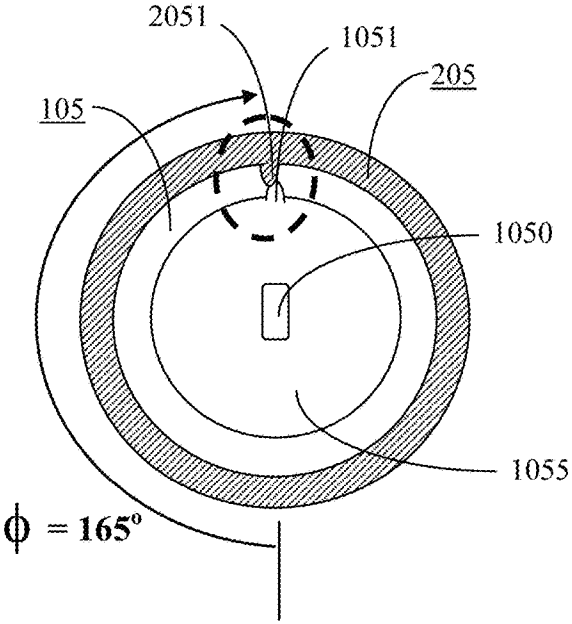

As shown in FIG. 24B, the discap 105 is clamped between the cam-locking click force of the cam-locking click points 1051 and 2051 and the wedge force of screw tighten between the discap 105 and the club head 205. The disc 1 and discap 105 are held to the disclub head 205. The wedge force of the screw tighten force is the tighten force between the discap 105 and the head 205 of disclub. The rotation angle $\phi$ of the discap 105 on the disclub head 205 is about 165°.

Figure 25A:
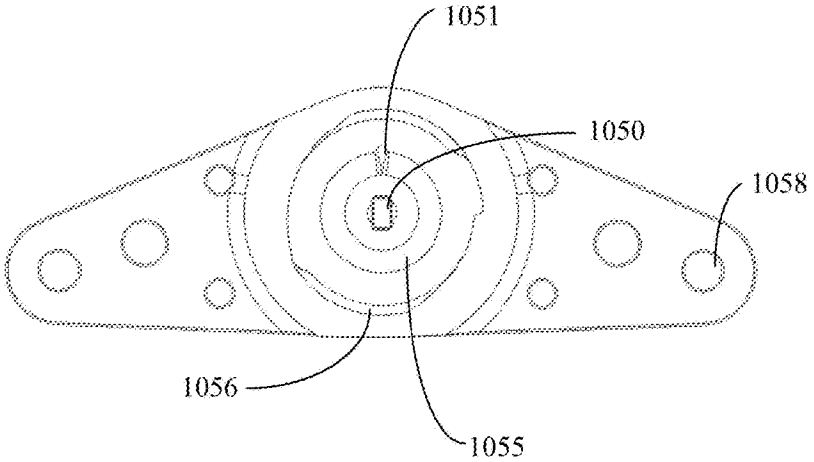
Figure 25C:
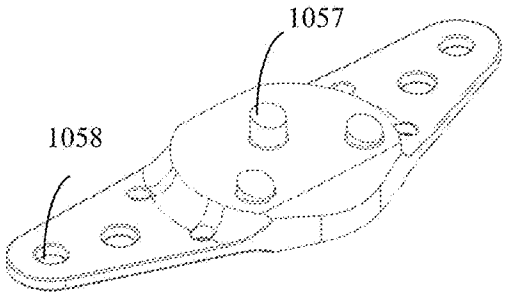
Figure 25B:
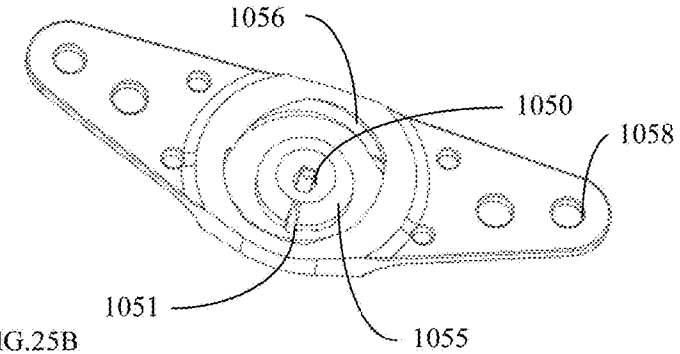

As shown in FIG. 25A and FIG. 25B, the click point 1051 is located at the rim of the plateau 1055. The plateau 1055 eliminates the big hole space of the discap 105. The rectangle hole 1050 is at the center of the plateau 1055. It is to hold the discap 105 to the wall of the module for the plastic injection. As shown in FIG. 25B, between the screw 1056 and the plateau 1050, there is a rim-type space to fit for the screw 2056 of the disclub head 205 as shown in FIG. 26A. As shown in FIG. 25C, the anti-thrust stubs 1057 are on the top of the discap 105. They absorb the thrust force as the snapping force applied to the discap 105. The holes 1058 are for the bonding between the disc 1 and the discap 105.

Figure 26C:
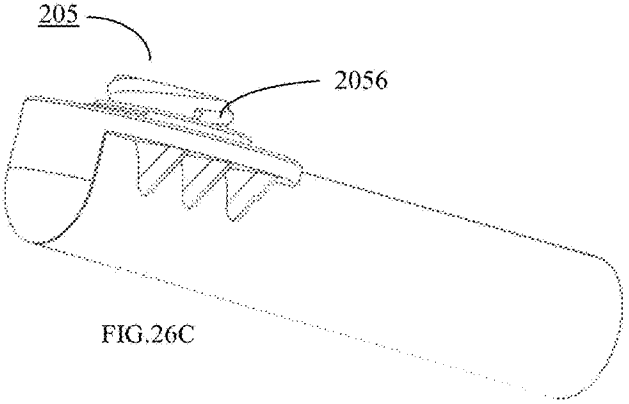

As shown in FIG. 26A, FIG. 26B and FIG. 26C, the slope 2058 of disclub head 205 is adapted to the triangle flap 102 of discap 105 as shown in FIG. 20A. As the disc 1 rotates about 165°, the bottom edge of the discap 105 engages with the flat step 2059 and the triangle flap 102 fits with the slope 2058. The bottom edge 101 of the discap 105 engages with the flat step 2059 generates the wedge force as shown in FIG. 24B. The solar cell 205*s* provides the electricity to the smart camera 151 and discopter 152. As shown in FIG. 26D1 and FIG. 26D2, the disclub head 207 has the same screw structure as the disclub head 205 does. As shown in FIG. 33C2, FIG. 33D2, FIG. 37C and FIG. 37D, the oil ring 2070 is to hold the first tube 271 of the disclub 27 at the shortened position. The grip 270 is mounted on the first tube 271. As shown in FIG. 33D1 and FIG. 37C, the friction segment 2730 is to hold the tube 273 in the tube 272. The friction segment 2720 is to hold the tube 272 in the tube 271.

Figure 29A:
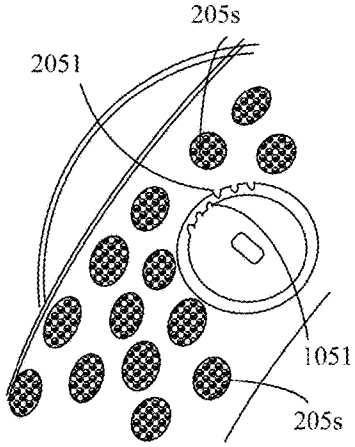
Figure 29B:
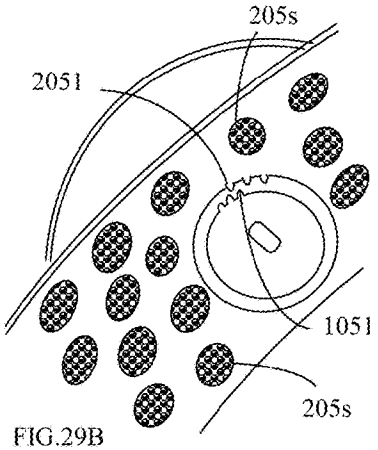
Figure 29C:
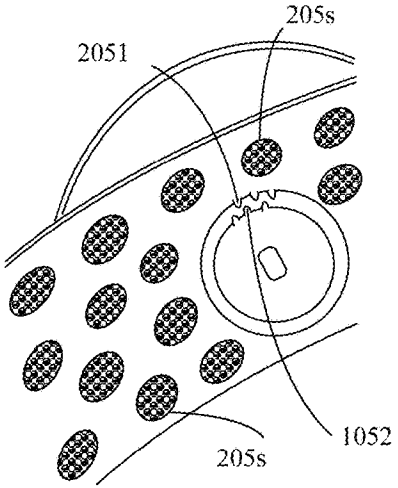
Figure 29D:
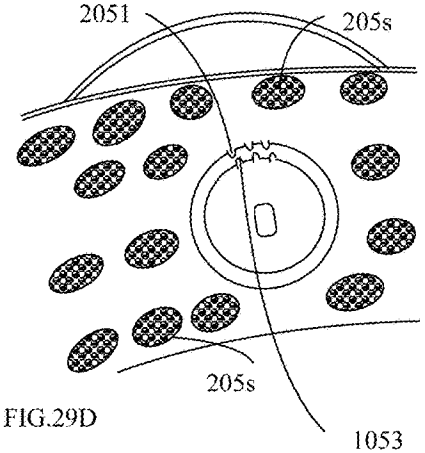
Figure 29J:
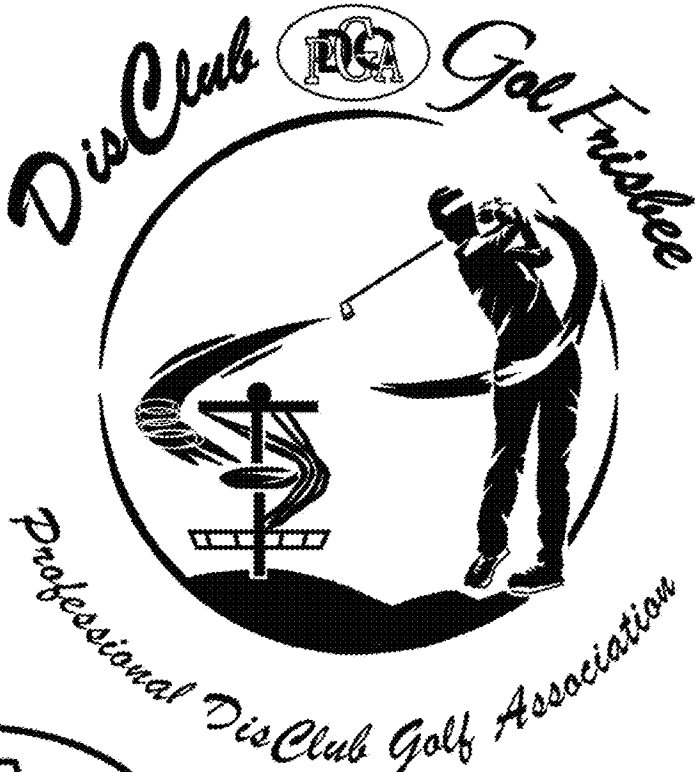

As shown in FIG. 27B and FIG. 29D, the discap and disclub head have a plurality of cam locking clicking point to hold the discap 105 to the disclub head 205. The cam locking clicking point 1051 is attached to inner wall of the discap 105. The cam locking clicking point 2053 is attached to the outer wall of the disclub head 205.

FIG. 29E1 shows the discap 105 embedded in the golfrisbee 11. FIG. 29E2 shows the cave of the discap 105*z* embedded in the golfrisbee after the discap 105*z* being removed. FIG. 29E3 shows the bottom view of the discap 105. FIG. 29E4 shows the top view of the discap 105*x* having the anti-shock stubs. FIG. 29E5 shows the top view of the discap 105*z* having the concave structure for the plastic injection to reduce the shrinkage. FIG. 29F1 shows the adaptable discap 105*a* embedded in the golfrisbee. The adaptable discap 105*a* is removable to change for the different adaptable discaps 105*a*. FIG. 29F2 shows the bottom isotropic view of the adaptable discap 105*a*. FIG. 29F3 shows the top view of the adaptable discap 105*ax* having the anti-shock stubs, FIG. 29F4 shows the cave of the adaptable discap 105*ax* embedded in the golfrisbee after the adaptable discap being removed for the discap as shown in FIG. 29F3. FIG. 29F5 shows the top view of the adaptable discap 105*az* having the concave structure for the plastic injection to reduce the shrinkage. FIG. 29F6 shows the cave of the adaptable discap 105*az* embedded in the golfrisbee after the adaptable discap 105*az* being removed for the discap as shown in FIG. 29F5, FIG. 29G1, FIG. 29G2 FIG. 29H1 and FIG. 29H2 the foil stamping of golfrisbee.

As shown in FIG. 27A and FIG. 27B, they show the single cam-locking clicking point structure. FIG. 27A shows the single cam-locking clicking point 1051 and cam-locking clicking point 2051 being in the lock position. FIG. 27B shows the single cam-locking clicking point 1051 and cam-locking clicking point 2051 being in the release position. The solar cell 205*s* provides the electricity to the smart camera 151 and discopter 152.

To adjust the flying distance of the disc, we can adjust the snapping force with the multiple cam-locking clicking points. As shown in FIG. 28A1 and FIG. 28B1, they show the discap 105 having the multiple cam-locking click points, 1051, 1052 and 1053. As shown in FIG. 28A2 and FIG. 28B2, they show the disclub head 205 having the multiple cam-locking click points, 2051, 2052 and 2053. As shown in FIG. 29A and FIG. 29B, they show the cam-locking clicking point structure. FIG. 29A shows the cam-locking triple clicking point in the release position. FIG. 29B shows the cam-locking triple clicking point at the single lock position having one click point in the lock position. FIG. 29C shows the cam-locking triple clicking point at the double lock position having two click points in the lock position. FIG. 29D shows the cam-locking triple clicking point at the triple lock position having three click points in the lock position.

As shown in FIG. 29E1 and FIG. 29E2, it is the isotropic bottom view of the golfrisbee 11 having the discap 105 or discap 105*z* embedded in the golfrisbee 11. The discap 105 or discap 105*z* cannot be removed from golfrisbee 11.

On the contrary, as shown in FIG. 29F1, it is the isotropic bottom view of the golfrisbee 11*a* having the discap 105*a* mounted on the golfrisbee 11*a*. The discap 105*a*, 105*ax* or 105*az* can be removed from the golfrisb 11*a*. FIG. 29F4 is the isotropic bottom view of the golfrisbee 11*ax* as the discap 105*ax* is removed from the golfrisbee 11*ax*. FIG. 29F6 is the isotropic bottom view of the golfrisbee 11*az* as the discap 105*ax* is removed from the golfrisbee 11*az*.

Figure 29K:
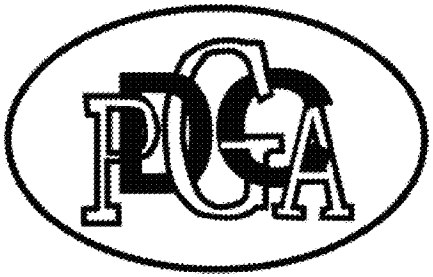
Figure 29I:
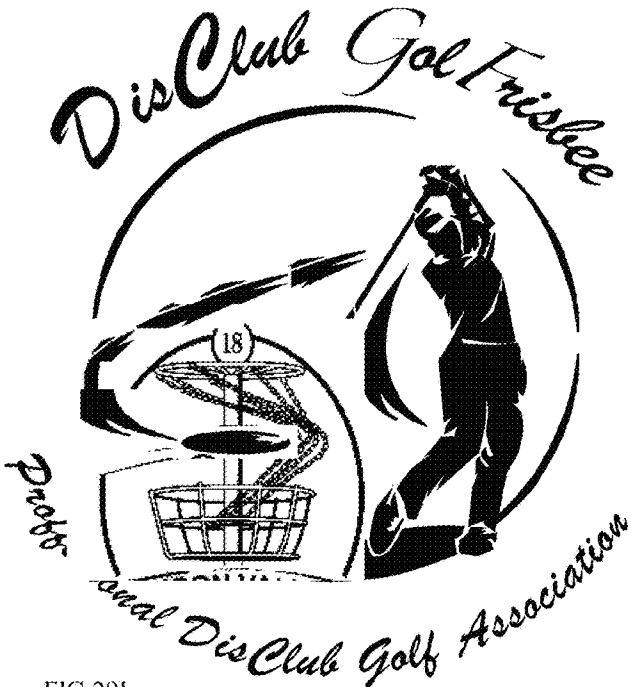

As shown in FIG. 29G1, FIG. 29G2, FIG. 29H1, FIG. 29H2, FIG. 29I and FIG. 29J, are the logos print on the golfrisbee, FIG. 29K is the symbol of the Professional DisClub Golf Association (PDCGA).

As shown in FIG. 30A and FIG. 30B, the smart phone 151 comprises the versatile vision facilities 1512 and 1513 such as camera, holographic projector light, laser, speaker, antenna and infrared, etc. As shown in FIG. 23B, the smart phone 151 is mounted on the golfdisc 1 with the pivotal axis 1511.

Figure 31B:
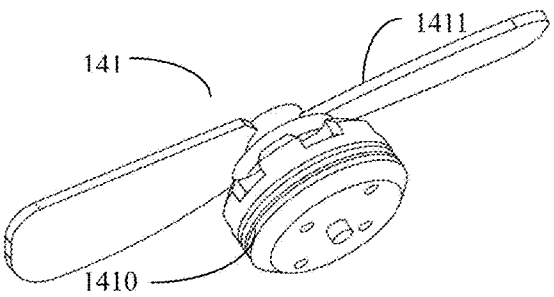
FIG. 31B is the isometric bottom view of the propeller and motor.
Figure 31A:
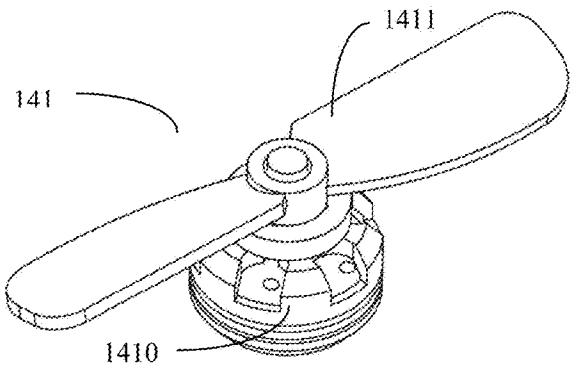
FIG. 31A is the isometric top view of the propeller and motor.

As shown in FIG. 31A and FIG. 31B, the discopter 141 has the propeller 1411 mounted on the motor 1410. As shown in FIG. 23C and FIG. 30A, the propeller 141 of discopter 15 is mounted in the frame of golfdisc rim.

As shown in FIG. 32A, FIG. 32B, FIG. 1E1 and FIG. 1E2, the golfdisc 12 and disclub 26 can serve as the self-portrait with the camera of smart phone 151. As shown in FIG. 32D1 and FIG. 32D2, the disclub head 205 is mounted a pivotal joint 206. As shown in FIG. 32C1, FIG. 32C2, FIG. 32D1, FIG. 32D2, FIG. 32E1, FIG. 32E2 and FIG. 32F, pulling the cam handle 2632 to rotate on the pixel 26311 to release the lock axle 2631. Pushing the cam handle 2632 to rotate on the pixel 26311, the cam 26310 engages with the fork 2630 to pull the lock axle 2631. As shown in FIG. 32F, the slope 26313 of the lock axle 2631 pushes the slope 20603 of the club head block 2060 to engage the club head block 2060 with the fork 2630.

As shown in FIG. 33A and FIG. 33B, the disclub 20 has the grip 208 and the club head 205. The disclub head 205 is mounted on the disclub head tube 203. As shown in FIG. 38A1 and FIG. 38A2, the grip 208 has the clamping ring 2082 and the cam handle 2081. Pushing the cam handle 2081, the cam at the top of the cam handle 2081 will push the 2082 to lock the handle 2081 to the club 20. As shown in FIG. 33C1, FIG. 33C2, FIG. 33D1, FIG. 33D2, FIG. 37C and FIG. 37D, the extendable disclub 27 adopts the friction segments 2720 and 2730 to hold the extendable disclub 27 in the extended position. The friction force is strong enough to resist the twisting torque of the disclub 27. This twisting torque is generated by the swivel of the disclub to launch the disc 207 to fly.

As shown in FIG. 34A and FIG. 34B, the golf-club style disclub 21 has the handle 208 and the club head 205. The disclub head 205 is mounted on the disclub head tube 203. As shown in FIG. 35A, FIG. 36A1, FIG. 36A2 and FIG. 36A3, the telescopic disclub 22, 22*e* and 22*f* are is in the elongation position. As shown in the FIG. 35A and FIG. 36A1, the callouts show the cross sections of the extendable disclub 22*e*. The disclub tube 221*e* and disclub pole 222*e* have the smooth transition between the circle and elliptical or non-circular cross sections. The elliptical or non-circular section of the disclub tube 221*e* and disclub pole 222*e* at the joint portions can resist the twist torque during the swivel of the disclub. The long/major axis of the elliptical or non-circular cross section is transverse the swivel direction of the extendable disclub 22*e*. As shown in FIG. 35A and FIG. 36A1, the bulk 2212*e* is optional. The bulk 2212*e* can strengthen the joint to resist the twist torque during the swivel of the disclub 22*e*. As shown in FIG. 38B3 and FIG.

38B4, the extended pole 222*e* and tube 221*e* have the elliptical and non-circular section. The tube 221*e* has one cavity 221*c*. The pole 222*e* has one bump 222*b*. The bump 222*b* fits in the cavity 221*c* to lock the pole 222*e* with the tube 221*e*. The knotch 222*k* is to increase the elasticity of the operation of the bump 222*b* and the cavity 221*c*. As shown in FIG. 35B, FIG. 36B1, FIG. 36B2 and FIG. 36B3, the telescopic disclub 22, 22*e* and 22*f* are in the shortened position. As shown in FIG. 36A2 and FIG. 38B2, the screw 2212 is screwed on the tube 221 to tighten the pole 222. As shown in FIG. 36A2, all the callouts have the circle sections. To resist the twist torque, the friction craw 2215 is adopted. As shown in FIG. 36A2, all the callouts of disclub 22 are circular cross sections view. It needs the self-tighten mechanism of friction craw 2215 to resist the twist torque. The length of disclub 22 can be adjusted freely. As shown in FIG. 36A3 and FIG. 36B3, the torque free disclub 22*f* has no torque during the swivel of disclub 22. The extend pole 222*f* has one bend that the disclub head 205 is aligned with the centerline 22*fc* of the torque free disclub 22*f*. Since the disclub head 205 is aligned with the centerline 22*fc* of the torque free disclub 22*f*, the torque is very small during the swivel of the torque free disclub 22*f*.

As shown in FIG. 38C1, FIG. 38C2, FIG. 38D1, FIG. 38D2, FIG. 38E1, FIG. 38E2, FIG. 38F and FIG. 38G, the friction craw 2215 is constituted of the craw 22152 and the driving screw 22151. The driving screw 22151 drives the claw 22152. The friction craw 2215 biases against the internal wall of the tube 221. Rotating the pole 222 to disengage the lock between the pole 222 and the tube 221, the pole 222 can slide inside the tube 221. Rotating the pole in the reverse direction to engage the lock between the pole 222 and the tube 221, the pole 222 is locked with the tube 221. This is the internal lock. Furthermore, there is the external lock. As shown in FIG. 38B1, FIG. 38B2 and FIG. 36A2, the screw 2212 locks the internal sliding pole 222 with the external tube 221. This is the external lock. With both the internal lock and external lock, the sliding pole 222 can be locked to the tube 221 firmly to be the discgolf stick.

Referring to FIG. 38C1, FIG. 38C2 and FIG. 37A, due to the twisting moment, the telescopic disclub 22 has the self-tighten feature to be the right-hand telescopic disclub 22R as shown in FIG. 37A and left-hand telescopic disclub 22L as shown in FIG. 37B.

As shown in FIG. 37A, the extendable disclub 22R is right-hand disclub having the left-hand locking screw 2212L and 2215L. All the callouts have the circular cross sections. The disclub head 205R is right-hand screw.

As shown in FIG. 37A, swiveling the right-hand telescopic disclub 22R, the twisting momentum is left-hand momentum. The friction screw 2215L and the screw 2212L are left-hand screw to have the self-tighten effect.

As shown in FIG. 37B, the extendable disclub is left-hand disclub having the right-hand locking screw 2212R and 2215R. All the callouts have the circular cross sections. The disclub head 205L is left-hand screw.

As shown in FIG. 37B, swiveling the left-hand telescopic disclub 22R, the twisting momentum is right-hand momentum. The friction screw 2215R and the screw 2212R are right-hand screw to have the self-tighten effect.

Being similar to FIG. 32A and FIG. 32B, the U-joint 2312 is made of the U-fork 263J and pivotal head 205J as shown in FIG. 38H. As the cam handle 2632J is pushed down to lock the U-joint 2312, the pivotal block 2060J biases against the wall of U-fork 263J. As shown in FIG. 1D2A, FIG. 38H and FIG. 38I, the end bar 232 is mounted on the joint end 205J, FIG. 38J and FIG. 38K show the isotropic view of the disclub head. FIG. 38L, FIG. 38M, FIG. 38N, FIG. 38O and FIG. 38P show the bottom, side and isotropic views of the gripper 270.

The light DisClub Golf is for the night golf and entrainment. Both the disclub and Golfrisbee can be implemented with the addition of either Fluorescent agent or Phosphor. As shown in FIG. 38W, the light DisClub Golf comprises the light DisClub 2L and the light GolFrisbee 1L. As shown in FIG. 38W, FIG. 38Q and FIG. 38R, the lighted golfrisbee 1L has the discap 105 and light LED 106. As shown in FIG. 38T, the battery 106*b* installed in the light packet 106*p*. The light packet 106*p* has the toggling switching button 106*s* and the LED lights 106*d*. The toggling switch 106*s* turns on and turns off the LED 106*d*. As shown in the FIG. 38T, the light packet 106*p* is installed in the light screw 106*u*. The light screw 106*u* is screwed in the light LED adaptor 106*v*. As shown in FIG. 38Z, the grip mounted on the lighted first tube 271L. The toggling switch 271*s* turns on and turns off the LED 271*d*. The battery 271*b* is installed in the light packet 271*p*. As shown in FIG. 46D, the switch SW can be either the toggling switching button 106*s* and the toggling switch 271*s*. The battery BAT can be either the battery 106*b* or the battery 271*b*. As the switch SW is turned on, the Switch Mode Power Supply light up the LED. The LED can be either the LED 106*d* or the LED 271*d*.

As shown in FIG. 39A and FIG. 14A1, the wrist-wearing video monitor 3 has the video 31 displayed on the flexible film 30. As shown in FIG. 39B and FIG. 23B, the architecture of the head wearing smart phone wireless camera 151 and the video monitor 3 has the DropLess Voltage regulator DLVR, DropLess Current Regulator DLIR, Frequency Phase Lock Loop FPLL, Radio Front RF, Analog Front AF and Inductor Capacitor Oscillator LCO, etc. As shown in FIG. 40A1, FIG. 40A2, FIG. 40B and FIG. 40C, it is the operation of the LC oscillator LCO. The inductor L1 in FIG. 40A2 might be implemented with the inductor as shown in FIG. 42A. As shown in FIG. 41A1, FIG. 41A2, FIG. 41B, FIG. 41C and FIG. 41D, it is the operation of the FPLL.

The conventional concept of the phase noise is completely wrong. The clock oscillation is $$fclk(t)=B+A\sin(\omega t+o(t))$$

Assuming no phase noise, $\phi(t)=0$ $$fclk(t)=B+A\sin(\omega t)$$

$$\omega=2\pi/(LC_{TUNE})^{1/2}$$

To completely specify the sinusoidal oscillation of the clock, we need one set having four parameters, [L, C, A, B].

However, the conventional LCO design has only [L, C] two parameters.

From the following equations, they show the variance of the amplitude ΔA and the wandering variance of the baseline/center line ΔB will generate the phase noise $\phi(t)$.

$$\begin{aligned} fclk(t) &= B + A\sin(\omega t + \phi(t)) \\ &= (B + \Delta B) + (A + \Delta A)\sin\omega t \end{aligned}$$

The variance of [A, B] becomes the phase noise.

$$\phi(t)=\sin^{-1}\{[\Delta B+\Delta A\sin\omega t]/A\}$$

From the above equation, as ΔA=0 and ΔB=0, the phase noise $\phi(t)=0$. In other words, to clean out the phase noises, we need to specify the four parameters, [L, C, A, B] to have the ΔA=0 and ΔB=0.

The amplitude A and baseline B can also be measured with the $A_{PEAK}$: maximum value of A $A_{VALLEY}$: minimum value of A $$A=(A_{PEAK}-A_{VALLEY})/2$$

$$B=(A_{PEAK}+A_{VALLEY})/2$$

As shown in FIG. 40A1 and FIG. 40A2, the oscillator has the Common Mode FeedBack CMFB, B=const, feedback "−ΔB" to cancel the "ΔB" noise. The oscillator has the Constant Amplitude FeedBack CAFB, A=const, feedback "−ΔA" to cancel the "ΔA" noise.

As shown in FIG. 40B, it is the mathematical model of the noiseless LCO. The LCO generates $f_{osc}$ as shown in the curve of $f_{osc}$−f in FIG. 40C. The local oscillator generates frequency $\delta(f_o)$. The local oscillator frequency $\delta(f_o)$ mixes with the LCO output $f_{osc}$. As shown by the curve $f_{noise}$−f in FIG. 40C, the mixture of the output passes the low pass filter LPF to get the $-f_{noise}$. The $-f_{noise}$, feedbacks to cancel the $f_{noise}$.

As shown in FIG. 41A1 and FIG. 41A2, they show the waveforms of the operation of the FPLL Frequency-Phase Lock Loop. FIG. 41B shows the architecture of the controller of the FPLL Frequency-Phase Lock Loop. As shown in FIG. 41D, the complete FPLL is constituted of the FPLL controller and the OSC oscillator as shown in FIG. 40A.

As shown in FIG. 41C, the dotted line is the output frequency of the conventional PLL phase lock loop. The solid line is the output frequency of FPLL. The settling time of the FPLL frequency phase lock is much faster than the conventional PLL. As shown in FIG. 41D, the counter is served as the FLL frequency detector. As shown in FIG. 41B, as the counter finishes count N, the $CLK_{FB}$ is generated. The phase detector is only serves as the PLL phase detector.

As the counter is counted to the preset value N, the counter is reset for the next cycle of frequency count. At beginning of the count, the oscillator has the injection lock synchronization to synchronize the input reference clock with the oscillator. As shown in FIG. 41A1, the oscillation comes earlier than the reference clock; the Inject Lock Synchronization makes the synchronization of the reference clock and the oscillator immediately. As shown in FIG. 41A2, the oscillation comes later than the reference clock; the Inject Lock Synchronization makes the synchronization of the reference clock and the oscillator in the next cycle of the reference clock. As shown in FIG. 41B, FIG. 41A1 and FIG. 41A2, the SyncGate is to control the synchronization of the reference clock and the oscillator.

As shown in FIG. 42A, the planar magnet 40 has the magnet conductor loop 41 and magnet sensor 401. As shown in FIG. 42B 1, it is the nanometer TubeFET having the gate G, source S and drain D. The conducting channel between the source S and gate D is completely surrounding and embedded in the gate G. Being similar to the TubeFET, as shown in FIG. 42B2, the Smart Coil has the magnet coil completely surrounds and driving the magnet sensor 401. The magnet sensor 401 has the similar structure of TubeFET. FIG. 43A shows the smart capless LDVR Low Drop Voltage Regulator having the transient & static loop and the dynamic switch loop. As the output voltage Vo is less than the specified voltage, the input terminals of the linear amplifier is short. The transient & static Loop is equivalent to the nonlinear amplifier as shown in FIG. 43B. For the switching current of the digital circuit, the dynamic switch loop has the fast closed loop. During the voltage sink of the digital circuit switching, the capacitor $C_{SWITCH}$ switches on the P-type switch to pull down the gate of PFET to charge the output.

As shown in FIG. 43C, the output voltage Vout of the conventional LDVR has the ripple. The in-rush current is very high. The voltage sink of the digital circuit switching is very large.

As shown in FIG. 43D, the output voltage Vout of the smart LDVR rises slowly and smoothly. The in-rush current is very small. The voltage sink of the digital circuit switching is very small.

As shown in FIG. 39B and FIG. 44A1, the gliding golfdisc has smart phone and camera comprises the general green power architecture made of dropless voltage regulator DLVR and dropless current regulator DLIR. A capacitor $C_{SW\ connects}$ between the input of the dropless current regulator DLIR and the input of dropless voltage regulator DLVR.

As shown in FIG. 44A2, the chip level green P&G architecture is constitute of the DLVR DropLess Voltage Regulator and DLIR DropLess Current Regulator.

As shown in FIG. 39B, FIG. 44A1 and FIG. 44A2, the gliding golfdisc wherein smart phone and camera comprises green power architecture made of dropless voltage regulator DLVR and dropless current regulator DLIR. A passive charging capacitor $C_{SW}$ connected between an input of said dropless current regulator DLIR and an input of said dropless voltage regulator DLVR. The dropless current regulator DLIR filters out the switching circuit noise in ground to be current noises ΔI. The passive charging capacitor $C_{SW}$ converts the current noises ΔI in the ground node to be the voltage noises ΔV in power node. Instead of the conventional active voltage charge pumping process, this is the passive current charge pumping process. The voltage noises $\Delta V_{DD}$ filtering with said dropless voltage regulator DLVR to be voltage potential energy of clean power supply.

As shown in FIG. 44A1, FIG. 44B1 and FIG. 44B2, the DLVR DropLess Voltage Regulator has the output voltage to be the constant voltage $V_{CC}$. This is the real DC/DC process. The DLIR DropLess Current Regulator has the output current to be the constant current $I_{SS}$. The CKT circuit generates the current $I_{SS}+\Delta I$. Due to the DLIR, the $I_{SS}$ flows through the ground inductor. From $L(dI/dt)=L(dI_{SS}/dt)=0$, the Gnd voltage is the same voltage as PAD_Gnd to be 0V. Due to the buck converter type DLIR Dropless effect caused by the ground inductor, the VSS is 0V.

Comparing FIG. 44A2 with FIG. 44E, FIG. 44A2 is the chip version of Green Power P&G architecture and system. FIG. 44E is the board version of Green Power P&G architecture and system.

As shown in FIG. 44A2, it is the detailed design of the chip version green power P&G architecture and system. The Analog circuit and digital circuit are separated. The switching current noise ΔI generated by the digital circuit injects into the switching capacitor $C_{SW}$. The switching current ΔI of ground node is converted to the switching voltage ΔV of the power node. This behavior is similar to the charge pump circuit. Instead of using the voltage mode as the active drive circuit of charge pump does, the passive circuit switching circuit use the current mode ΔI to do the current charge pump.

The switching current ΔI injects into the switch capacitor $C_{SW}$ to be ΔV. All the switching noise energy injecting into $V_{DD}$ to store in the power inductor $L_V_{DD}$. The switching mode power and the switching noise power add up to be the switch power. The switch power going through the DropLess Voltage Regulator DLVR to be the clean power having the constant voltage $V_{CC}$. The switch noise energy is recycled to be the useful power. The parametric inductor $L_V_{DD}$ serves as the switching energy storage in the dynamic oscillatory form.

As shown in FIG. 43A, FIG. 44C1, FIG. 44C2 and FIG. 44B2, the Low Drop Voltage Regulator LDVR has the voltage drop. The DropLess Voltage Regulator DLVR does not have the voltage drop due to the DLVR has the hybrid operation of the buck-boost-LDVR type inductor operation.

The DropLess Voltage Regulator DLVR has the average of the switch mode power voltage due to the extra inductor as shown in FIG. 44C1. The DLVR DropLess Voltage Regulator is the active RC filter to be rippless and capless. As shown in FIG. 44I, the DropLess Voltage Regulator DLVR is for the dynamic varying high voltage input $V_{HIGH}$. The resistor R has the dual purposes. The first purpose is to shut down the output device $M_{POUT}$ during the power up transient process. The second purpose is to move the third poles to very high frequency to have the same stability as the two-poles system does. Therefore, the stability of the three-poles system is the same as the conventional two-poles LDVR Low Drop Voltage Regulator system does.

As shown in FIG. 44B2 and FIG. 44C2, the waveform of the input of the saw-tooth voltage output of the switch mode power supply is converted to the constant potential voltage of the output power with the active RC filter rippless and capless DLVR Low Drop Buck converter Voltage Regulator.

As shown in FIG. 44B1, FIG. 44D1 and FIG. 44D2, the chip version DLIR DropLess Current Regulator uses the parametric inductor L_Gnd to be the current sensor. The capacitor CJ is to keep the $V_{GS}$ of output NMOS type device to be constant to regulate the current to be constant. The differential amplifier senses the voltage variance ΔV caused by the variance of the current ΔI.

As shown in FIG. 44E, the active Common Mode Choke CM choke is implemented with the DropLess Voltage Regulator DLVR and DropLess Current Regulator DLIR. It is the board version of the green power architecture. It is the merge of the DLVR in FIG. 44C 1 with the DLIR in FIG. 44D1.

As shown in FIG. 44F, the Power Supply Rejection Ratio PSRR of the LDVR has the band-limited frequency in low frequency. The PSRR of conventional Common Mode choke, CM choke, has the band-limited frequency in the high frequency. The PSRR of the Active Common Mode choke, ACM-Choke, has no band limited. The ACM-Choke combines the PSRR of both LDVR and CM Choke to be the flat curve which has no band-limited. The noisy input power VDD is connected to the DLVR as input power. The output of the DLVR is the clean power VCC. The noisy input ground GND is connected to the DLIR. The output of the DLIR is the clean ground VSS.

As shown in FIG. 44A1, FIG. 44A2 and FIG. 44E, the Green Power Architecture and System has the voltage waveforms of $V_{DD}$, $V_{CC}$, $V_{SS}$ and Gnd as shown in FIG. 44G.

As shown in FIG. 44H 1, the SPICE simulation result of the conventional circuit has the waveforms of power VDD and ground GND oscillate violently having the amplitude +/−93 mv.

As shown in FIG. 44A1, FIG. 44A 2, FIG. 44E and FIG. 44H2, with the green power architecture and system of recycling energy, the SPICE simulation result shows the noise amplitudes of VCC, VSS and GND are reduced to be +/−0.05 mV. The noise reduction is 32.7 dB. However, the amplitude of VDD is almost double, +/−160 mV. All the noises in the ground GND is injected and stored in the power VDD. Then the noisy power VDD is filtered to be clean power VCC with the DLVR DropLess Voltage Regulator.

FIG. 45A shows the analog front of the high frequency wireless cellular phone. FIG. 45B shows the high-speed analog front of the digital communication system. It shows the high frequency wireless system and the high-speed digital circuit. The high-frequency wireless system uses the root-mean-square RMS detector to detect the power to adjust the Variable Gain Amplifier VGA. The high-speed digital circuit uses the peak detector to detect the amplitude to adjust the Variable Gain Amplifier VGA. The comparator of the high-speed digital circuit can be considered as the 1-bit ADC of the high-frequency wireless system.

As shown in FIG. 46A and FIG. 46B, the gliding golfdisc comprises the smart phone and camera having bandgap generator BG. The bandgap generator BG further comprises a voltage bandgap generator $V_{BG}$ and current bandgap generator $I_{BG}$. The voltage bandgap generator $V_{BG}$ generates $I_{PTAT}$ current and $V_{BG}$ bandgap voltage and feeding them into the current bandgap generator $I_{BG}$. The current band generator $I_{BG}$ generates the bandgap current $I_{BG}$ and feeding it into the voltage bandgap generator $V_{BG}$.

As shown in FIG. 46A, FIG. 46B and FIG. 46C, the bandgap voltage $V_{BG}$ is generated by the bandgap generator BG. The BG Bandgap Generator is constituted of the voltage bandgap generator $V_{BG}$ Gen and the current bandgap generator $I_{BG}$ Gen. The voltage bandgap generator $V_{BG}$ Gen sends the voltage $V_{BG}$ and the current $I_{PTAT}$ to current bandgap generator $I_{BG}$. The current bandgap generator $I_{BG}$ Gen sends the bandgap current to the voltage bandgap generator $V_{BG}$ Gen. As shown in FIG. 46C, the current flows through bipolar device Q1 is $I_{PTAT}$ and the voltage across the bipolar device Q1 is $V_{CTAT}$. Therefore, the current flowing through $R_{3A}$ is $I_{CTAT}$. With the adjustment of $R_{3A}$, the current flowing through $R_{1A}$ is the bandgap current $$I_{BG}=I_{PTAT}+C_{TAT}.$$

The currents flowing through $R_{2A}$ and $R_{2B}$ are the non-linear compensation for the logarithm factor of the $V_{CTAT}$.

As shown in FIG. 47, the Separation/Parting line of disc determines the performance of disc. The lower the Separation/Parting line is, the more lift is and the less stability is. The higher the Separation/Parting line is, the less lift is and the more stability is. To break the rule, the golfdisc adopts the flat bottom with the tail flap. It has the maximum lift and the maximum stability.

As shown in FIG. 48, the solid line is the flow trajectory of the golfdisc. The dotted line is the conventional disc. At the front portion, the tail flap has the higher lift. For the golfdisc, the flow hits the rear portion of the dome area. For the conventional disc, the flow hits the front portion of the dome area. Therefore, the Center of Pressure CP of the golfdisc is located after the Center of Pressure CP of conventional disc. Therefore, the stability of the golfdisc is more stable than the conventional disc does. At the rear portion, for the golfdisc, due to the tail flap, the airflow bypasses the flat bottom and the cavity of the discap 105. For the conventional disc, the air blows into the cavity of discap 105. Therefore, the drag of golfdisc is much less than the conventional disc. At the side of disc 10, the golfdisc flap has more stability than the conventional disc without the flap. Therefore, the disc with the flap is the biggest innovation in the disc golf.

The camera, video display and monitor have the green power architecture made of the DLVR DropLess Voltage Regulator, DLIR DropLess Current Regulator and Switch Noise Power Charging Capacitor to convert the noise energy to be the useful power. The camera, video display and monitor further have the Bandgap Generator being constituted of the Voltage Bandgap Generator and Current Generator. The Frequency-Phase Lock Loop comprises the frequency lock and phase lock two stages and the frequency lock is implemented with the counter. The DropLess Voltage Regulator DLVR is implemented with the hybrid combination of the LDVR and P-side buck type inductor. The DropLess Current Regulator DLIR is implemented with the sense of voltage difference of the parasitic inductor induced by the variance of the current. The active common mode choke ACM is made of the common mode choke, the DLVR DropLess Voltage Regulator, DLIR DropLess Current Regulator and Switch Noise Power Charging Capacitor.

While the invention has been particularly shown and described with reference to the preferred embodiments thereof, it will be understood by those skilled in the art that various changes in form and details may be made therein without departing from the spirit and scope of the invention. It is noted that this disclub golf design can be easily modified to be the left-handed ultra-long-drive disc and disclub with the right-hand screws changing to be the left-hand screws. Furthermore, it is noted that the discap and head positions can be interchangeable for disclub and golfdisc. In other words, even in the previous description, all the discussion is based on the alignment of the disclub head 10 being on disclub 1 and the discap 20 is on golfdisc 2. However, the alignment of the fitting discap is on disclub and the head is on golfdisc is also workable. The same principles and methodologies, etc are applicable to both cases. All the innovations made for the golfdisc of disclub golf can be applied to the conventional disc of disc golf, too.

We claim:

1. A disc sport means comprises a flying disc, said flying disc comprising an annular rim and a central section joined together by an annular shoulder, and formed in a single piece, said rim further comprising a right triangular aerofoil cross-section and right triangle wing-fin-flap cross-section; said aerofoil having a right triangular longer leg edge and a wing-fin-flap downward inclined hypotenuse edge defining a lower plane of said disc, and said central section having an upper zone defining an upper plane of said disc, at front position of said flying disc flying direction, said wing-fin-flap having increasing lift flap function to guide horizontal air flow downward to increase lift; at left edge and right edge of said flying disc flying direction, said wing-fin-flap having wing and fin side stability function; said right triangular cross-section aerofoil with a lower flat edge of leg, said right triangular wing-fin-flap with a lower hypotenuse and a leg forming said lower edge, an outer rounded corner with said outer corner located at lower plane, and an upper corner merging with said shoulder, said shoulder decreasing in thickness from said rim to said central section, and with the outer surface of said disc from said rim outer corner to said central section having a continuous smooth curved lifting surface, and the upper surface of said central section being substantially flat when the disc is stationery, with said central section being sufficiently thin and flexible to dome upwards when in flight; further comprising a discap means, said discap means being rotationally mounted on a disclub head means, said disclub head means being mounted on a pole of a disclub of disclub golf means; said disclub head means having screws notched on a cylinder wall, said discap means having a central plateau means fitting inside of said cylinder wall, said discap means having a plurality of locking click points on the outside wall of said central plateau means, said disclub head means having a plurality of locking click points on the inside of said cylinder wall, a half circle closing near grip side of said pole means, at top of said screws, said cylinder wall of said disclub head means being removed from root of said screws to have slope to remove said disc horizontally.

2. A disc sport means comprises a flying disc according to claim 1, said right triangular cross-section aerofoil with said lower flat edge of leg further comprises a concave groove, said right triangular cross-section aerofoil with said lower flat edge of leg, said concave groove, said right triangular wing-fin-flap with said lower hypotenuse and a leg forming said lower edge to be said lower plane, an outer rounded corner with said outer corner located at lower planes and an upper corner merging with said shoulder.

3. A disc sport means comprises a flying disc according to claim 1, for said annular rim, a lower plane having dimples on surface of said flying disc further having a coating with solar cells.

4. A disc sport means comprises a flying disc according to claim 1, said closed rim airfoil further comprising a slat-fin-flap-head-adaptor, said slat-fin-flap-head-adaptor being parallel to said vertical curve edge of said closed rim airfoil having a narrow open space between said adaptor and said vertical curve edge of said closed rim airfoil; said slat-fin-flap-head-adaptor serving as adaptor to wear said flying disc on a head; said slat-fin-flap-head-adaptor serving as slat at rear portion of said flying disc flying direction; said slat-fin-flap-head-adaptor serving as flap at front portion of said flying disc flying direction; said slat-fin-flap-head-adaptor serving as fin at right edge and left edge of said flying disc flying direction; said open space between said slat-fin-flap-head-adaptor and said vertical curve edge of said closed rim airfoil being narrow that said slat-head-adaptor-flap further reducing air resistance of stagnation point of said vertical curve edge of said closed rim airfoil that the space being narrow.

5. A disc sport means comprises a flying disc according to claim 1, said disc further comprising bumper-fin-slat, said bumper-fin-slat having section in triangle shape; said bumper-fin-slat being annular rim at the same level of said rim outer corner and having a gap between said disc and said bumper-fin-slat; at front of said disc flying direction, said bumper-fin-slat having increasing lift function of slat; at side of said disc flying direction, said bumper-fin-flat having stability function of fin; as said disc hitting other staff, said bumper-fin-slat serving as bumper cushion to reduce impact force.

6. A disc sport means comprises disclub according to claim 1 being multiple section disclub, said disclub head being mounted on an end pole; said end pole sliding in poles having larger sizes; said end pole having an oil ring to hold said end pole in a first pole.

7. A disc sport means comprises a disclub according to claim 1 being a night disclub of night golf, said disclub being transparent; said disclub having battery means, LED means and switch means embedded in said disclub; turning on said switch means, said battery means connecting with said LED means and lighting on said disclub; said disclub having a coating with solar cells to charge up said battery means.

8. A disc sport means comprises a disclub according to claim 1 being a night disc and disclub of night golfrisbee, said night disclub and night golfrisbee implemented with the addition of either Fluorescent agent or Phosphor means.

9. A disc sport means comprises a flying disc according to claim 1 being a night disc of night golf, said disc being transparent; said disc having battery means, LED means and switch means embedded in said disc; turning on said switch means, said battery means connecting with said LED means and lighting on said disc; said disc having a coating with solar cells to charge up said battery means.

10. A circular flying disc according to claim 1 of said disc means further comprising a discap means, said discap means being mounted on said disc and said disc being removable from said disc.

11. A smart iHat means comprises a discopter, said discopter comprising an annular rim, for said annular rim, having a plurality of propellers being embedded in said annular rim to be discopter; further comprising a discap means, said discap means being rotationally mounted on a disclub head means, said disclub head means being mounted on a pole of a disclub of disclub golf means; said disclub head means having screws notched on a cylinder wall, said discap means having a central plateau means fitting inside of said cylinder wall, said discap means having a plurality of locking click points on the outside wall of said central plateau means, said disclub head means having a plurality of locking click points on the inside of said cylinder wall, a half circle closing near grip side of said pole means, at top of said screws, said cylinder wall of said disclub head means being removed from root of said screws to have slope to remove said disc horizontally.

12. A smart hat means of iHat comprises a discopter according to claim 11 further comprising a head adaptor to be said smart hat means of iHat; said head adaptor of iHat being attached to said annular rim, said head adaptor of said iHat having an adjustable belt structure to fit different head size.

13. A smart hat of iHat means comprises a discopter according to claim 11 further comprising a camera means and a cellular phone means and microphone means; said camera means and a cellular phone means and microphone means being embedded in said annular rim with pivotal joints.

14. A smart hat of iHat means comprises a discopter according to claim 11, said smart iHat means having an annular slat-fin-flap to be adaptor for head; said annular rim being closed-figure airfoil comprising propellers, camera and cellular phone made of nanometer TubeFET and Smart Coil embedded in said flying ring; said TubeFET being FET in tube form.

15. A golf sport means comprises golfdisc means and golfring means being compatible with golfball courses, said golfball course comprising a flagpole to indicate a hole for golfball; said golfdisc means being thrown to avoid blockage of trees; said golfdisc means being changed with golfring means to toss said flagpole; said golfring means being tossed said flag pole of said golf courses; further comprising a discap means, said discap means being rotationally mounted on a disclub head means, said disclub head means being mounted on a pole of a disclub of disclub golf means; said disclub head means having screws notched on a cylinder wall, said discap means having a central plateau means fitting inside of said cylinder wall, said discap means having a plurality of locking click points on the outside wall of said central plateau means, said disclub head means having a plurality of locking click points on the inside of said cylinder wall, a half circle closing near grip side of said pole means, at top of said screws, said cylinder wall of said disclub head means being removed from root of said screws to have slope to remove said disc horizontally.

16. A golf sport means according to claim 15, said golf ring means comprising a closed-figure airfoil and annular slat-fin-flap, and formed in a single piece of flexible plastic, a slat-fin-flap at the inner side of said annular rim, at front side of said flying ring flying direction, said slat-fin-flap serving as flap; at rear side of said flying ring flying direction, said slat-fin-flap serving as slat; at left side and right side of said flying ring flying direction, said slat-fin-flap serving as fin, said closed-figure airfoil having a platform comprising an upper and lower surface, a central opening, an inner perimeter encompassing said central opening, an outer perimeter encompassing said inner perimeter, an axis of revolution which is substantially normal to the planes described by said inner and outer perimeters, said airfoil having a cross-section comprising a line defining said lower surface, a convex line defining said upper surface, said convex line reaching a zenith which is the highest point on the airfoil section of said ring.

17. A golf sport means comprises a flying ring according to claim 15, said flying ring further comprising a bumper-slat-flap means, said bumper-slat-flap means upper surface located on or near said outer perimeter with a narrow gap between said bumper-slat-flap means and said outer perimeter, said bumper-slat-flap means extending to a narrow peak which is higher than the immediately adjacent portion of said upper surface.

18. A golf sport means comprises a flying ring according to claim 16, said flying ring comprising a closed-figure airfoil, there being dimples on upper surfaces of said closed-figure aerofoil with dimples on bottom surfaces of said closed-figure aerofoil.

19. A golf sport means according to claim 15 of which said golfring means further comprising a discap means, said discap means being rotationally mounted on a disclub head means, said disclub head means being mounted on a pole of a disclub of disclub golf means; said disclub head means having screws notched on a cylinder wall, said discap means having a central plateau means fitting inside of said cylinder wall, said discap means having a plurality of locking click points on the outside wall of said central plateau means, said disclub head means having a plurality of locking click points on the inside of said cylinder wall, a half circle closing near grip side of said pole means, at top of said screws, said cylinder wall of said disclub head means being removed from root of said screws to have slope to remove said ring horizontally.

* * * * *